US006960987B2

(12) United States Patent
Dohi et al.

(10) Patent No.: US 6,960,987 B2
(45) Date of Patent: Nov. 1, 2005

(54) FIRE ALARM SYSTEM, FIRE SENSOR, FIRE RECEIVER, AND REPEATER

(75) Inventors: Manabu Dohi, Kanagawa-ken (JP); Masahiko Nemoto, Kanagawa-ken (JP); Naoto Yamano, Kanagawa-ken (JP); Hiroshi Shima, Kanagawa-ken (JP); Naoya Matsuoka, Tokyo (JP)

(73) Assignee: Hochiki Corporation (JP)

( * ) Notice: Subject to any disclaimer, the term of this patent is extended or adjusted under 35 U.S.C. 154(b) by 87 days.

(21) Appl. No.: 10/246,616

(22) Filed: Sep. 19, 2002

(65) Prior Publication Data

US 2003/0058093 A1 Mar. 27, 2003

(30) Foreign Application Priority Data

| | | |
|---|---|---|
| Sep. 21, 2001 | (JP) | 2001-288306 |
| Sep. 25, 2001 | (JP) | 2001-290575 |
| Sep. 28, 2001 | (JP) | 2001-300525 |
| Oct. 26, 2001 | (JP) | 2001-329733 |

(51) Int. Cl.[7] ..... G08B 5/00

(52) U.S. Cl. ..... 340/286.05; 340/506; 340/538; 340/577

(58) Field of Search ..... 340/286.05, 286.02, 340/506, 538, 577

(56) References Cited

U.S. PATENT DOCUMENTS

| | | | | |
|---|---|---|---|---|
| 4,477,800 A | | 10/1984 | O'Brien | 340/505 |
| 4,610,012 A | * | 9/1986 | Terada et al. | 370/527 |
| 4,725,818 A | | 2/1988 | Motyka et al. | 340/514 |
| 5,017,905 A | * | 5/1991 | Yuchi | 340/506 |
| 5,131,019 A | | 7/1992 | Sheffer et al. | |
| 5,493,271 A | | 2/1996 | Kobayashi et al. | 340/505 |
| 5,754,103 A | * | 5/1998 | Kanai et al. | 340/507 |
| 6,104,286 A | * | 8/2000 | Luquette | 340/506 |
| 6,229,429 B1 | | 5/2001 | Horon | 340/286.01 |

FOREIGN PATENT DOCUMENTS

| | | |
|---|---|---|
| EP | 0 396 386 | 11/1990 |
| EP | 0 751 488 | 1/1997 |
| EP | 1 296 301 | 3/2003 |
| GB | 2 095 014 | 9/1982 |
| JP | 2001-184571 | 7/2001 |
| WO | WO 98/49663 | 11/1998 |

OTHER PUBLICATIONS

Partial European Search Report, Aug. 28, 2003.
European Search Report, dated Feb. 3, 2004.

* cited by examiner

*Primary Examiner*—Brent A. Swarthout
(74) *Attorney, Agent, or Firm*—Blank Rome LLP

(57) ABSTRACT

Disclosed herein is a fire alarm system for connecting a plurality of fire sensors to sensor lines, and giving an alarm in response to fire information output from the fire sensor in a line unit. The fire alarm system includes a current modulation section and an address specification section. The current modulation section is used for maintaining a current flowing in the sensor line at a predetermined value for a predetermined time at the time of a fire, and modulating the current in accordance with the inherent address information of the fire sensor. The address specification section is used for sensing fire information by judging whether or not the current has been maintained at the predetermined value for the predetermined time, and also for specifying the inherent address of the fire sensor that issued the fire information, from the modulated state of the current.

4 Claims, 47 Drawing Sheets

FIG. 4
(a)
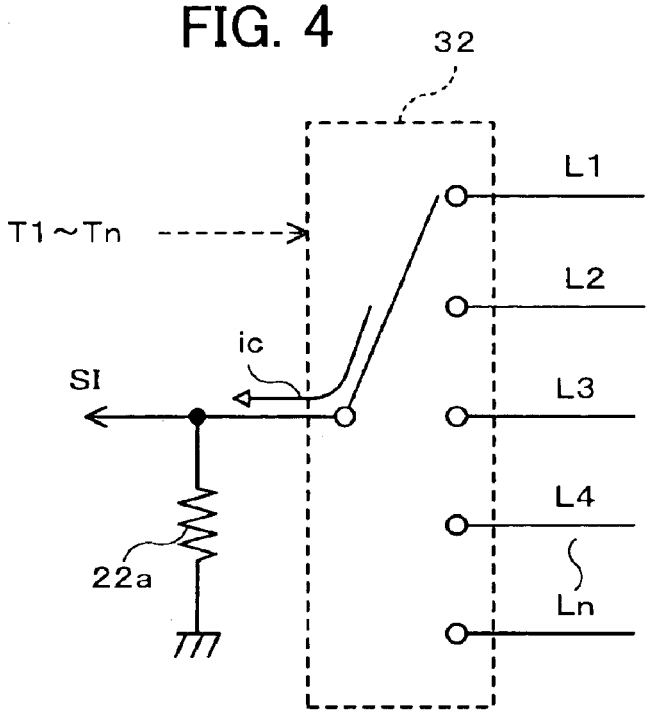
(b)
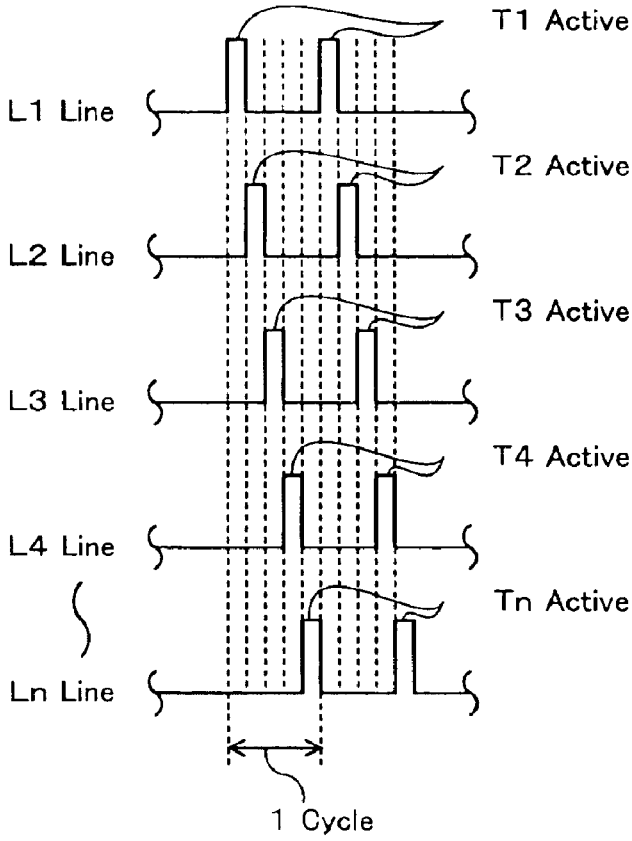

FIG. 5
(a)
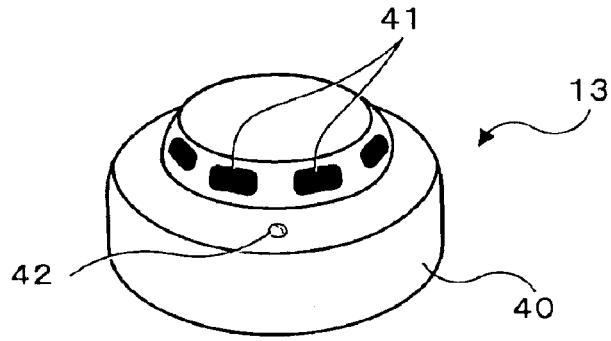
(b)
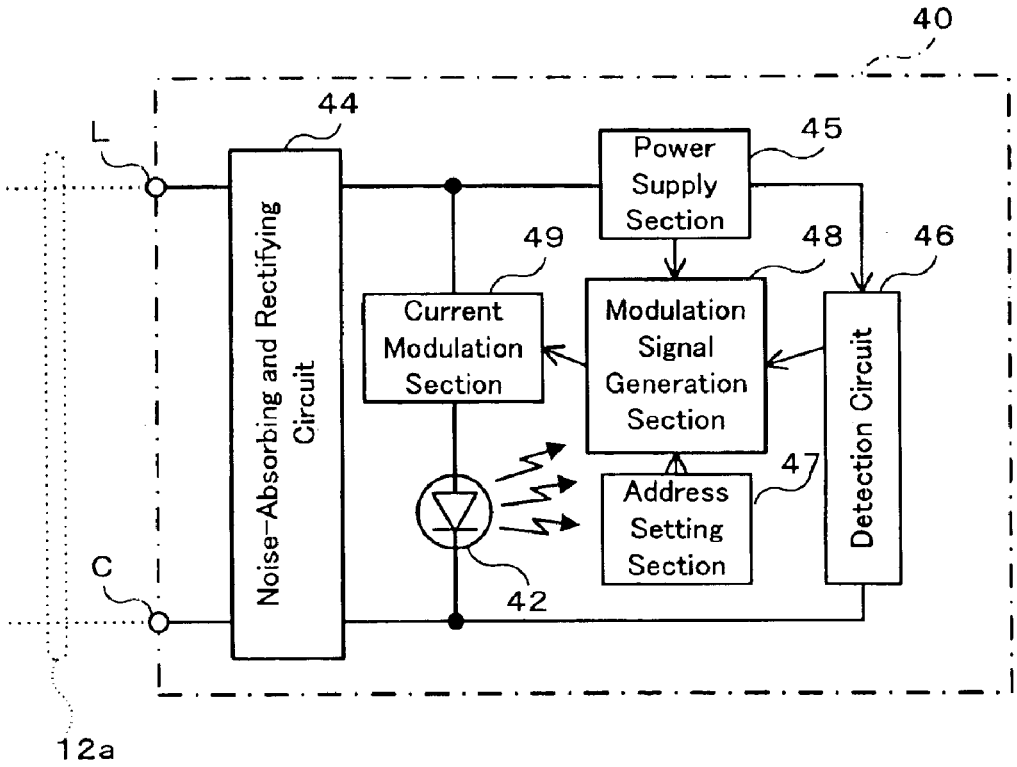

FIG. 10
(a)
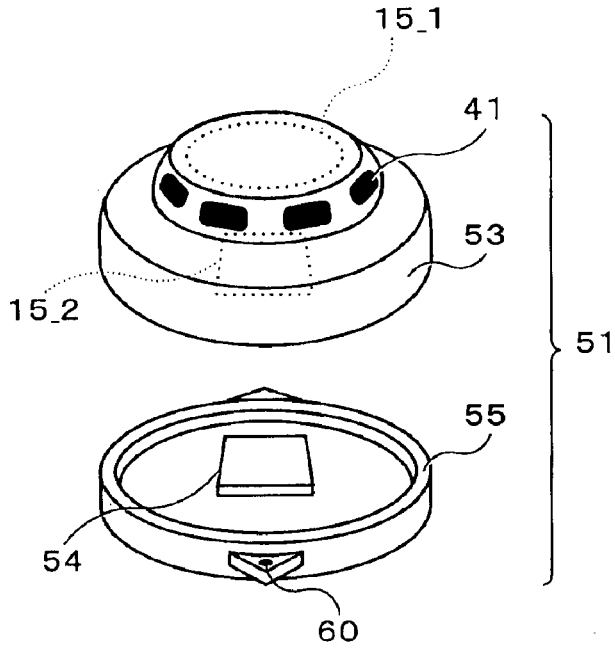
(b)
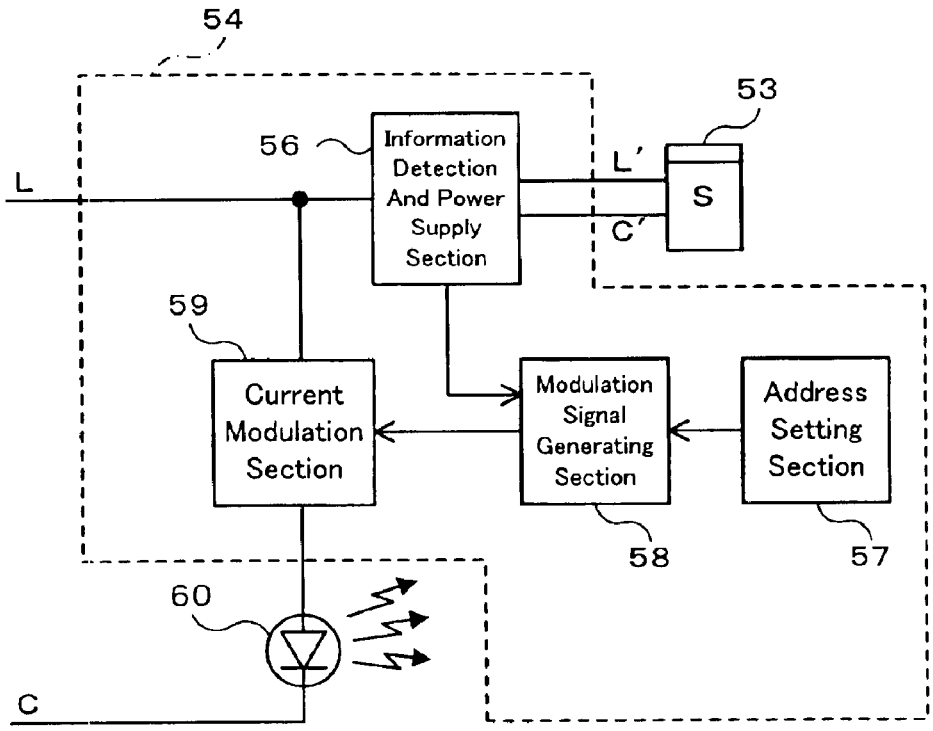

FIG. 11
(a)
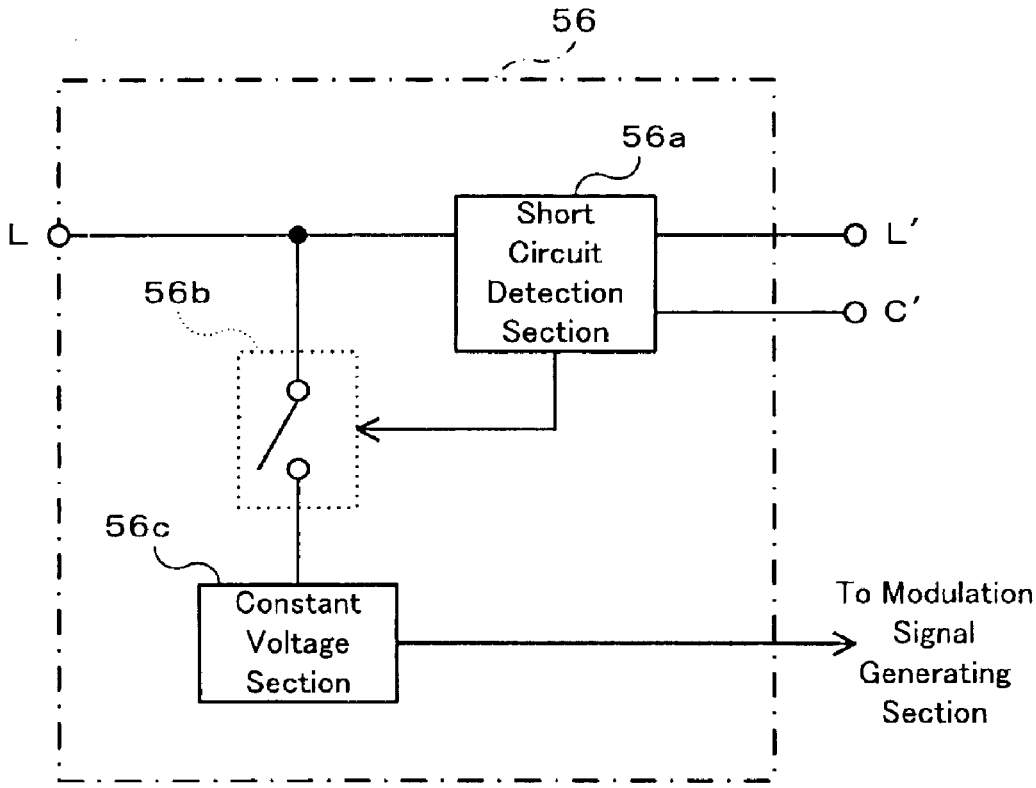
(b)
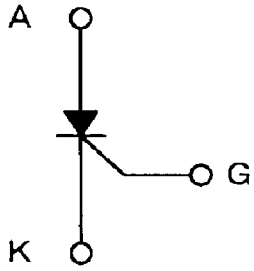

FIG. 21
(a)
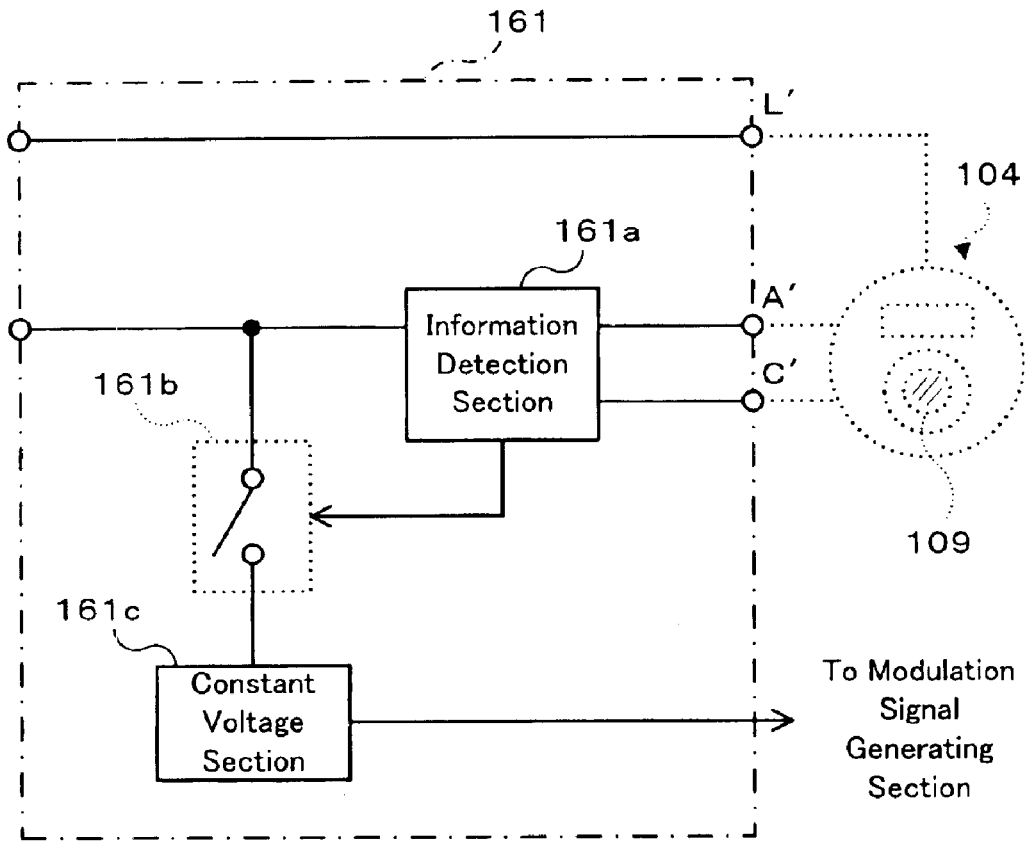
(b)
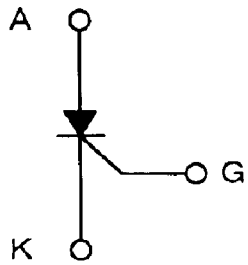

FIG. 22
(a)
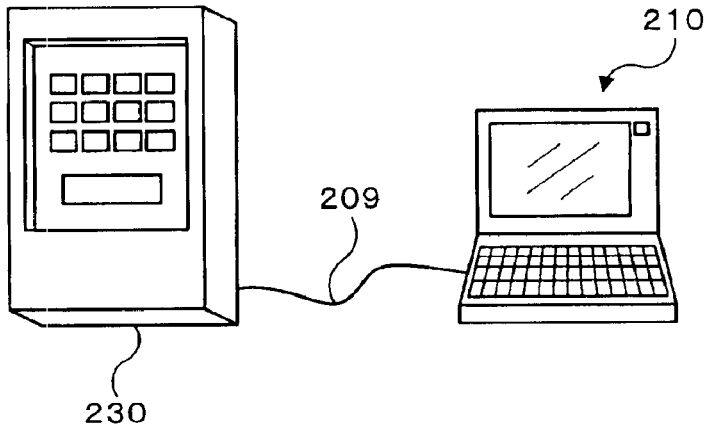
(b)
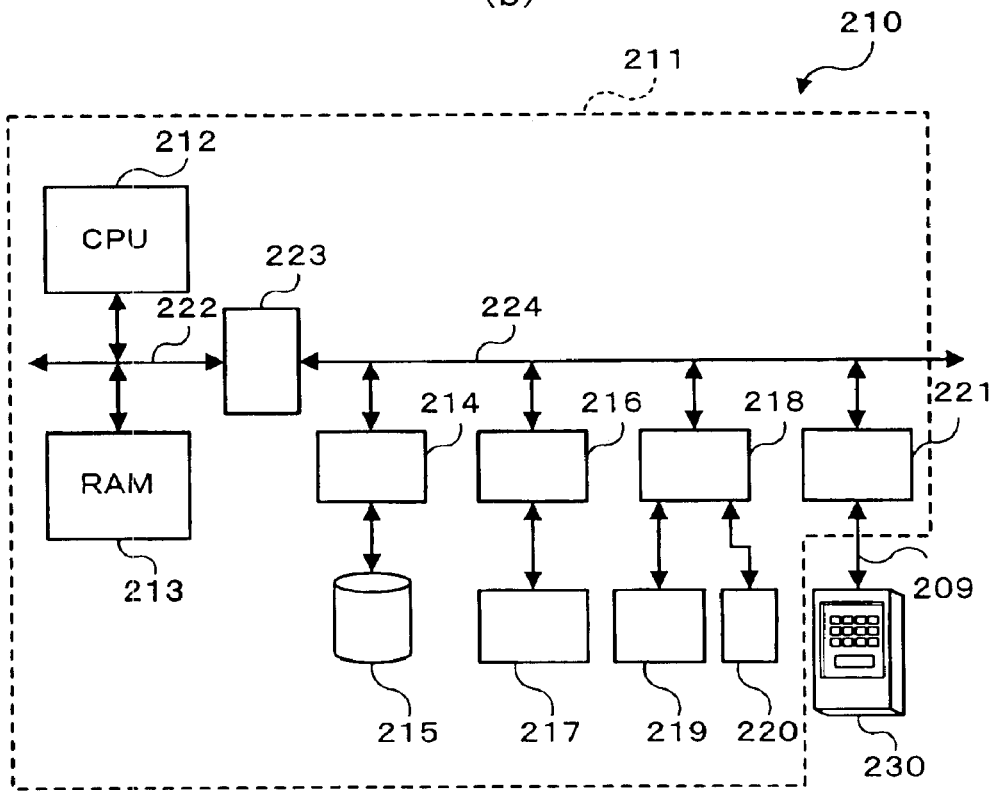

FIG. 25
(a)
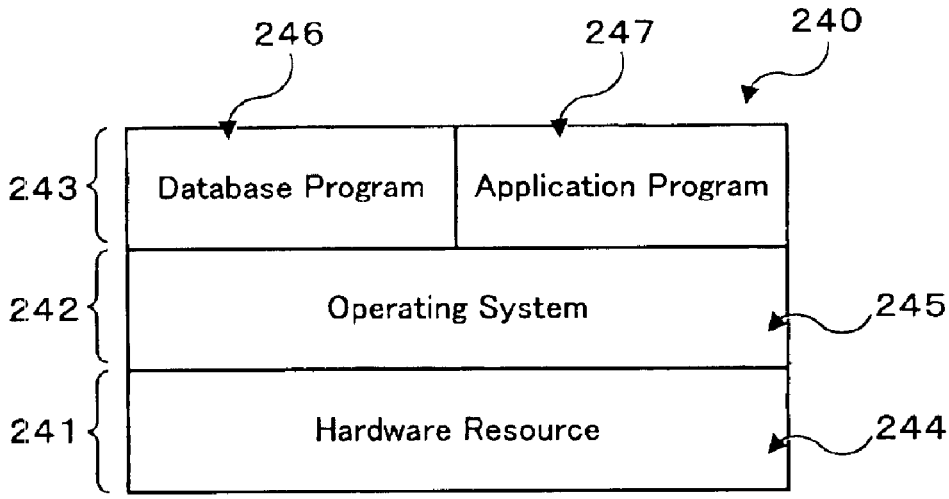
(b)
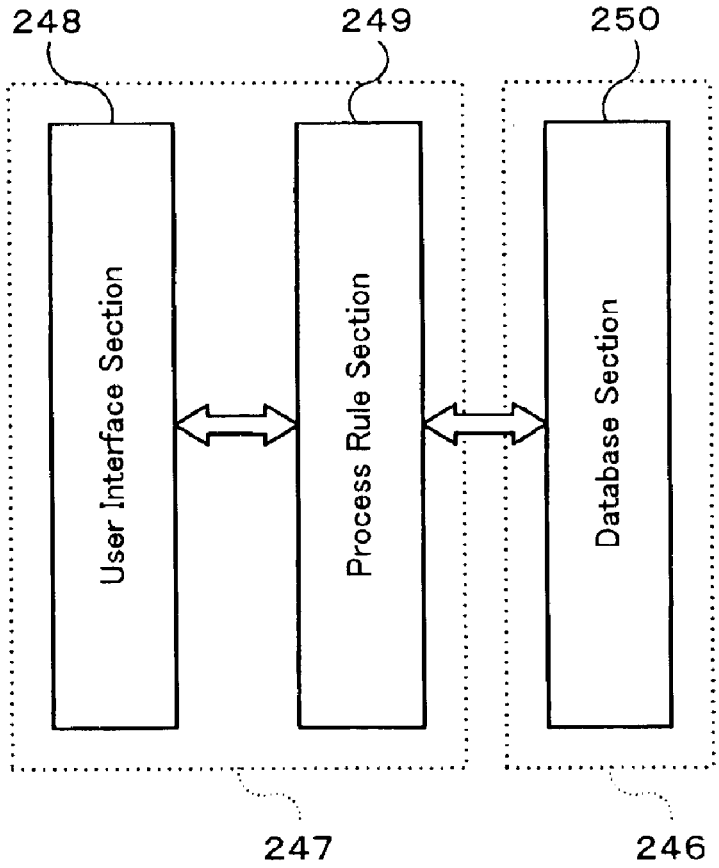

(a)

(b)

263a 263b 263c 263

| Address | Floor Name | Room Name |
|---|---|---|
| A001 | 1st Floor | Room No. 101 |
| A002 | 1st Floor | Room No. 102 |
| A003 | 1st Floor | Room No. 103 |
| A004 | 2nd Floor | Room No. 201 |
| A005 | 2nd Floor | Room No. 202 |
| A006 | 2nd Floor | Room No. 203 |

FIG. 28
(a)
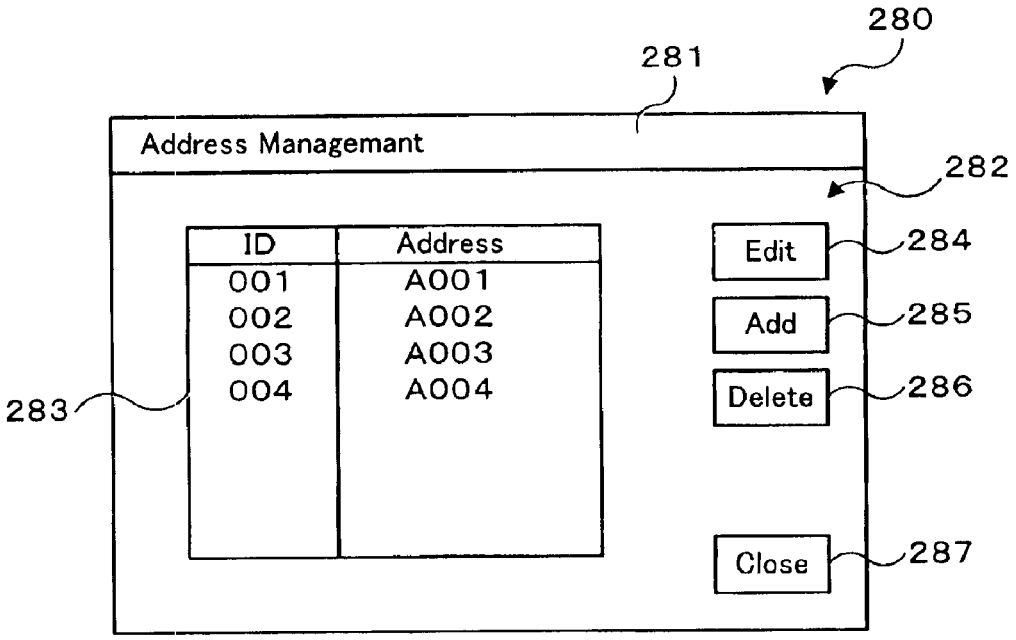
(b)
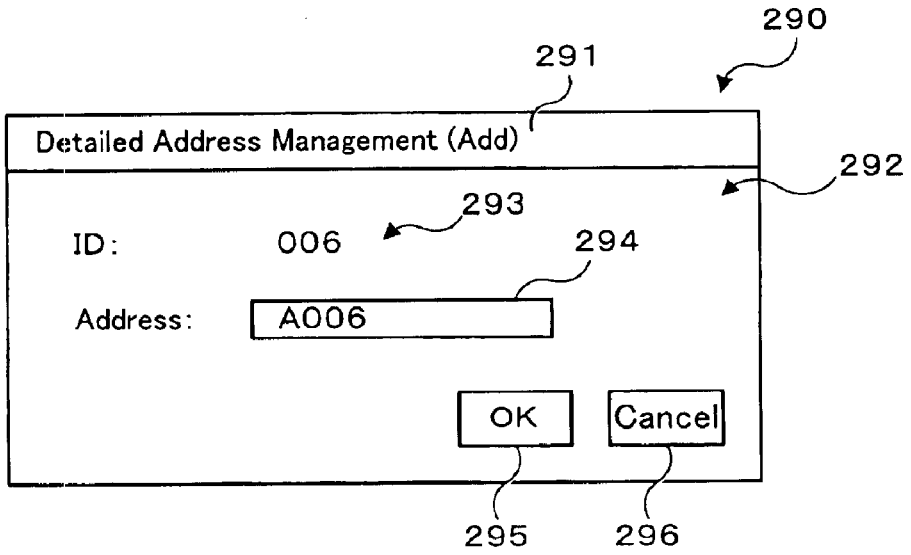

FIG. 29
(a)
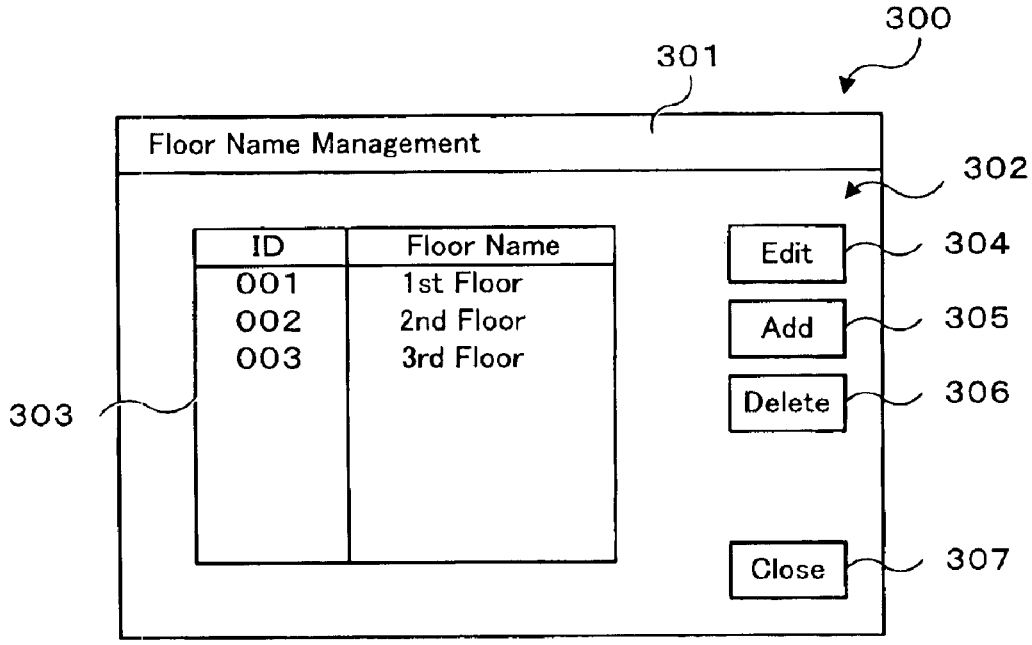
(b)
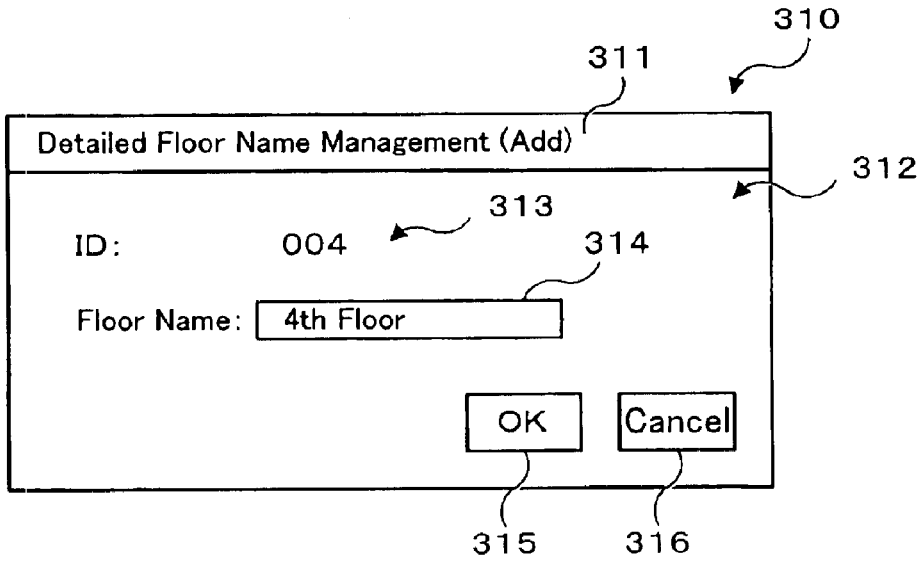

FIG. 30
(a)
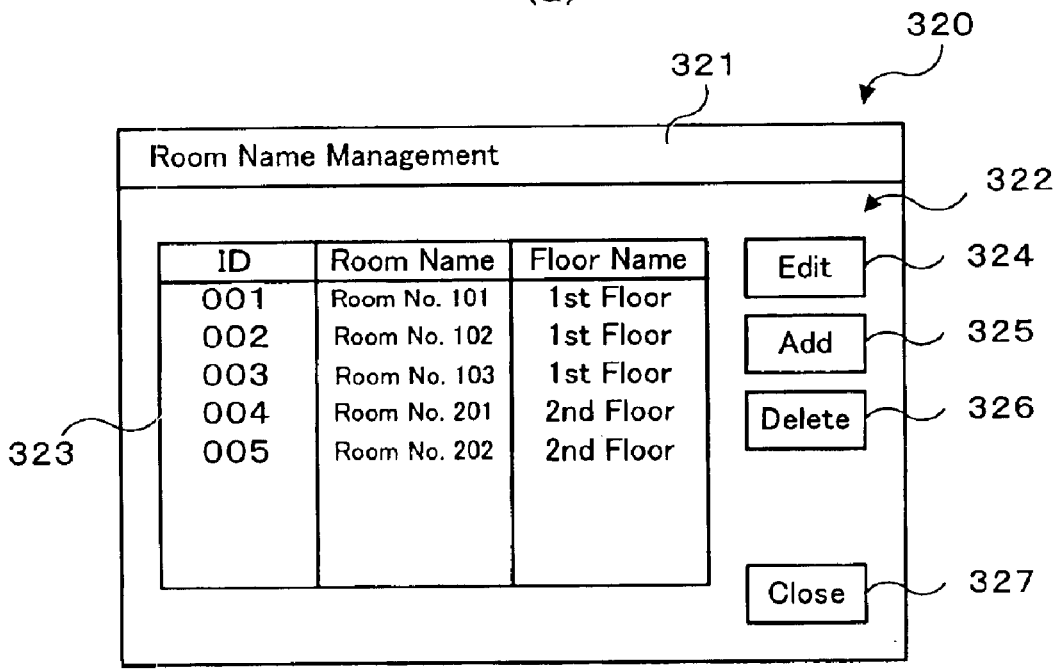
(b)
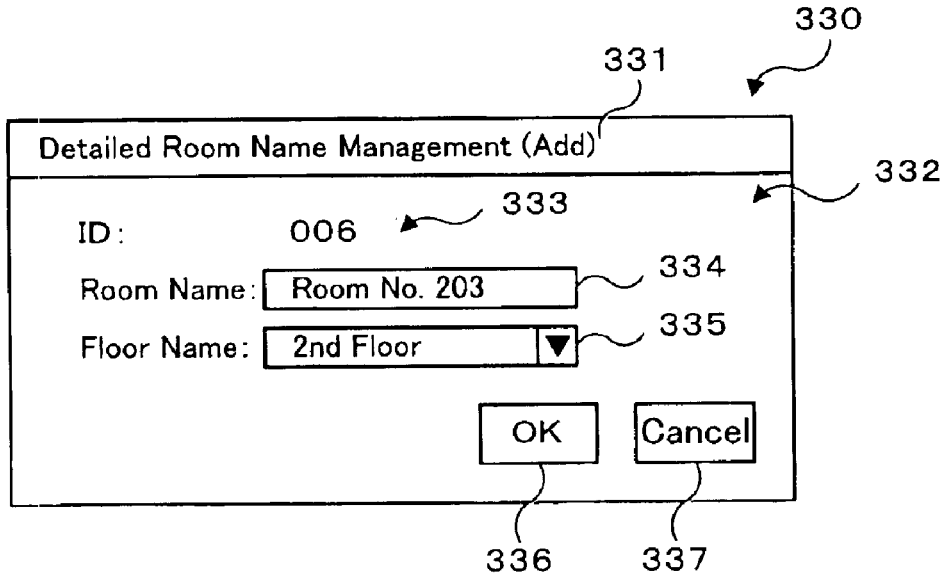

FIG. 31
(a)
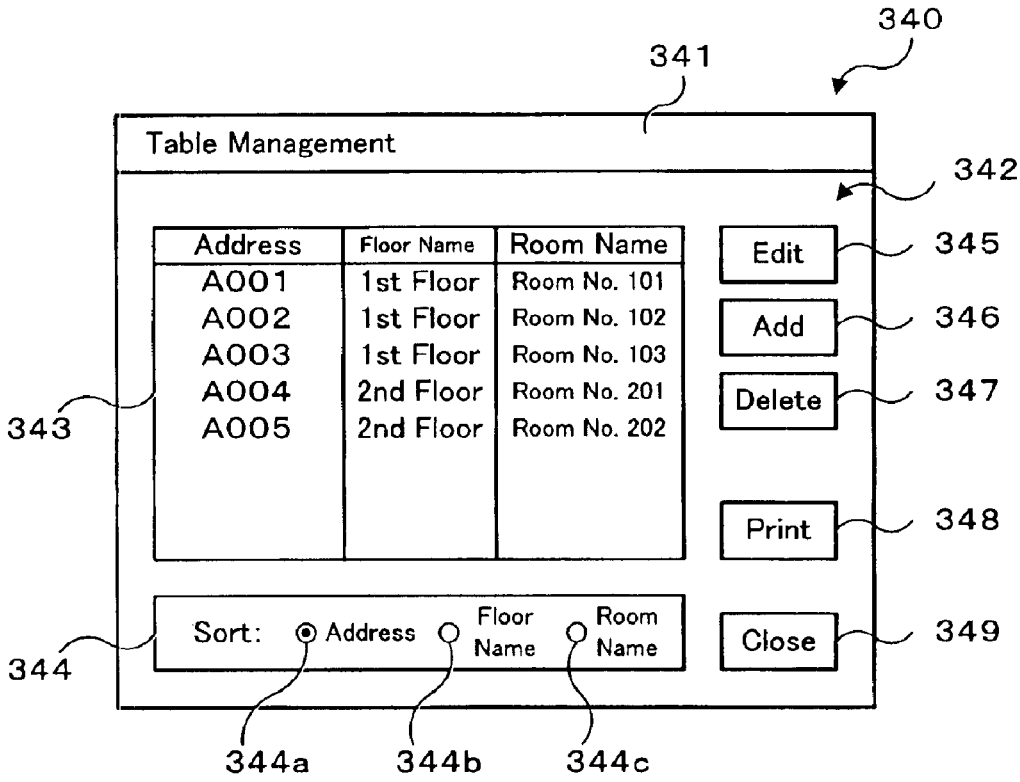
(b)
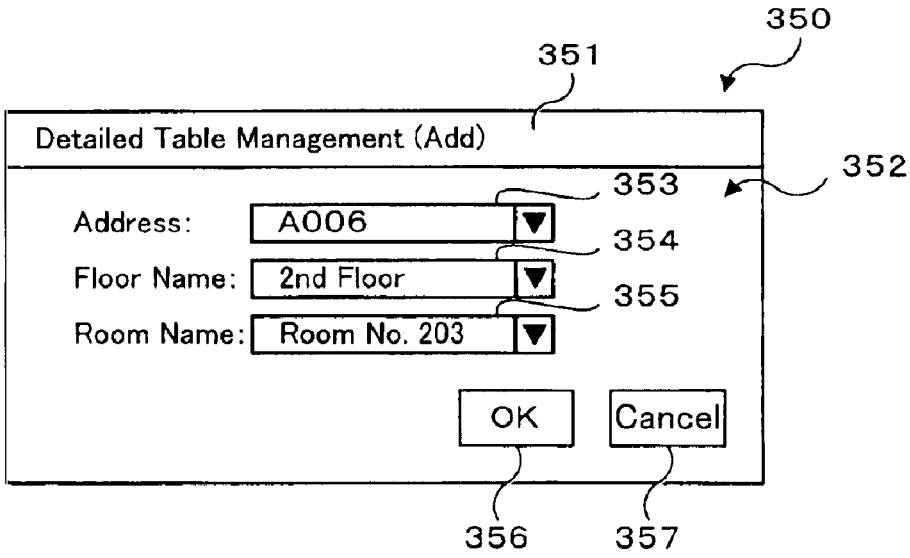

FIG. 32

(a)

Address Table List (Address Sort)

| Address | Floor Name | Room Name |
|---|---|---|
| A001 | 1st Floor | Room No. 101 |
| A002 | 1st Floor | Room No. 102 |
| A003 | 1st Floor | Room No. 103 |
| A004 | 2nd Floor | Room No. 201 |
| A005 | 2nd Floor | Room No. 202 |

Sort Item (b)

Address Table List (Floor Name Sort)

| Floor Name | Room Name | Address |
|---|---|---|
| 1st Floor | Room No. 101 | A001 |
| 1st Floor | Room No. 102 | A002 |
| 1st Floor | Room No. 103 | A003 |
| 2nd Floor | Room No. 201 | A004 |
| 2nd Floor | Room No. 202 | A005 |

Sort Item (c)

Address Table List (Room Name Sort)

| Room Name | Floor Name | Address |
|---|---|---|
| Room No. 101 | 1st Floor | A001 |
| Room No. 102 | 1st Floor | A002 |
| Room No. 103 | 1st Floor | A003 |
| Room No. 201 | 2nd Floor | A004 |
| Room No. 202 | 2nd Floor | A005 |

Sort Item (a)

(b)

3

| Address | Place |
|---|---|
| A001 | 1st Floor Room No. 101 |
| A002 | 1st Floor Room No. 102 |
| A003 | 1st Floor Room No. 103 |
| A008 | nth Floor Room No. n02 |
| A009 | nth Floor Room No. n03 |

(a)

420a

420a_1 420a_2

| Address | Room Name |
|---|---|
| 1 | Business Dep. |
| 2 | Design Dep. |
| 3 | Patent Dep. |
| 4 | General Affairs Dep. |
| ⋮ | ⋮ |

(b)

(a)

(b)

451

| Test Date | Line | Address | Room Name | Status |
|---|---|---|---|---|
| 2001/09/10 12:00 | L1, | 1, | Business Dep. , | OK |
| 2001/09/10 12:10 | L1, | 2, | Design Dep. , | OK |
| ⋮ | | | | |
| 2001/09/10 13:00 | L5, | 3, | Delivery Dep. , | NG |

PRIOR ART

PRIOR ART

FIRE ALARM SYSTEM, FIRE SENSOR, FIRE RECEIVER, AND REPEATER

BACKGROUND OF THE INVENTION

1. Field of the Invention

The present invention relates generally to a fire alarm system, a fire sensor, a fire receiver, and a repeater, and more particularly to a fire alarm system which includes fire sensors provided at the predetermined places within a building, and a fire receiver for receiving a fire alarm signal from the fire sensors.

2. Description of the Related Art

FIG. 46 shows a proprietary type fire alarm system (hereinafter referred to as a P-type fire alarm system). This fire alarm system includes a fire receiver 2, which has a plurality of sensor lines L1 to Ln. Each of the sensor lines L1 to Ln are connected with a great number of fire sensors 1. The operations of the fire sensors 1 are collectively monitored for each sensor line by the fire receiver 2.

The range to be monitored by the P-type fire alarm system is not the unit of a single fire sensor 1 but the unit of a sensor line (L1 to Ln) to which a plurality of fire sensors 1 are connected. Therefore, when a certain fire sensor 1 is operated, an area allocated to a sensor line (e.g., line L1) including the operated fire sensor 1 is specified as the place of the occurrence of a fire by the fire receiver 2.

However, it is desirable that the place of the occurrence of a fire be pinpointed. In view of that point, the present applicant has proposed a fire alarm system (Japanese Patent Application No. HEI 11-366915 (Dec. 24, 1999)). The fire alarm system includes a receiver (equivalent to a fire sensor), and a plurality of fire sensors connected to a sensor line. In the fire alarm system, a fire information signal from a fire sensor is received in the unit of a line (equivalent to L1 to Ln). The fire alarm system further includes a retrieval section and a response section. The retrieval section is provided on the side of the receiver. When fire information is sensed, the retrieval section sends a retrieval signal on the line from which the fire information was issued, and retrieves the fire sensor which issued the fire information. The response section is provided for each of the fire sensors. The response section sends back a retrieval response signal when it recognizes the above-described retrieval signal at the time of a fire.

The fire receiver issues an alarm, if it receives a fire information signal from a fire sensor. At the same time, the fire receiver sends out a retrieval signal on the line from which fire information was issued. On the other hand, the fire sensor which issued fire information sends back a retrieval response signal, if it receives the retrieval signal from the fire receiver. In this manner, a fire alarm system of a question/answer type is constructed.

Therefore, since the fire sensor that answered can be specified by the fire receiver, the place of a fire can be pinpointed in the unit of a fire sensor. As a result, the accuracy of a fire alarm can be considerably enhanced.

In the above-described fire alarm system, the fire receiver includes the above-described retrieval section, and the fire sensor includes the above-described response section. Between the retrieval section and the response section, a question/answer system is constructed. A question and an answer are performed with a single transmission line in which transmission and reception are switched. Because of this, if the line number n is increased, the time for specifying the place of a fire will be increased in proportion to the line number n.

In addition, in such a fire alarm system, sensors must have a dedicated line that can answer the signal from the transmitter in order to specify a sensor that issued an alarm. Therefore, the fire alarm system has the disadvantage that it cannot utilize the existing systems.

FIG. 47A shows a fire alarm panel provided in public facilities such as a school, etc. The fire alarm panel 101 is attached, for example, to the wall of a building and includes a bell 102, a red display light 103, and a transmitter 104.

The transmitter 104 includes a circular main body 105 painted red, and a nameplate 106 with a printed or carved suitable character string indicating a use (e.g., a fire alarm), mounted on the main body 105. The transmitter 104 further includes a circular hole 108, which is formed near the central portion of the circular main body 105 and protected with a transparent plastic window 107. Within the circular hole 108, there are provided a push-button switch 109 and an operation confirming light 110.

FIG. 47B shows the circuit diagram of the transmitter 104. The push-button switch 109 consists of two contacts a and b. The first contact a is positioned between an L line and a C line, while the second contact b is positioned between an A line and the C line through the operation confirming light 110. The A line and C line are drawn from a transmitter 111 to all monitoring areas.

In the above-described construction, if the plastic window 107 is destroyed and the push-button switch 109 is depressed, the bell 102 rings and the two contacts a and b are closed. That is, the L and C lines are short-circuited through the first contact a. At the same time, the A and C lines are short-circuited through the second contact b. If the short-circuited state (between the L and C lines) is transmitted to the transmitter 111, a predetermined DC current is applied from the transmitter 111 on the A line. Since the predetermined DC current flows in the order of A line->operation confirming light 110->contact b->C line, the operation confirming light 110 provided in the transmitter 104 is lit. With the lighting, it can be confirmed that the receiver 111 has received the depression of the push-button switch 109. The predetermined DC current, for lighting the operation confirming light 110, will hereinafter be referred to as answer current. In FIG. 47C, the letter "i" in the Li line represents the number of a monitoring area. Therefore, the Li line represents an L line connected to the $i^{th}$ monitoring area. For example, if a transmitter 104 belongs to the first monitoring area, the first contact a of the transmitter 104 is positioned between the L1 line and the C line.

Although such a transmitter 104 is used to inform the surrounding people of the occurrence of a fire, the use of the transmitter 104 is not limited to this. For instance, in the case of an abnormal situation such as an assault by a ruffian, there are cases where the nearby transmitter 104 is operated to ring the bell 102, repulse a ruffian, and ask the surrounding people for help. In addition, when a suspicious person is found in schools, etc., the above-described transmitter can be utilized to quickly inform the surrounding people of the suspicious person.

However, the above-described transmitter 104 is used for issuing an alarm with the ring of a bell. Therefore, in a large building (e.g., a school) where a great number of transmitters 104 are disposed, it is fairly difficult to specify the transmitter 104 which is issuing an alarm, and consequently, there is a problem that guards or teachers cannot rush to the place of an abnormal situation.

Note that a large building is equipped with a system in which fire-information signals from a great number of transmitters are collectively monitored with a receiver (e.g., a P-type fire receiver). In this system, as shown in FIG. 47C, signals from a great number of transmitters 104 provided at the predetermined places within a building are transmitted to the receiver 111 through a dedicated reception line (which consists of Li and C lines (L-C line)) for each monitoring area. The receiver 111 transmits a confirmation signal (answer signal), which indicates that an alarm was received, to the transmitter 104 through a confirmation line (which consists of A and C lines (A-C line)). As a result, the operation confirming light 110 of the transmitter 104 is lit. In this manner, the person who operated the transmitter 104 is informed of the confirmation of reception by the receiver 111. However, since a great number of transmitters 104 are connected for each monitoring area, it is extremely difficult for the receiver 111 to specify the transmitter 104 in one monitoring area which issued fire information, and consequently, there is a problem that guards or teachers cannot rush to the place of an abnormal situation.

SUMMARY OF THE INVENTION

The present invention has been made in view of the circumstances mentioned above. Accordingly, it is a first important object of the present invention is to quickly specify the inherent address of a fire sensor that issued a fire signal regardless of the number of lines, and reduce the time for specifying the place of a fire. A second importance object of the invention is to specify a sensor that issued a fire signal without using a sensor which has a dedicated line. A third important object of the invention is to provide a disaster prevention system that is capable of specifying at a center side a transmitter whose push-button switch was operated at the time of an abnormal situation so that guards can rush to the place of the abnormal situation.

To achieve the above-described objects and in accordance with the present invention, there is provided a fire alarm system for connecting a plurality of fire sensors to sensor lines drawn from a fire receiver, and giving an alarm in response to a fire information signal output from the fire sensor in a line unit. The fire alarm system comprises current modulation means and address specification means. The current modulation means is provided in the fire sensors, and is used for maintaining a current flowing in the sensor line at a predetermined value for a predetermined time at the time of a fire, and modulating the current in accordance with inherent address information of the fire sensor after the predetermined time. The address specification means is provided in the fire receiver, and is used for sensing fire information by judging whether or not the current has been maintained at the predetermined value for the predetermined time, and also for specifying the inherent address of the fire sensor that issued the fire information, from a modulated state of the current after the predetermined time.

In accordance with the present invention, there are provided fire sensors which are employed in a fire alarm system for connecting a plurality of fire sensors to sensor lines drawn from a fire receiver, and giving an alarm in response to a fire information signal output from the fire sensor in a line unit. Each of the fire sensors comprises current modulation means, provided in the fire sensors, for maintaining a current flowing in the sensor line at a predetermined value for a predetermined time at the time of a fire, and modulating the current in accordance with the inherent address information of the fire sensor after the predetermined time.

In accordance with the present invention, there is provided a fire receiver which is employed in a fire alarm system for connecting a plurality of fire sensors to sensor lines drawn from a fire receiver, and giving an alarm in response to a fire information signal output from the fire sensor in a line unit. The fire receiver comprises address specification means, provided in the fire receiver, for sensing fire information by judging whether or not the current has been maintained at the predetermined value for the predetermined time, and also for specifying the inherent address of the fire sensor that issued the fire information, from a modulated state of the current after the predetermined time.

In accordance with the present invention, there is provided a repeater which is employed in a fire alarm system for connecting a plurality of fire sensors to sensor lines drawn from a fire receiver, and giving an alarm in response to a fire information signal output from the fire sensor in a line unit. The repeater comprises current modulation means, provided in each of the fire sensors, for maintaining a current flowing in the sensor line at a predetermined value for a predetermined time at the time of a fire, and modulating the current in accordance with inherent address information of the fire sensor after the predetermined time.

In accordance with the present invention, there is provided a disaster prevention system comprising a plurality of transmitters, which each have a push-button switch, for causing an L-C line to be in a short-circuited state when the push-button switch is operated at the time of an abnormal situation. The disaster prevention system further comprises (1) a receiver for sensing the short-circuited state of the L-C line, also detecting abnormal-situation information within a warning area allocated to the L-C line, then causing answer current to flow in the transmitter in which the push-button switch was operated, via an A-C line to light a confirming light provided in the transmitter, and then informing an operator that a signal was received; (2) current modulation means, provided in the transmitters, for modulating the answer current in accordance with the inherent address information of the transmitter when the push-button switch is operated; and (3) address specification means, provided in the receiver, for sensing the short-circuited state of the L-C line, also detecting that an abnormal situation has occurred within the warning area allocated to the L-C line, and specifying the inherent address of the transmitter in which the push-button switch was operated, from the modulated state of the answer current.

In accordance with the present invention, there is provided a transmitter with a push-button switch for causing an L-C line to be in a short-circuited state when the push-button switch is operated at the time of an abnormal situation, the transmitter comprising:

current modulation means for modulating answer current in accordance with the inherent address information of the transmitter, when, by a receiver constituting a disaster prevention system along with the transmitter, the short-circuited state of the L-C line is sensed, also abnormal-situation information is detected within a warning area allocated to the L-C line, then the answer current is caused to flow in the transmitter in which the push-button switch was operated, via an A-C line to light a confirming light provided in the transmitter, and then an operator is informed that a signal was received.

In accordance with the present invention, there is provided a receiver which constitutes a disaster prevention system along with a transmitter. The transmitter has a push-button switch, also causes an L-C line to be in a short-circuited state when the push-button switch is operated at the time of an abnormal situation, also receives answer current from the receiver through an A-C line when the push-button switch is operated and lights a confirming light, and is also equipped with current modulation means for modulating the answer current in accordance with the inherent address information of the transmitter. The receiver comprises:

address specification means for sensing the short-circuited state of the L-C line, also detecting that an abnormal situation has occurred within a warning area allocated to the L-C line, then causing answer current to flow in the transmitter in which the push-button switch was operated, via an A-C line to light a confirming light provided in the transmitter, then informing an operator that a signal was received, and specifying the inherent address of the transmitter from which abnormal-situation information was output, from the modulated state of the answer current.

In accordance with the present invention, there is provided a repeater which is provided between a transmitter, which has a push-button switch and causes an L-C line to be in a short-circuited state when the push-button switch is operated at the time of an abnormal situation, and a receiver constituting a disaster prevention system along with the transmitter; the repeater comprising:

current modulation means for modulating answer current in accordance with address information of the transmitter, when, by the receiver, the short-circuited state of the L-C line is sensed, also abnormal-situation information is detected within a warning area allocated to the L-C line, then the answer current is caused to flow in the transmitter in which the push-button switch was operated, via an A-C line to light a confirming light provided in the transmitter, and then an operator is informed that a signal was received.

In the repeater of the present invention, the above-described transmitter may comprise a plurality of transmitters, and the above-described address information may be address information for group identification, allocated in common to the plurality of transmitters.

In accordance with the present invention, there is provided a data set support system that is applied to a fire alarm system which has a fire receiver that rewrites and maintains data corresponding to identification information allocated to a fire sensor and a transmitter and also corresponding to installation place information of the fire sensor and installation place information of the transmitter, in order to support an operation of setting the corresponding data. The data set support system comprises (1) holding means for holding the identification information and the installation place information in correlation with each other; (2) first generation means for generating a user's interface to perform data addition and data update on the holding means; (3) second generation means for generating the corresponding data from data held in the holding means; and (4) transfer means for transferring the corresponding data generated by the second generation means to the fire receiver.

In the data set support system of the present invention, the above-described transfer means may transfer the corresponding data generated by the second generation means to the fire receiver through a telephone line.

In accordance with the present invention, there is provided a program for causing a computer to execute predetermined processing functions. The predetermined processing functions has functions for realizing (1) holding means for holding the identification information and the installation place information in correlation with each other; (2) first generation means for generating a user's interface to perform data addition and data update on the holding means; (3) second generation means for generating the corresponding data from data held in the holding means; and (4) transfer means for transferring the corresponding data generated by the second generation means to the fire receiver.

In accordance with the present invention, there is provided a recording medium storing the above-described program.

In accordance with the present invention, there is provided a fire receiver that rewrites and maintains data which corresponds to identification information allocated to a fire sensor and a transmitter and also corresponds to installation place information of the fire sensor and installation place information of the transmitter. The fire receiver comprises open means for generating a HTML document and opening the HTML document to a network. The HTML document has (1) a display area for the identification information and the installation place information, (2) data input controls for inputting data to change the identification information and the installation place information, and (3) a transmission command button control for transmitting the data, input to the data input controls, to a predetermined destination. The fire receiver further comprises reception means for receiving changed data transmitted from a terminal provided on the network, in response to a signal from the transmission command button control; and update means for updating the identification information and the installation place information in accordance with the changed data received by the reception means.

In accordance with the present invention, there is provided a test device for a fire alarm system, comprising (1) detection means for detecting a reception operation of a fire receiver when a fire sensor or transmitter issues test information; (2) generation means for generating a message which is transmitted to a portable terminal of a tester, based on information detected by the detection means; and (3) transmission means for transmitting the message to the portable terminal of the tester. In the test device, the generation means generates a character message which includes the inherent address or installation area information of the fire sensor or transmitter. The character message includes a significant character string corresponding to the inherent address or the installation area information.

In the test device of the present invention, the aforementioned significant character string may comprise a character string which specifies the installation place of the fire sensor or transmitter. The test device may further comprise means for storing the message and opening the stored message on a network.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIGS. 4A and 4B are conceptual diagrams showing how a time-sharing operation is performed;

FIG. 5A is a perspective view showing a fire sensor;

FIG. 5B is a block diagram showing the circuit of the fire sensor;

FIGS. 10A and 10B are diagrams showing a separable fire sensor constructed in accordance with a second embodiment of the present invention;

FIGS. 11A and 11B are diagrams showing the essential part (fire-information detection and power supply section) of the address transmission circuit of FIG. 10 improved with the object of reducing power consumption;

FIGS. 21A and 21B are diagrams showing the essential part (information detection and power supply section) of the repeater of FIG. 20 improved with the object of reducing power consumption;

FIG. 22A is a diagram showing a data set support system constructed in accordance with a fifth embodiment of the present invention;

FIG. 22B is a block diagram of the data set support system shown in FIG. 22A;

FIG. 25A is a diagram showing the hierarchical structure of the hardware and software resources of the PC 210;

FIG. 25B is a conceptual diagram of a fire data management system constructed in accordance with a seventh embodiment of the present invention;

FIG. 28A is a diagram showing an address management screen;

FIG. 28B is a diagram showing a detailed address management screen;

FIG. 29A is a diagram showing a floor name management screen;

FIG. 29B is a diagram showing a detailed floor name management screen;

FIG. 30A is a diagram showing a room name management screen;

FIG. 30B is a diagram showing a detailed room name management screen;

FIG. 31A is a diagram showing a table management screen;

FIG. 31B is a diagram showing a detailed table management screen;

FIGS. 32A to 32C are diagrams showing the printed examples of data displayed in a list box control;

DETAILED DESCRIPTION OF THE PREFERRED EMBODIMENTS

Embodiments of a fire alarm system according to the present invention will hereinafter be described in detail with reference to the drawings.

Figure 1:
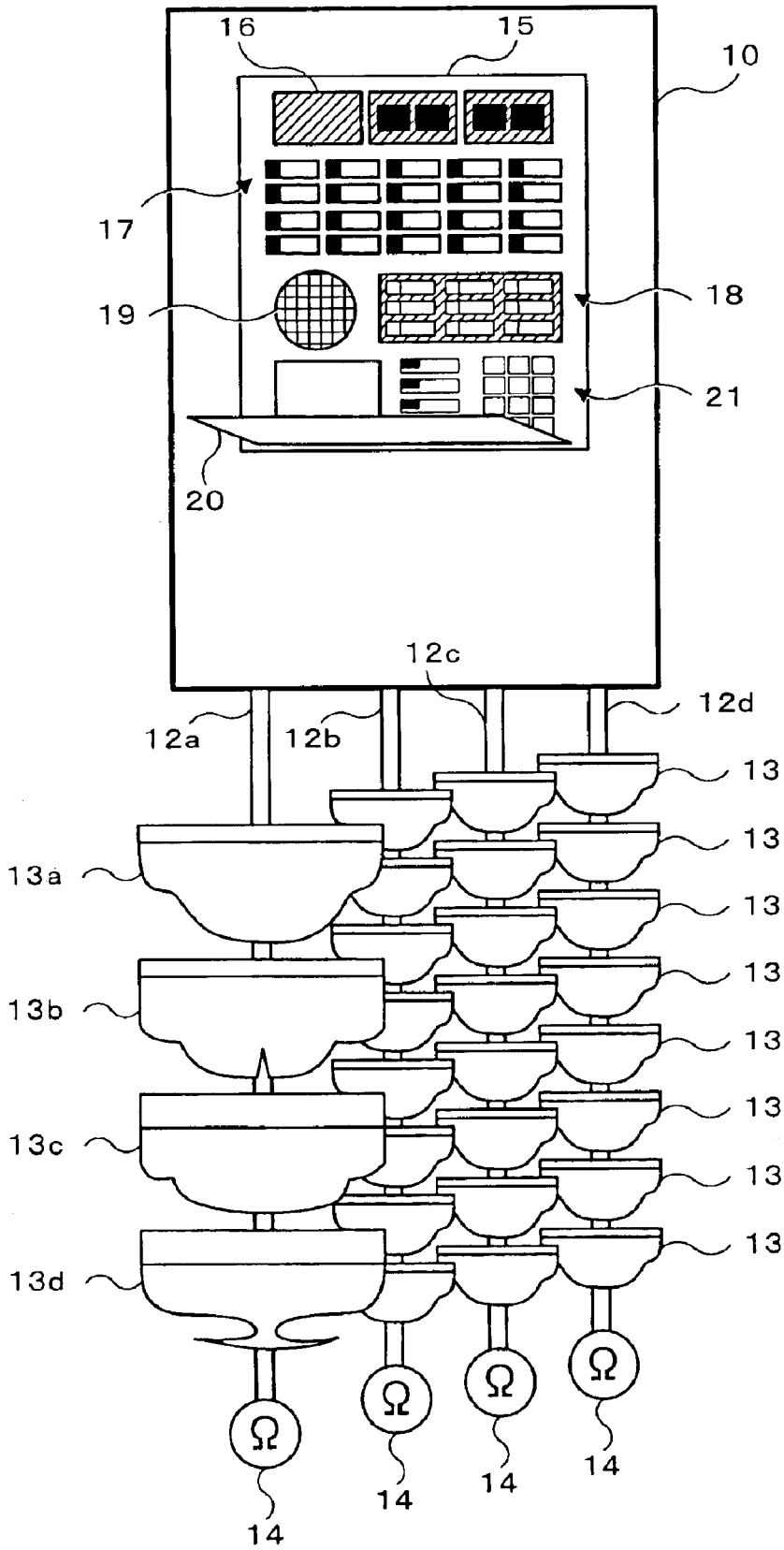
FIG. 1 is a diagram showing a fire alarm system constructed in accordance with a first embodiment of the present invention.

FIG. 1 shows a P-type fire alarm system (hereinafter referred to simply as a fire alarm system) constructed in accordance with a first embodiment of the present invention. In the figure, a fire receiver 10 has n sensor lines 12*a* to 12*d* (in this embodiment, n=4). Each of the sensor lines 12*a* to 12*d* has a 2-line construction (pair construction of an L line and a C line), as described later. Each of the sensor lines 12*a* to 12*d* is connected in parallel with an arbitrary number of fire sensors 13. The sensor lines 12*a* to 12*d* are terminated at resistors 14, respectively.

If it detects a fire, the fire sensor 13 short-circuits the connected sensor line (short circuit between L and C lines). For example, as represented by the sensor circuit 12*a*, the fire sensors 13 may comprise various types of fire sensors such as a photoelectric smoke sensor 13*a*, a thermistor type heat sensor 13*b*, a differential sensor 13*e*, a constant-temperature sensor 13*d*, etc.

The fire receiver 10 has a front panel 15, which is provided with various display buttons and control buttons. For example, the front panel 15 is provided with a fire display light 16 which is lit at the time of the occurrence of a fire, a place display section 17 for displaying the place of a fire, a control section 18, and a sound output section 19. Inside a small lid 20, there is provided a control display section 21 for maintenance and inspection.

Figure 2:
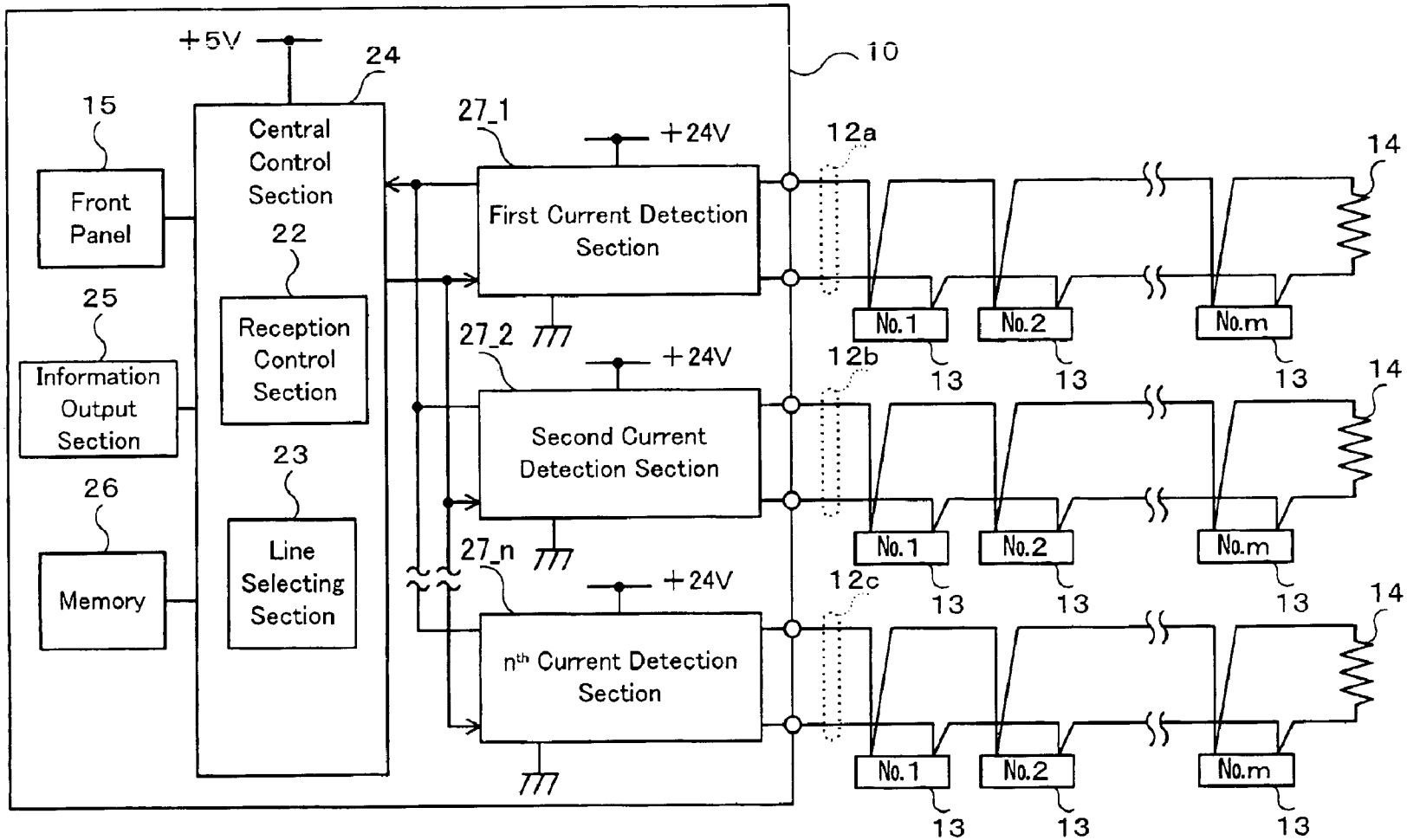
FIG. 2 is a circuit diagram of the fire receiver and the fire sensors shown in FIG. 1.

FIG. 2 shows a circuit diagram of the fire receiver 10 and the fire sensors 13. The fire receiver 10 is equipped with a central control section 24 (which includes a reception control section 22 and a line selecting section 23), a front panel 15, an information output section 25, memory 26, and n current detection sections (first current detection section 27_1 to $n^{th}$ current detection section **27_*n*). The control section 22, line selecting section 23, central control section 24, and n current detection sections 27_1 to 27_*n*** as a whole constitute the address specification means of the present invention.

The information output section 25 detects by the detection section that any of the lines or sensors is on fire, and outputs the information to an external unit (e.g., an auxiliary display panel, etc.) by a change in a voltage or current. The memory 26 consists of a mask ROM or flash ROM, in which software for operating the central control section 24 is stored. The memory 26 can also store a history of operations, and the quality management information at the time of shipment.

When constituting the fire alarm system, an arbitrary number of fire sensors 13 (for convenience, m sensors No. 1 to No. m) are connected to the L and C lines of sensor lines (for convenience, three sensors 12*a* to 12*c*) drawn from the current detection sections 27_1 to **27_*n*, and the terminal ends of the L and C lines of each of the sensor lines 12***a* to 12*c* are connected with the resistor 14 for termination.

The first current detection section 27_1 to $n^{th}$ current detection section **27_*n*** operate at predetermined intervals in a time sharing manner by time sharing control (described later), and each of the detection sections detects the magnitude of a current which flows in the L and C lines of the corresponding sensor line.

That is, the first current detection section 27_1 detects the magnitude of a current which flows in the L and C lines of the sensor line 12*a* during the first time sharing period. The second current detection section 27_2 detects the magnitude of a current which flows in the L and C lines of the sensor line 12*b* during the second time sharing period. The $n^{th}$ current detection section **27_*n* detects the magnitude of a current which flows in the L and C lines of the sensor line 12***c* during the $n^{th}$ time sharing period. In each current detection section, the measured signal is output to the central control section 24 during the time sharing period.

The central control section 24 is used to control the entire operation of the fire receiver 10. In many cases, the central control section 131 is designed by a so-called microprogramming technique which employs a mircoprocessor in consideration of ease of design and ease of repair. However, the present invention is not limited to the microprogramming technique. For instance, the central control section 24 may be designed by hard-wired logic.

The central control section 24 has the first function of controlling operation of the front panel 15 or information output section 25, and also has the second function of detecting fire information, judging the position of the fire information in the unit of a fire sensor, and controlling the time sharing periods of the current detection sections 27_1 to **27_*n***.

The illustrated reception control section 22 and line selecting section 23 are conceptual blocks schematically representing the second function. That is, the reception control section 22 detects fire information, based on the measured signals from the current detection sections 27_1 to **27_*n* and judges the position of the fire information in the unit of the fire sensor 13. The line selecting section 23 controls the time sharing operation of the current detection sections 27_1 to 27_*n***.

Figure 3:
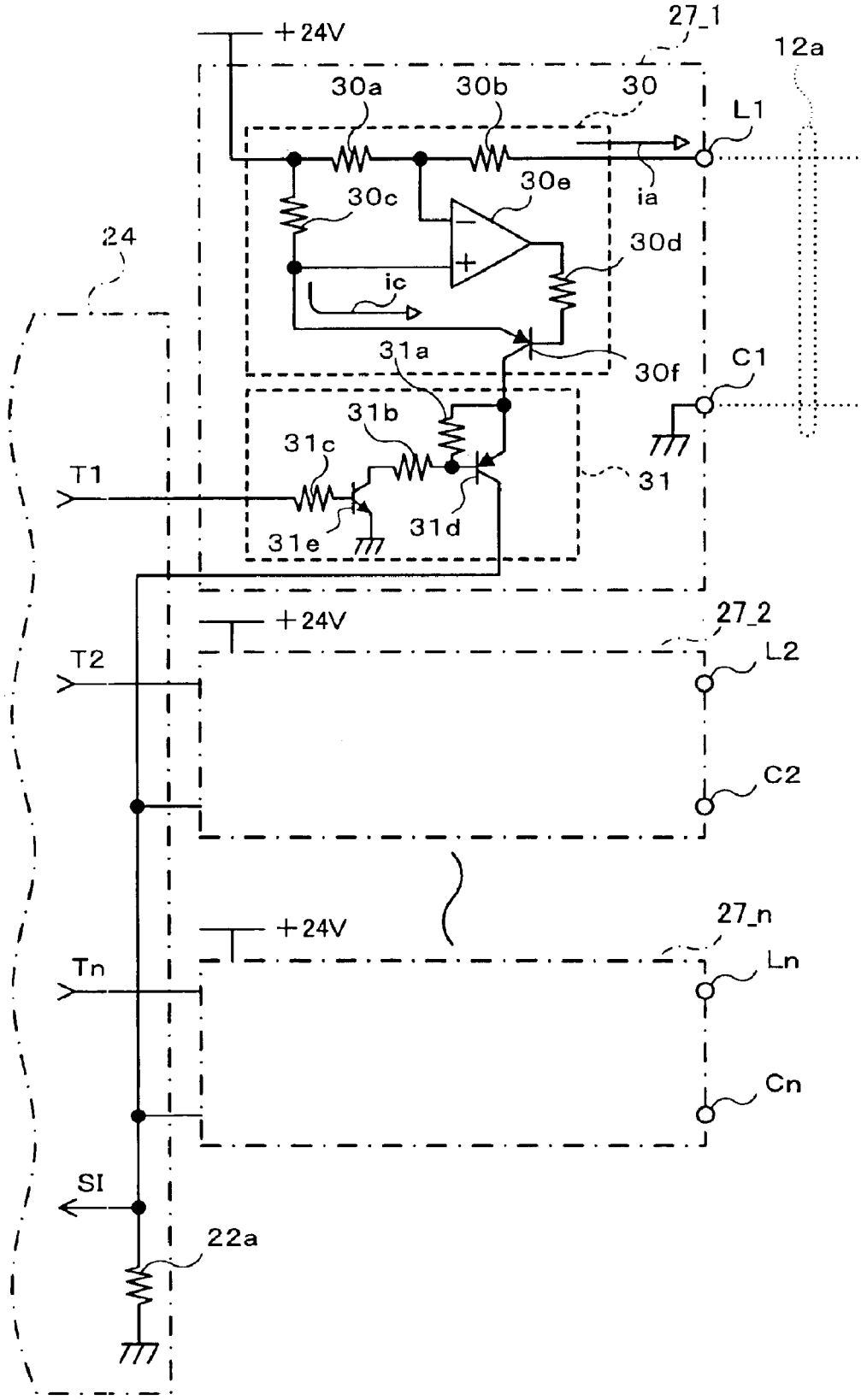
FIG. 3 is a circuit diagram of the central control section and the current detection section shown in FIG. 2.

FIG. 3 shows a portion of the central control section 24 and the current detection section (current detection sections 27_1 to **27_*n***). The circuit construction is for purposes of illustrating embodiments of the present invention and not for purposes of limiting the invention.

The current detection sections 27_1 to **27_*n* are the same in construction. Therefore, a description will be given of the first current detection sections 27_1. The first current detection sections 27_1 is equipped with two connection terminals (L1 and C1 terminals), a current detection circuit 30, and a switching circuit 31**.

The L1 terminal of the first current detection sections 27_1 is connected with the L line of the sensor line 12*a*, while the C1 terminal is connected with the C line of the sensor line 12*a*. The C1 terminal is also connected to a common potential (ground potential). The current detection circuit 30 detects a current proportional to a current that flows between the two terminals (L1 and C1 terminals). The switching circuit 31 outputs the current detected by the current detection circuit 30 to the central control section 24 as a measured signal during a predetermined time sharing period.

For instance, the current detection circuit 30 in FIG. 3 is equipped with four resistors 30*a* to 30*d*, an operational amplifier 30*e*, and a transistor 30*f*. Between the L1 terminal and a power source of +24 V, the resistors 30*a* and 30*b* are disposed in series. The connection point between the resistors 30*a* and 30*b* is connected to the inverting input (−input) of the operational amplifier 30*e*. The +24 V power source is connected to the non-inverting input (+input) of the operational amplifier 30*e* through the resistor 30*c*. The output of the operational amplifier 30*e* is connected to the base of the transistor 30*f*. The non-inverting input of the operational amplifier 30*e* is connected to the emitter of the transistor 30*f*.

The switching circuit 31 is equipped with three resistors 31*a* to 31*c* and two transistors 31*d* and 31*e*. Between the collector and base of the transistor 31*d*, the resistor 31*a* is disposed. The emitter of the transistor 31*d* is connected to the collector of the transistor 30*f* of the current detection circuit 30. The base of the transistor 31*d* is connected to the collector of the transistor 31*e* through the resistor 31*b*. A time sharing signal (T1) from the line selecting section 23 of the central control section 24 is applied to the base of the transistor 31*e* which has an emitter connected to a common potential. The collector of the transistor 31*d* is connected to a common potential through a load resistor 22*a* provided in the reception control section 22 of the central control section 24.

In FIG. 3, reference character T1 denotes a time sharing signal for the first current detection section 27_1. Reference character T2 denotes a time sharing signal for the second current detection section 27_2, and reference character Tn denotes a time sharing signal for the $n^{th}$ current detection section 27_*n*. Reference character SI denotes a current-voltage conversion signal taken out from both ends of the load resistor 22*a*.

With the above-described construction, the transistors 31*d* and 31*e* are made on or off by switching the potential of the time sharing signal T1. For convenience, the potential state of the time sharing signal T1 is assumed to be active when the transistors 31*d* and 31*e* are on. In the active state, the collector of the transistor 30*f* of the current detection circuit 30 is connected to a common potential through the load resistor 22*a* provided in the reception control section 22 of the central control section 24.

In addition, the collector current $i_c$ of the transistor 30*f* of the current detection circuit 30 is accurately controlled according to the ratio of two input resistors (30*a* and 30*c*). That is, the collector current $i_c$ is $i_a$/A, in which $i_a$ is the current that flows from the +24 V power supply into the sensor line 12*a* and A is the ratio of the two input resistors 30*a* and 30*c* of the operational amplifier 30*e*. For example, when the resistor 30*a* is 100 Ω, and the resistor 30*c* is 10 kΩ, the resistor ratio A is 1/100 and therefore $i_c=i_a/100$. In the period during which the time sharing signal T1 is active, the current $i_c$ (which is $i_a/100$) can flow in the load resistor 22*a* of the central control section 24.

Therefore, when the load resistor 22*a* is 10 kΩ, the value of the current-voltage conversion signal SI that is taken out from both ends of the load resistor 22*a* becomes 10 kΩ×$i_c$. Therefore, when $i_a$=35 mA, SI=10 kΩ×$i_c$=10 kΩ×(35 mA/100)=3.5 V.

FIG. 4A shows a conceptual diagram of the time-sharing operation. In the figure, a multi-contact switch 32 represents n switch circuits 31 for the current detection sections 27_1 to 27_*n*. The multi-contact switch 32 is used to close contacts in sequence in accordance with a cyclic active operation of time sharing signals T1 to Tn shown in FIG. 4B. According to the above-described active operation, $i_c$ for the line L1, $i_c$ for the line L2, . . . , and $i_c$ for the line Ln flow in sequence in the load resistor 22*a* for one cycle. As a result, SI for each sensor line (L1 to Ln) can be taken out for each time sharing period.

As described above, SI is 3.5 V when $i_a$=35 mA. In this embodiment, in addition to 35 mA, $i_a$ can have 2.4 mA and 10 mA. Therefore, SI can have three values: 3.5 V (when $i_a$=35 mA), 2.4 V (when $i_a$=2.4 mA), and 1.0 V (when $i_a$=10 mA). Since 2.4 mA, 10 mA, and 35 mA are values provided for the convenience of explanation, the present invention is not limited to these values.

FIGS. 5A and 5B show a perspective view of the fire sensor 13 and a circuit block diagram of the fire sensor 13, respectively. For example, when the fire sensor 13 is used as a smoke sensor, it is equipped with a case 40, smoke sensing windows 41 formed in the case 40, and a light-emitting element 42 for displaying fire information. Within the case, there are provided a noise-absorbing and rectifying circuit 44, a power supply section 45, a detection circuit 46, an address setting section 47, a modulation signal generating section 48, and a current modulating section 49. These components have the following functions.

The noise-absorbing and rectifying circuit 44 removes the noise component of the sensing current (2.4 mA at the time of a steady state and 35 mA or 10 mA at the time of a fire) supplied from the fire receiver 10 through the sensor line 12*a*, and then rectifies the current.

The power supply section 45 is a circuit for generating the internal power-supply voltage required of the detection circuit 46 and the modulation signal generating section 48, from the sensing current rectified by the noise-absorbing and rectifying circuit 44.

The detection circuit 46 measures the concentration of smoke and, when the measured concentration is a predetermined value or greater, generates an actuation signal for actuating operation of the modulation signal generating section 48.

The address setting section 47 is a circuit for setting identification information (address information) inherent in the fire sensors 13 constituting at least one fire alarm system. The address setting section 47, modulation signal generating section 48, and current modulating section 49 as a whole constitute the current modulation means of the present invention.

The modulation signal generating section 48 is a circuit for generating a predetermined modulation signal in response to the actuation signal output from the detection circuit 46. Although the modulation signal is described in detail later, it has fire information, and address information set by the address setting section 47.

The current modulating section 49 is a circuit for modulating the sensing current in accordance with the modulation signal generated by the modulation signal generating section 48. With operation of this circuit, the sensing current which is 2.4 mA during a steady state is amplitude modulated with two value logic of 35 mA (high level) and 10 mA (low level) at the time of a fire. The modulated waveform is transmitted to the fire receiver 10.

Figure 6:
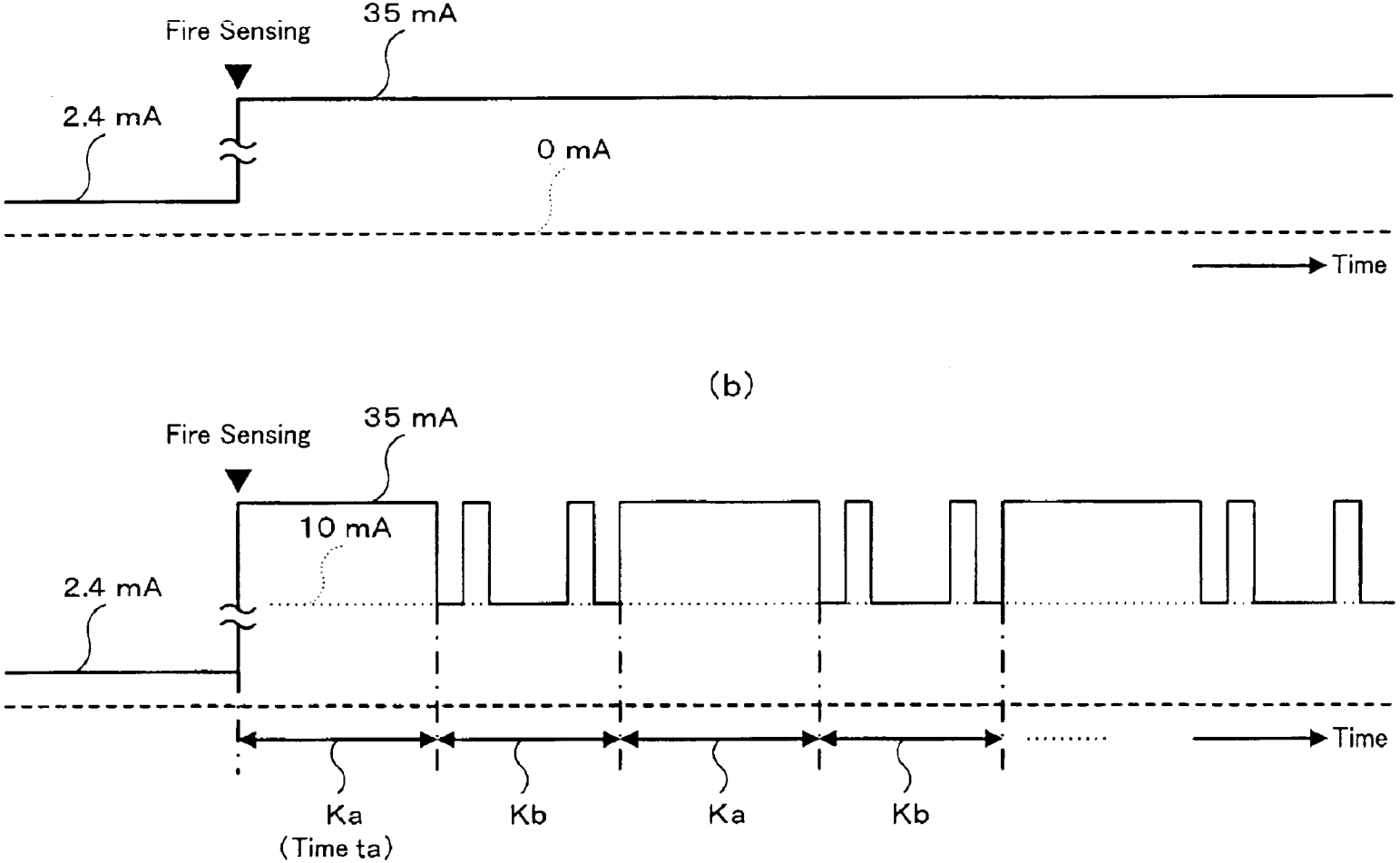
FIG. 6A is a diagram of a prior art sensing-current waveform.
FIG. 6B is a diagram of a sensing-current waveform according to the first embodiment of the present invention.

FIG. 6 shows the modulation waveform of a sensing current. FIG. 6A is a prior art sensing-current waveform shown for comparison, while FIG. 6B is a sensing-current waveform according to this embodiment. In the prior art sensing-current waveform, the current is 2.4 mA at the time of a steady state and increases to 35 mA at the time of a fire. In this manner, the fire receiver detects an increase in the sensing current and outputs fire information.

In the sensing-current waveform according to this embodiment, as with prior art, the current is 2.4 mA at the time of a steady state and increases to 35 mA at the time of a fire. However, the sensing-current waveform differs in that (1) the length of the 35-mA increase period $K_a$ is a predetermined time $t_a$, (2) the 35-mA increase period $K_a$ is followed by a predetermined amplitude modulation period $K_b$, and (3) the 35-mA increase period $K_a$ and the amplitude modulation period $K_b$ are repeated as one unit.

Figure 7:
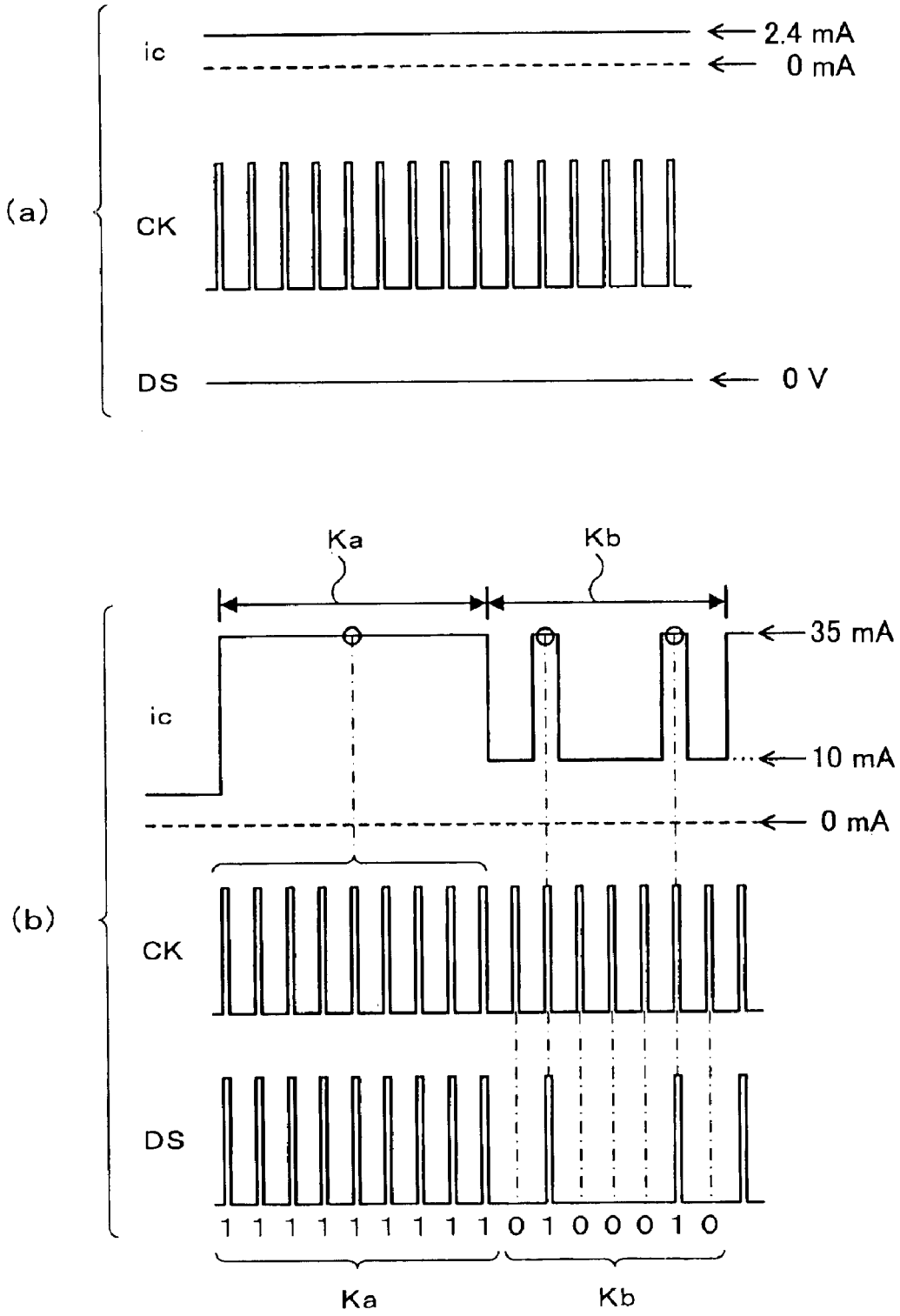
FIGS. 7A and 7B are timing diagrams showing operation of the fire receiver of the fire alarm system of the first embodiment.

FIGS. 7A and 7B show timing diagrams of the operation of the fire receiver 10 of the fire alarm system of the first embodiment. FIG. 7A shows the current $i_c$ at the time of a steady state, a sampling clock CK, and a digital signal waveform DS obtained by binarizing SI (voltage converted from $i_c$), using the sample clock CK. In the case of FIG. 7A (during a steady state), $i_c$=2.4 mA and therefore SI becomes 0.24 V. If a threshold value for binarization is set to a slightly greater value than 1.0 V, the digital signal waveform DS maintains 0 V (logic 0) at the timing of the sampling clock CK.

On the other hand, FIG. 7B shows the current $i_c$ at the time of a fire, a sampling clock CK, and a digital signal waveform DS obtained by binarizing SI (voltage converted from $i_c$), using the sampling clock CK. In the case of FIG. 7B (during a fire), $i_c$ is constituted by the combination of the 35-mA increase period Ka and the amplitude modulation period Kb. The amplitude modulation period Kb is constituted by a combination of logic 1s (35 mA) and logic 0s (10 mA). Therefore, if SI (voltage converted from $i_c$) is binarized at the sampling clock CK using the above-described threshold value, the digital signal waveform DS can be obtained. For example, in the illustrated waveform DS, the 35-mA increase period Ka is represented by nine logic 1s (111111111) and the amplitude modulation period Kb by 0100010. In the amplitude modulation period Kb (0100010), the first two bits (01) indicates a header and the remaining five bits indicates the address of a sensor (set by the address setting section 47 of the fire sensor 13).

Therefore, the fire receiver 10 of the first embodiment is capable of sensing fire information when nine logic 1s are obtained during the continuous time ($t_a$) of the 35-mA increase period Ka. The fire receiver 10 is also capable of finding the inherent address of the sensor from the five bits following the header. For instance, in the illustrated example, the five bits are 00010. Since the binary number 00010 is equivalent to a decimal number 2, the fire receiver 10 can detect that fire information was output from the fire sensor 13 having address number 2.

Figure 8:
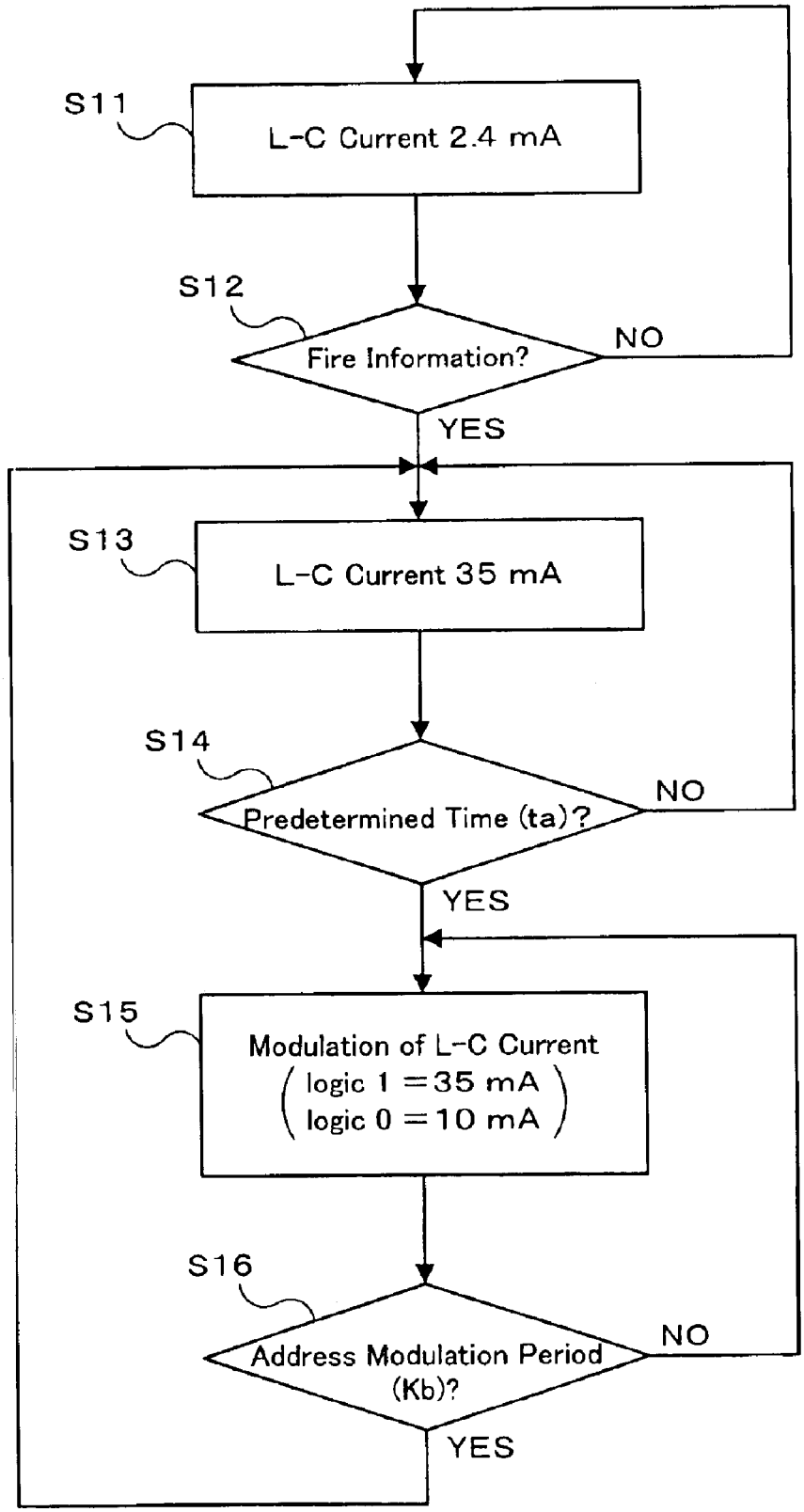
FIG. 8 is a flowchart showing how the fire sensor is operated.

FIG. 8 shows how the fire sensor 13 is operated. During a steady state, the current between the Land C lines is maintained at 2.4 mA (step S11). If a fire is detected (step S12), the current between the L and C lines is increased to 35 mA (step S13). The 35-mA increase period Ka is maintained for a predetermined time $t_a$ (step S14). Thereafter, the amplitude of the current between the L and C lines is modulated (logic 1=35 mA, and logic 0=10 mA) based on the address information set to the address setting section 47 (step S15), and the maintenance of the 35-mA increase period Ka and the modulating operation are repeated.

Figure 9:
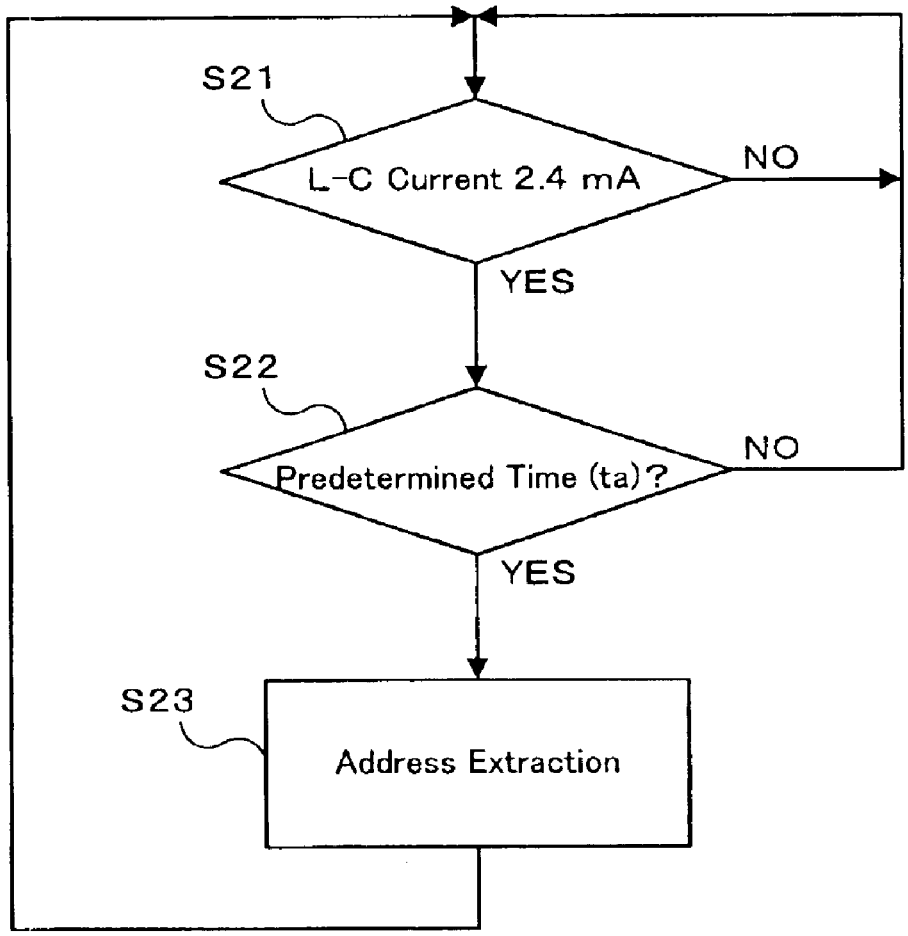
FIG. 9 is a flowchart showing how the fire receiver is operated.

FIG. 9 shows how the fire receiver 10 is operated. It is judged whether or not the current between the L and C lines is 2.4 mA or greater (exactly speaking, (10 mA+$\alpha$) or greater, in which $\alpha$ is a margin) (step S21). When it is 2.4 mA or greater and continues for a predetermined time ($t_a$) (step S22), fire information is sensed and address information is extracted from the modulation information of the current between the L and C lines (step S23).

Thus, if the fire alarm system is constructed so that when a fire takes place, the modulation of the current between the L and C lines generated by the fire sensor is detected by the fire receiver, the place of a fire (location of the fire sensor 13) can be pinpointed.

In addition, the above-described first embodiment is not the above-described half-duplex "question-response" type but a unidirectional type. More specifically, the 35-mA increase period Ka and the amplitude modulation period Kb are sent to the fire receiver 10 as a pair. Therefore, the shortest time required of the fire receiver 10 from the sensing of fire information to the specification of a sensor address can be reduced to the total time of the 35-mA increase period Ka and the amplitude modulation period Kb. Furthermore, since the time is independent of the number of sensor lines (L1 to Ln), the above-described time reducing effect can be obtained regardless of the size of a fire alarm system.

In the above-described embodiment, although the fire sensor 13 has the function of generating its address, the present invention is not limited to this embodiment. For example, the address generating function may be mounted on the separable base portion of the fire sensor.

FIG. 10 shows a separable fire sensor 51 constructed in accordance with a second embodiment of the present invention. In FIG. 10A, the fire sensor 51 consists of a main body portion 53 and a base portion 55. The main body portion 53 has a detection portion 15-1 for detecting by a scattered light method that smoke entered through smoke sensing windows 41, and a circuit board 15-2 for converting a scattered light quantity into a smoke concentration signal. The base portion 55 is equipped with an address transmission circuit 54 which has an address generating function, and a fire-information display light 60. If the main body portion 53 is mounted on the base portion 55, the circuit board 15-2 is electrically connected with the address transmission circuit 54. This state is shown in FIG. 10B.

The address transmission circuit 54 is equipped with a fire-information detection and power supply section 56, an address setting section 57, a modulation signal generating section 58, and a current modulation section 59. As described above, the base portion 55 is equipped with the fire-information display light 60 (equivalent to the light-emitting element 42 of FIG. 5). These sections have the following functions, respectively.

The fire-information detection and power supply section 56 is a circuit for detecting the short circuit between the L' and C' lines of the fire sensor 52 (fire sensing operation), and generating the internal power-supply voltage required of the modulation signal generating section 58 at the time of the detection.

The address setting section 57 is a circuit for setting identification information (address information) inherent in the fire sensors 51 constituting at least one fire alarm system. The address setting section 57, modulation signal generating section 58, and current modulating section 59 as a whole constitute the current modulation means of the present invention.

The modulation signal generating section 58 is a circuit for generating a predetermined modulation signal when a fire is sensed. As previously described, the modulation signal has fire information, and address information set by the address setting section 57.

The current modulating section 49 is a circuit for modulating the sensing current (which flows between L and C terminals) in accordance with the modulation signal generated by the modulation signal generating section 58. With operation of this circuit, the sensing current which is 2.4 mA during a steady state is modulated at 35 mA and 10 mA at the time of a fire. The modulation waveform is transmitted to the fire receiver 10.

In addition to the same advantages as the first embodiment, the second embodiment can handle the base portion 55 as if it is a repeater, because the base portion 55 is separated from the main body portion 53 and provided with the address transmission circuit 54 which has the address generating function. For instance, in the case where the base portion 55 is applied to ordinary fire sensors (which have only the function of short-circuiting L and C terminals), the existing fire sensors can be effectively utilized.

As a modification of the second embodiment, the base portion 55 may be used as a repeater. That is, instead of the base portion 55 of the shape shown in FIG. 10A, the address transmission circuit 54 may be formed as an address generating device of an arbitrary shape, which has terminals for connecting the signal lines (L and C lines) of a fire sensor which has only the function of short-circuiting L and C terminals, and terminals for connecting the signal lines (L and C lines) of the fire receiver 10. The address generating device may be provided with a circuit (address transmission circuit 54) for generating an inherent address. For example, in buildings with the existing fire sensors, if only the above-described address generating device is installed near the fire sensor 51, the fire alarm system according to the second embodiment can be easily constructed without exchanging the existing fire sensor.

FIG. 11A shows the essential part (fire-information detection and power supply section 56) of the address transmission circuit 54 of FIG. 10, improved with the object of reducing power consumption. In this example, the modulation signal generating section 58 is operated only at the time of a fire to save electric power. That is, the fire-information detection and power supply section 56 has a short circuit detection section 56*a*, a switch section 56*b*, and a constant voltage section 56*c*. When the short circuit between L' and C' lines is detected by the short circuit detection section 56*a*, the switch section 56*b* is made on. Therefore, a sensing current is supplied to the constant voltage section 56*c* through the L terminal. In this manner, a voltage with which the modulation signal generating section 59 is operated is generated. When the short circuit between L' and C' lines is not detected by the short circuit detection section 56*a*, the switch section 56*b* is made off. Therefore, since no electric power is consumed at the constant voltage section 56*c* during a steady state, electric power can be saved.

What kind of switching device is used in the switch section 56*b* belongs to the category of a design. For example, as shown in FIG. 11B, the switch section 56*b* may comprise a thyristor (which consists of four layers of PNPN in which a transistor has another PN junction). As is generally known, a thyristor is a three-terminal device that has an anode electrode (A), a cathode electrode (K), and a gate electrode (G). With a gate potential, a switch from an OFF-state to an ON-state can be made between the anode electrode and the cathode electrode. Once a switch to an ON-state is made, the gate potential will make no contribution to the switch. Therefore, it is necessary to make a current of some magnitude flow between the anode electrode and the cathode electrode to maintain the ON-state. The logic 0 (10 mA) in the above-described amplitude modulation period Kb is equivalent to the current for maintaining the ON-state. Therefore, in the case of employing a switching device which does not require such a maintaining current, there is no need to limit the level of the logic 0 in the amplitude modulation period Kb to 10 mA. For example, it may be the level (2.4 mA) of a sensing current at the time of a steady state.

While the above-described embodiments of the present invention are applied to the photoelectric smoke sensor, the present invention is applicable to any type of sensor which short-circuits a connected sensor line at the time of a fire to make the impedance low. That is, even a mechanical constant-temperature heat sensor and a differential heat sensor can confirm the address of a sensor outputting fire information by employing the address transmission circuit of the present invention.

As set forth in the embodiments of FIGS. 1 to 11, the present invention has the following advantages:

According to the present invention, at the time of a fire, a current flowing in sensor lines is maintained at a predetermined value (e.g., 34 mA) for a predetermined time (e.g., $t_a$), and after the predetermined time, the current is modulated based on the address information inherent in the fire sensor. And in the fire receiver, fire information is sensed by judging whether or not the above-described current has been maintained at a predetermined value for a predetermined time. Furthermore, the inherent address of the fire sensor which issued the fire information is specified from the modulated state of the above-described current after the predetermined time.

Therefore, since the transmission of fire information from the fire sensor to the fire receiver and the transmission of the inherent address information are performed at nearly the same time, the inherent address of the fire sensor can be quickly specified regardless of the number of lines. Thus, the time for specifying the place of a fire can be shortened.

Embodiments of a disaster prevention system according to the present invention will hereinafter be described with a P-type fire alarm system as an example.

Figure 12:
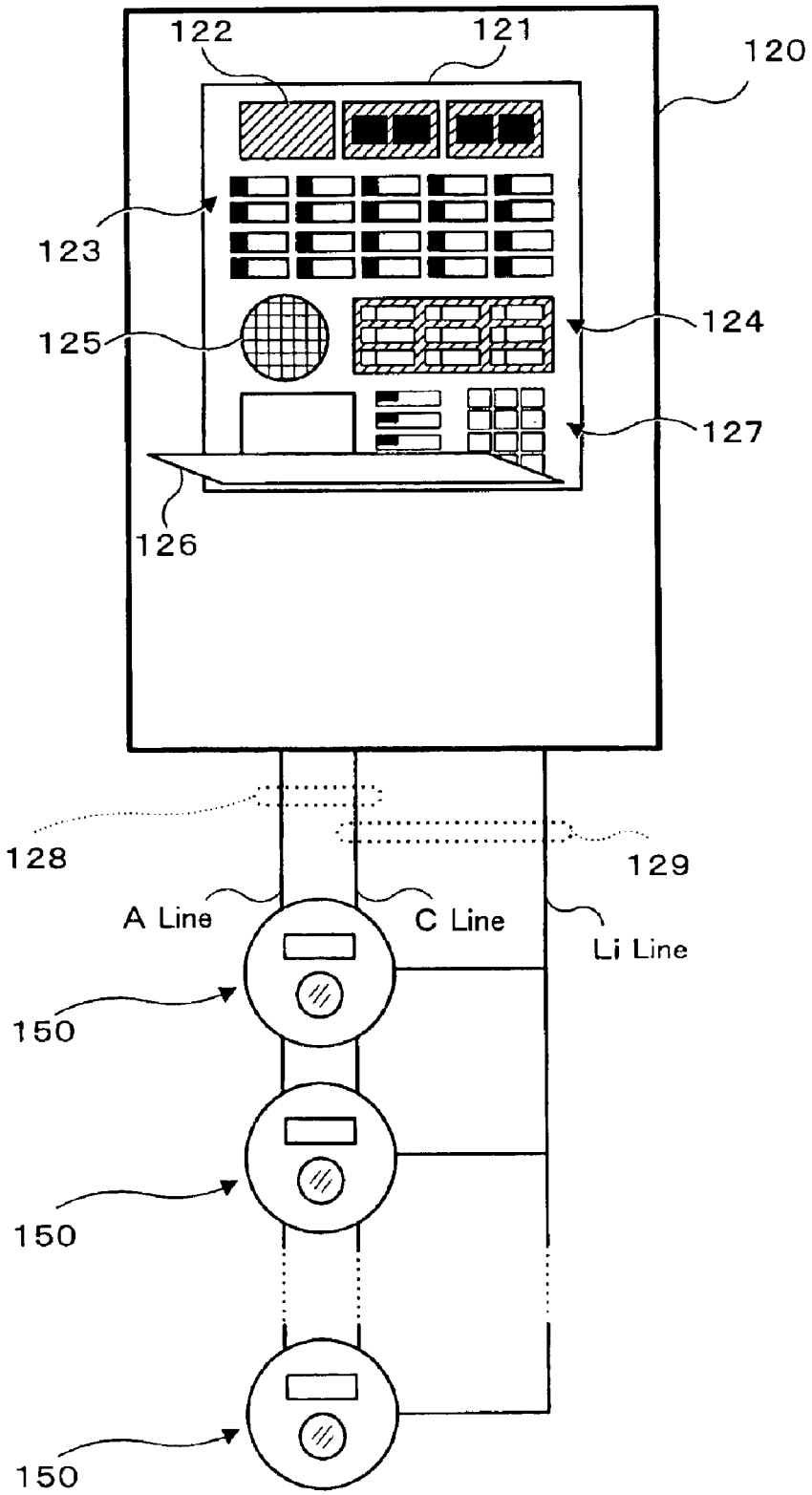
FIG. 12 is a diagram showing a disaster prevention system constructed in accordance with a third embodiment of the present invention.

FIG. 12 shows a disaster prevention system constructed in accordance with a third embodiment of the present invention. In the figure, a receiver 120 is constructed so that various display buttons and control buttons are disposed in the front panel 121. For example, the receiver 120 is provided with an abnormal-situation display light 122 which is lit at the time of an abnormal situation such as a fire, a place display section 123 for displaying the place of an abnormal situation, a control section 124, and a sound output section 125. Inside a small lid 126, there is provided a control display section 127 for maintenance and inspection.

The receiver 120 has an A line, a C line, and Li lines. The number of Li lines corresponds to the number of warning areas. The Li line in FIG. 12 represents an L line for the $i^{th}$ warning area. A pair of A and C lines is referred to as an A-C line 128, which is connected to an arbitrary number of transmitters 150 (hereinafter referred to as n transmitters 150). A pair of Li and C lines is referred to as an L-C line 129, which is connected to the n transmitters 150. Note that the C line is a line common to the A-C line 128 and L-C line 129.

Figure 47:
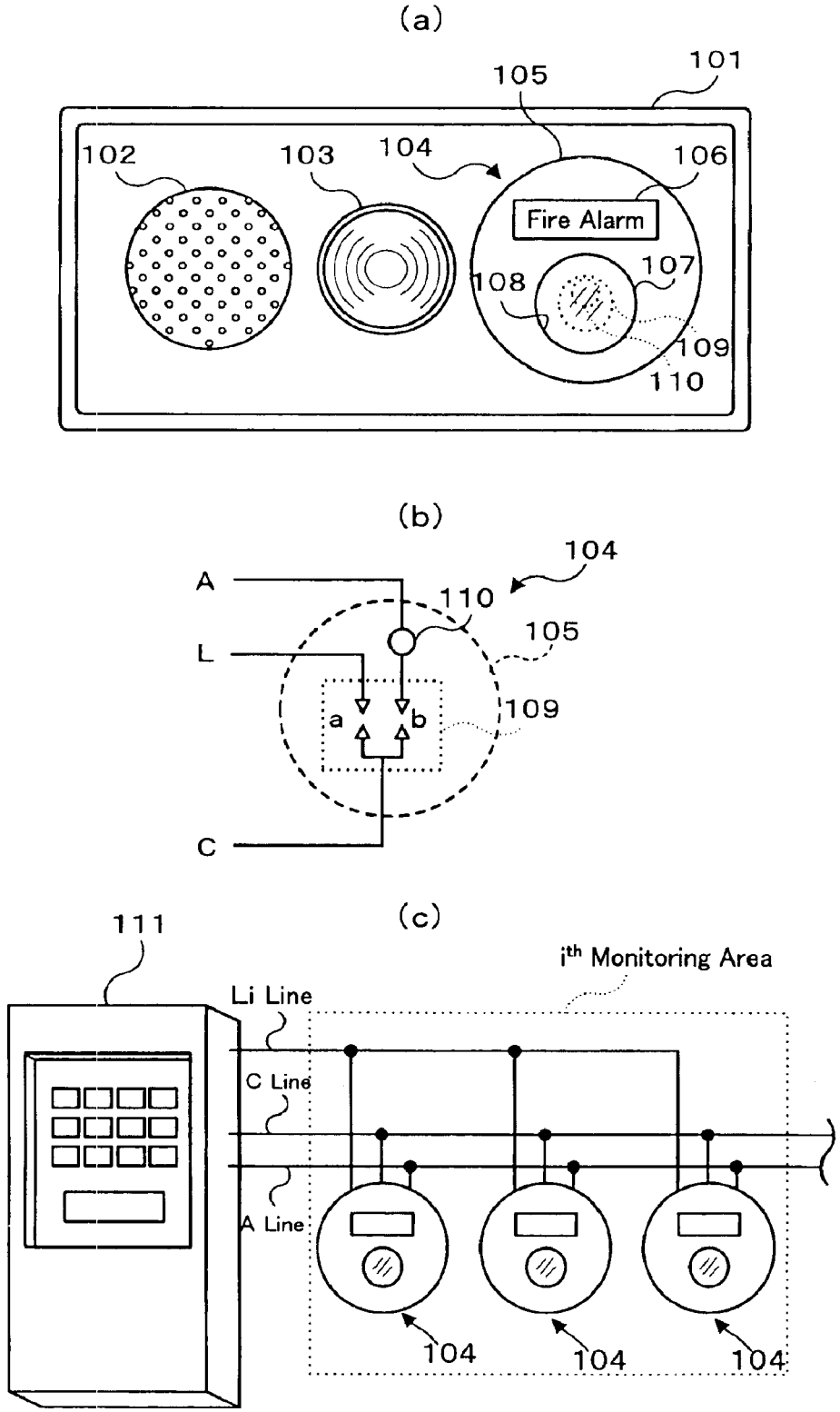
FIGS. 47A to 47C are diagrams showing a prior art fire alarm system.

The transmitters 150 have the same construction and are bush-button transmitters for fire information. The transmitters 150 are transmitters improved based on a P-type first class transmitter, using the technical idea of the present invention. That is, the transmitter 150 is the same in appearance as the prior art transmitter 104 (see FIG. 47A). The transmitter 104 includes a circular main body 105 painted red, and a nameplate 106 with a printed or carved suitable character string indicating a use (e.g., a fire alarm), mounted on the main body 105. The transmitter 104 further includes a circular hole 108, which is formed near the central portion of the circular main body 105 and protected with a transparent plastic window 107. Within the circular hole 108, there are provided a push-button switch 109 and an operation confirming light 110. In case of necessity, the plastic window 107 is destroyed with the finger and the push-button switch 109 is depressed. The transmitter 150 differs from the prior art transmitter 104 in that the location of urgent information can be pinpointed in the unit of the place of the transmitter 150 by the receiver 120.

Figure 13:
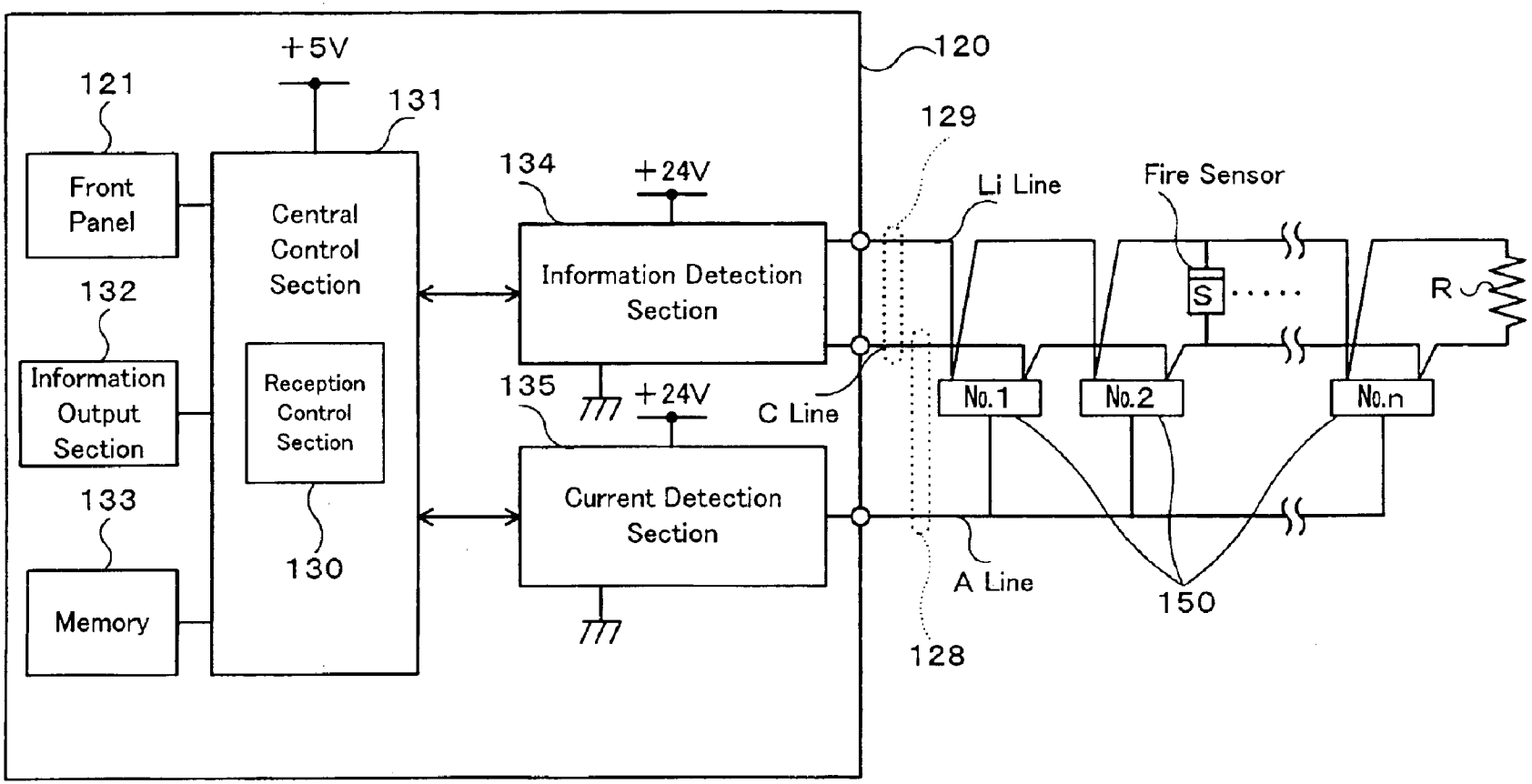
FIG. 13 is a circuit diagram of the receiver and the transmitter shown in FIG. 12.

FIG. 13 shows a circuit diagram of the receiver 120 and the transmitters 150. The receiver 120 is equipped with a central control section 131 (which includes a reception control section 130), a front panel 121, an information output section 132, memory 133, an information detection section 134, and a current detection section 135.

The information output section 25 detects by the detection section that any of the lines or sensors is on fire, and outputs the fire information to an external unit (e.g., an auxiliary display panel, etc.) by a change in a voltage or current. The memory 133 consists of a mask ROM or flash ROM, in which software for operating the central control section 131 is stored. The memory 133 can also store a history of operations, and the quality management information at the time of shipment.

When constituting the fire alarm system, an arbitrary number of fire alarms S (fire sensors such as smoke and heat types) are connected to the Li and C lines of the L-C line 129 drawn from the information detection section 134 of each monitoring area. In addition, an arbitrary number of transmitters 150 (for convenience, m sensors No. 1 to No. m) are connected to the Li and C lines. The transmitter 150 are further connected to the A line of the A-C line 128 drawn from the current detection section 135. Note that reference character R denotes a terminating resistor for the L-C line 129.

The information detection section 134 detects the short circuit of the L-C line 129. For example, when the Li line and the C line are short-circuited, the information detection section 134 generates an information detection signal which represents the fire information of the $i^{th}$ monitoring area, and outputs the signal to the central control section 131.

The current detection section 135 causes a predetermined confirmation current (hereinafter referred to as an answer current) to flow in the A line of the A-C line 128 in response to a signal from the central control section 131, when the information detection signal is generated by the information detection section 134.

The central control section 131 is used to control the entire operation of the receiver 120. In many cases, the central control section 131 is designed by a so-called micro-programming technique which employs a micro-processor in consideration of ease of design and ease of repair. However, the present invention is not limited to the micro-programming technique. For instance, the central control section 24 may be designed by hard-wired logic.

The central control section 131 has the first function of controlling operation of the front panel 121 or information output section 132, and also has the second function of specifying a monitoring area from which fire information was sent, and detecting the position of the transmitter 150 from which abnormal-situation information was sent.

The illustrated reception control section 130 is a conceptual block schematically representing the second function. That is, the reception control section 130 specifies a monitoring area from which fire information was sent, based on a short circuit detection signal from the information detection section 134. The reception control section 130 also causes an answer current to flow in the A-C line 128 by controlling the current detecting section 135 at the time of the detection of fire information. The reception control section 130 further specifies the address of the transmitter 150 from which urgent information was sent, based on the answer current measured by the current detection section 135.

Figure 14:
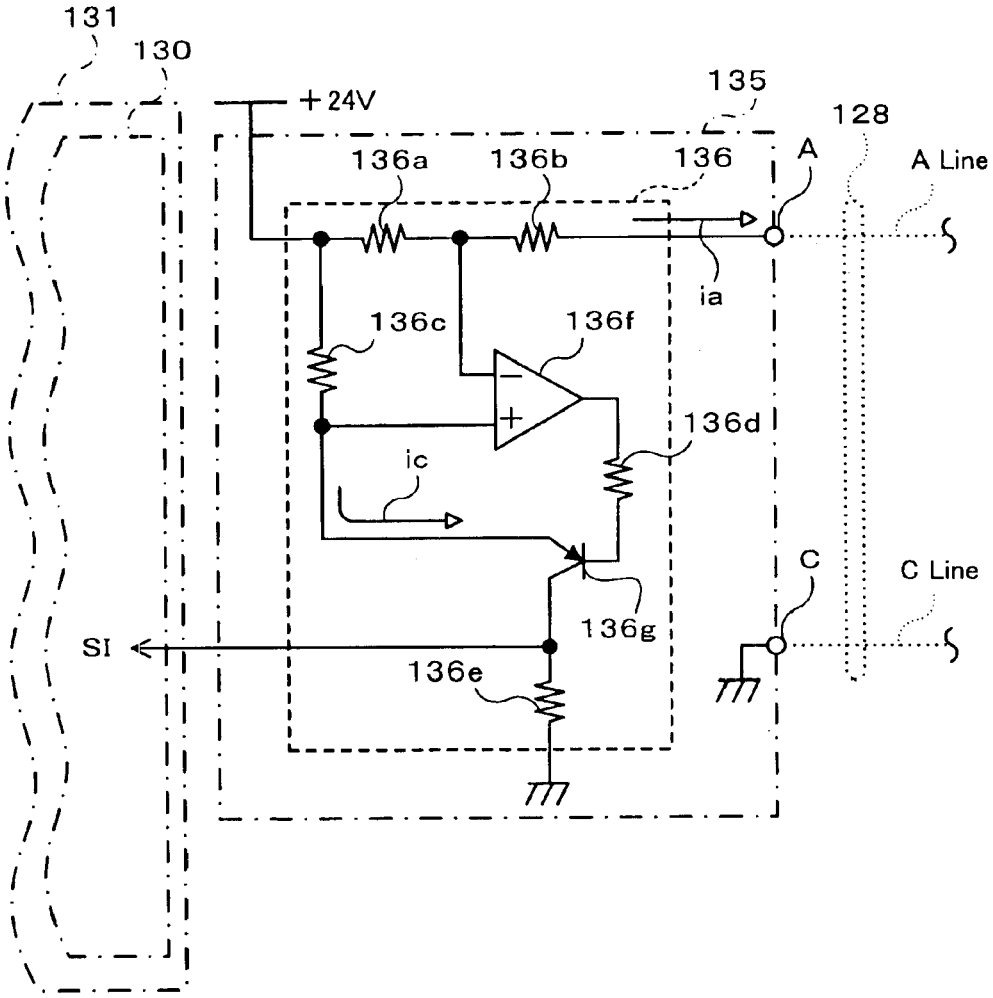
FIG. 14 is a circuit diagram of the central control section (portion of the reception control section) and the current detection section shown in FIG. 13.

FIG. 14 shows the central control section 131 (more specifically, a portion of the reception control section 130) and the current detection section 135. The circuit construction is for purposes of illustrating embodiments of the present invention and not for purposes of limiting the invention.

The current detection section 135 is equipped with two connection terminals (A and C terminals) and a current detection circuit 136.

The A terminal of the current detection section 135 is connected with the A line of the A-C line 128, while the C terminal is connected with the C line of the A-C line 128. The C terminal is also connected to a common potential (ground potential). The current detection circuit 136 detects a current ($i_c$) proportional to an answer current ($i_a$) that flows between the two terminals (A and C terminals), and converts the detected current ($i_c$) into a current-voltage conversion signal SI and outputs the signal SI to the central control section 131.

For instance, the current detection circuit 136 in FIG. 14 is equipped with five resistors 136*a* to 136*e*, an operational amplifier 136*f*, and a transistor 136*g*. Between the A terminal and a power source of +24 V, the resistors 136*a* and 136*b* are disposed in series. The connection point between the resistors 136*a* and 136*b* is connected to the inverting input (−input) of the operational amplifier 136*f*. The +24 V power source is connected to the non-inverting input (+input) of the operational amplifier 136*f* through the resistor 136*c*. The output of the operational amplifier 136*f* is connected to the base of the transistor 136*g*. The non-inverting input of the operational amplifier 136*f* is connected to the emitter of the transistor 136*g*. The collector of the transistor 136*g* is connected to a common potential through the resistor 136*e*.

With the above-described construction, the collector of the transistor 136*g* of the current detection circuit 136 is connected to a common potential through the resistor 136*e*, and the collector current ($i_c$) of the transistor 136*g* is accurately controlled according to the ratio of two input resistors (136*a* and 136*c*) of the operational amplifier 136*f*. That is, the collector current $i_c$ is $i_a/A$, in which $i_a$ is the answer current that flows from the +24 V power supply into the A-C line 128 and A is the ratio of the two input resistors 136*a* and 136*c* of the operational amplifier 136*f*. For example, when the resistor 136*a* is 100 Ω, and the resistor 136*c* is 10 kΩ, the resistor ratio A is 1/100 and therefore $i_c=i_a/100$. As a result, the collector current $i_c$ (which is $i_a/100$) can flow in the load resistor 136*e*.

Therefore, when the load resistor 136*e* is 10 kΩ, the value of the current-voltage conversion signal SI that is taken out from both ends of the load resistor 136*e* becomes 10 kΩ×$i_c$. Therefore, when $i_a$=35 mA, SI=10 kΩ×$i_c$=10 kΩ×(35 mA/100)=3.5 V.

As described above, SI is 3.5 V when $i_a$=35 mA. In this embodiment, in addition to 35 mA, $i_a$ can have 0 mA and 10 mA. Therefore, SI can have three values: 3.5 V (when $i_a$=35 mA), 0 V (when $i_a$=0 mA), and 1.0 V (when $i_a$=10 mA). When $i_a$=0 mA, there is no answer current. When $i_a$=10 mA and $i_a$=35 mA, answer current flows. Since 10 mA and 35 mA are values provided for the convenience of explanation, the present invention is not limited to these values.

Figure 15:
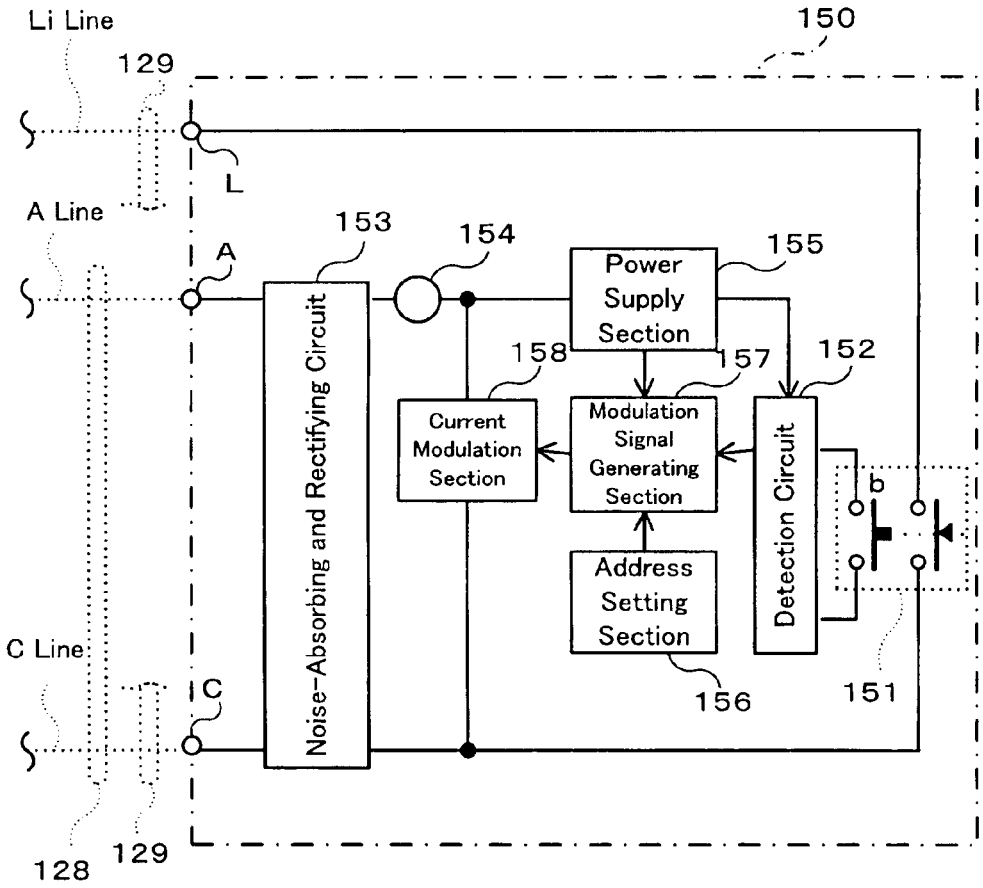
FIG. 15 is a block diagram showing the transmitter employed in the disaster prevention system of FIG. 12.

FIG. 15 shows a block diagram of the transmitter 150 constructed in accordance with the present invention. The transmitter 150 includes a push-button switch 151 (which corresponds to the push-button switch 109 of FIG. 47), and a detection circuit 152 for detecting the depressed state of the push-button switch 151 and generating a continuous detection signal. The transmitter 150 further includes a noise-absorbing and rectifying circuit 153, an operation confirming light 154 (corresponding to the operation confirming light 110 of FIG. 47), a power supply section 155, an address setting section 156, a modulation signal generating section 157, and a current modulating section 158. These components have the following functions, respectively.

The noise-absorbing and rectifying circuit 153 is a circuit for removing the noise component of the answer current (2.4 mA at the time of a steady state and 35 mA or 10 mA at the time of an abnormal situation) supplied from the receiver 120 through the A-C line 128, and then rectifying the current.

The power supply section 155 is a circuit for generating the internal power-supply voltage required of the detection circuit 152 and the modulation signal generating section 157, from the answer current rectified by the noise-absorbing and rectifying circuit 153.

The address setting section 156 is a circuit for setting identification information (address information) inherent in the transmitters 150.

The modulation signal generating section 157 is a circuit for generating a predetermined modulation signal in response to the detection signal output from the detection circuit 152. Although the modulation signal is described in detail later, it has fire information, and address information set by the address setting section 156.

The current modulating section 158 is a circuit for modulating the answer current in accordance with the modulation signal generated by the modulation signal generating section 157. With this circuit, 0 mA at the time of a steady state is modulated to 35 mA and 10 mA at the time of an abnormal situation. The modulation waveform is output to the receiver 120 through the A-C line 128.

Figure 16:
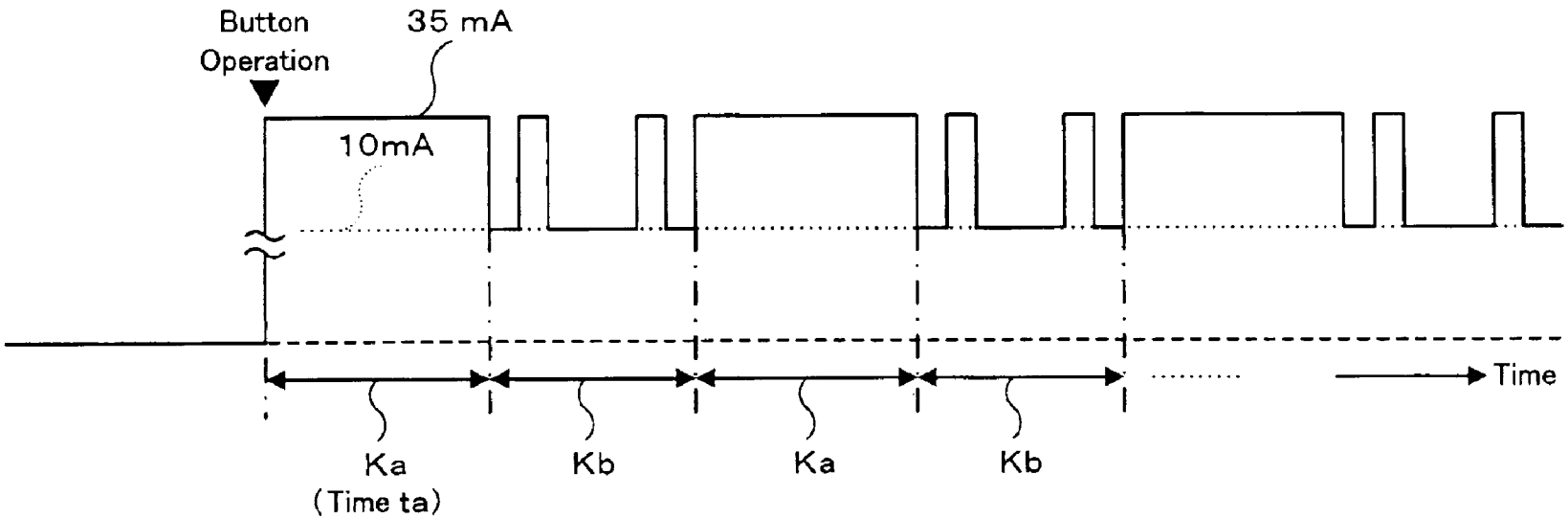
FIG. 16 is a waveform diagram of the answer current according to the third embodiment of the present invention.

FIG. 16 shows the modulation waveform of the answer current of the third embodiment. The waveform of the answer current is 2.4 mA at the time of a steady state and increases to 35 mA at the time of an abnormal situation. The answer current waveform is characterized in that (1) the length of the 35-mA increase period $K_a$ is a predetermined time $t_a$, (2) the 35-mA increase period $K_a$ is followed by a predetermined amplitude modulation period $K_b$, and (3) the 35-mA increase period $K_a$ and the amplitude modulation period $K_b$ are repeated as one unit.

Figure 17:
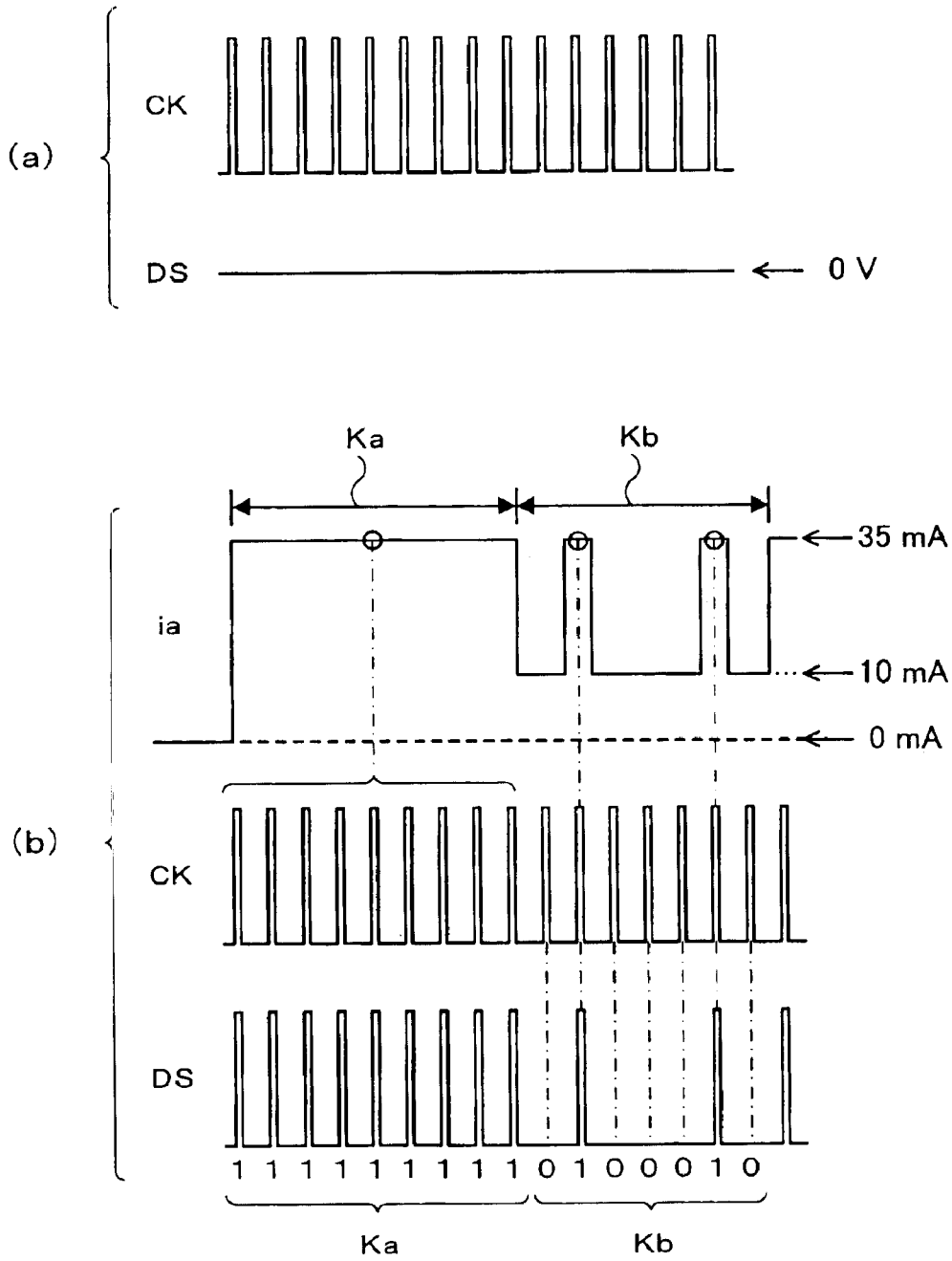
FIGS. 17A and 17B are timing diagrams showing operation of the receiver of the disaster prevention system of the third embodiment.

FIGS. 17A and 17B show timing diagrams of the operation of the receiver 120 of the disaster prevention system of the third embodiment. FIG. 17A shows a sampling clock CK, and a digital signal waveform DS obtained by binarizing SI (voltage converted from $i_c$), using the sample clock CK. In the case of FIG. 17A (during a steady state), $i_a$=0 mA and therefore SI becomes 0 V. If a threshold value for binarization is set to a slightly greater value than 1.0 V, the digital signal waveform DS maintains 0 V (logic 0) at the timing of the sampling clock CK.

On the other hand, FIG. 17B shows the answer current $i_a$ at the time of an abnormal situation, a sampling clock CK, and a digital signal waveform DS obtained by binarizing SI, using the sampling clock CK. In the case of FIG. 17B (during an abnormal situation), $i_a$ is constituted by the combination of the 35-mA increase period Ka and the amplitude modulation period Kb. The amplitude modulation period Kb is constituted by a combination of logic 1s (35 mA) and logic 0s (10 mA). Therefore, if SI is binarized at the sampling clock CK using the above-described threshold value, the digital signal waveform DS can be obtained. For example, in the illustrated waveform DS, the 35-mA increase period Ka is represented by nine logic 1s (111111111) and the amplitude modulation period Kb by 0100010. In the amplitude modulation period Kb (0100010), the first two bits (01) indicates a header and the remaining five bits indicates the address of a transmitter (set by the address setting section 156 of the transmitter 150).

Therefore, when nine logic 1s are obtained during the continuous time ($t_a$) of the 35-mA increase period Ka, the receiver 120 of the third embodiment is capable of grasping that confirmation current is flowing in the transmitter 150 in which the push-button switch was operated. The expression "confirmation current is flowing" means that current is flowing through the contact b of the push-button switch of the transmitter 150. That is, it means that the operation confirming light 110 of the transmitter 150 is being lit. The receiver 120 is also capable of finding the inherent address of the transmitter 150 (in which the operation confirming light 110 was lit) from the five bits following the header. For instance, in the illustrated example, the five bits are 00010. Since the binary number 00010 is equivalent to a decimal number 2, the receiver 120 can detect that fire information was output from the transmitter 150 having address number 2. That is, the operation confirming light 110 of the transmitter 150 with address number 2 is being lit.

Figure 18:
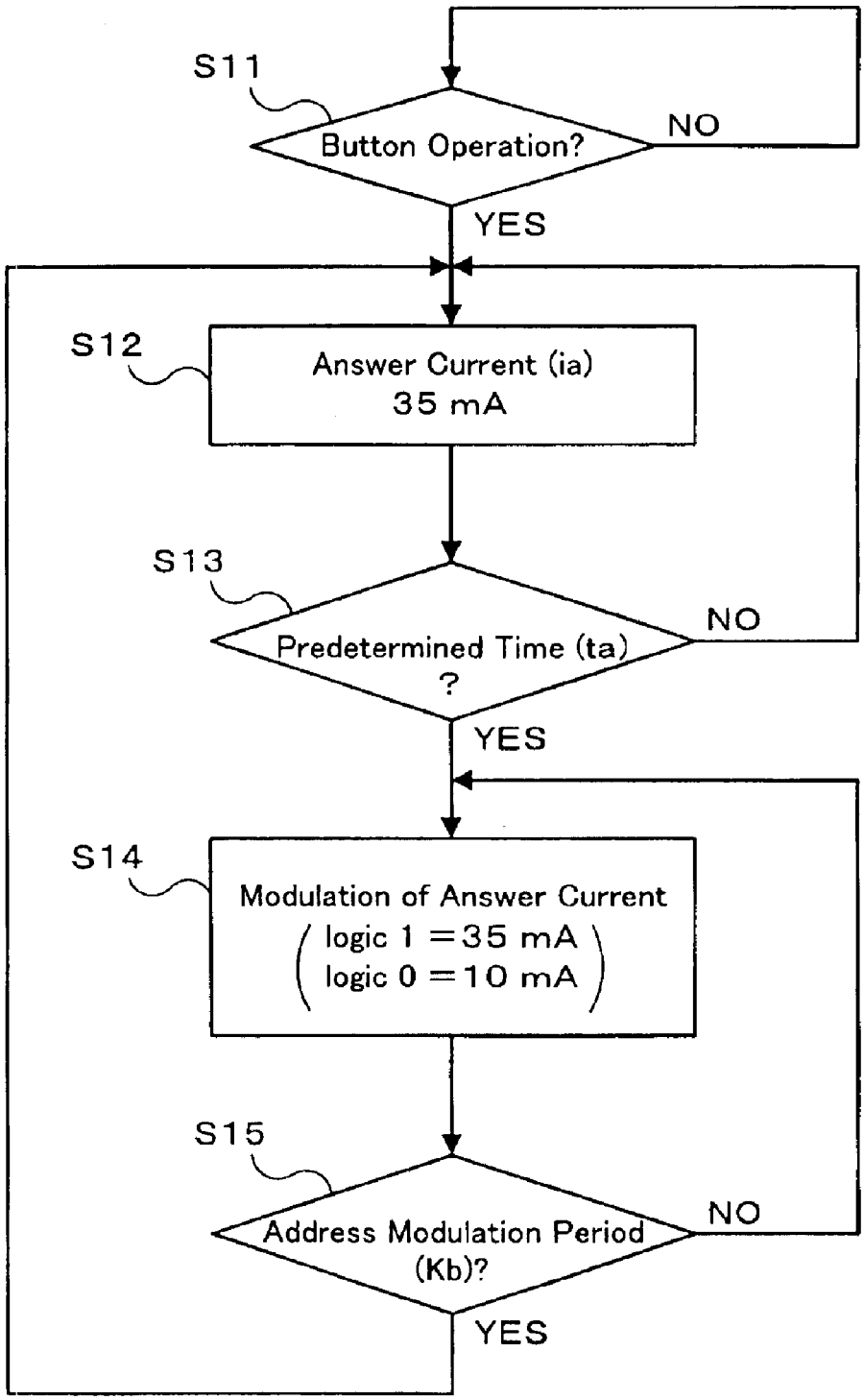
FIG. 18 is a flowchart showing how the transmitter in the disaster prevention system of FIG. 12 is operated.

FIG. 18 shows how the transmitter 150 is operated. If the push-button switch 151 is depressed (step S11), an answer current of 35 mA which flows from the receiver 120 to the A-C line 128 is detected (step S12). Then, the 35-mA increase period Ka is maintained for a predetermined time $t_a$ (step S13). Thereafter, the amplitude of the answer current is modulated (logic 1=35 mA, and logic 0=10 mA) based on the address information set to the address setting section 156 (step S14), and the maintenance of the 35-mA increase period Ka and the modulating operation are repeated.

Figure 19:
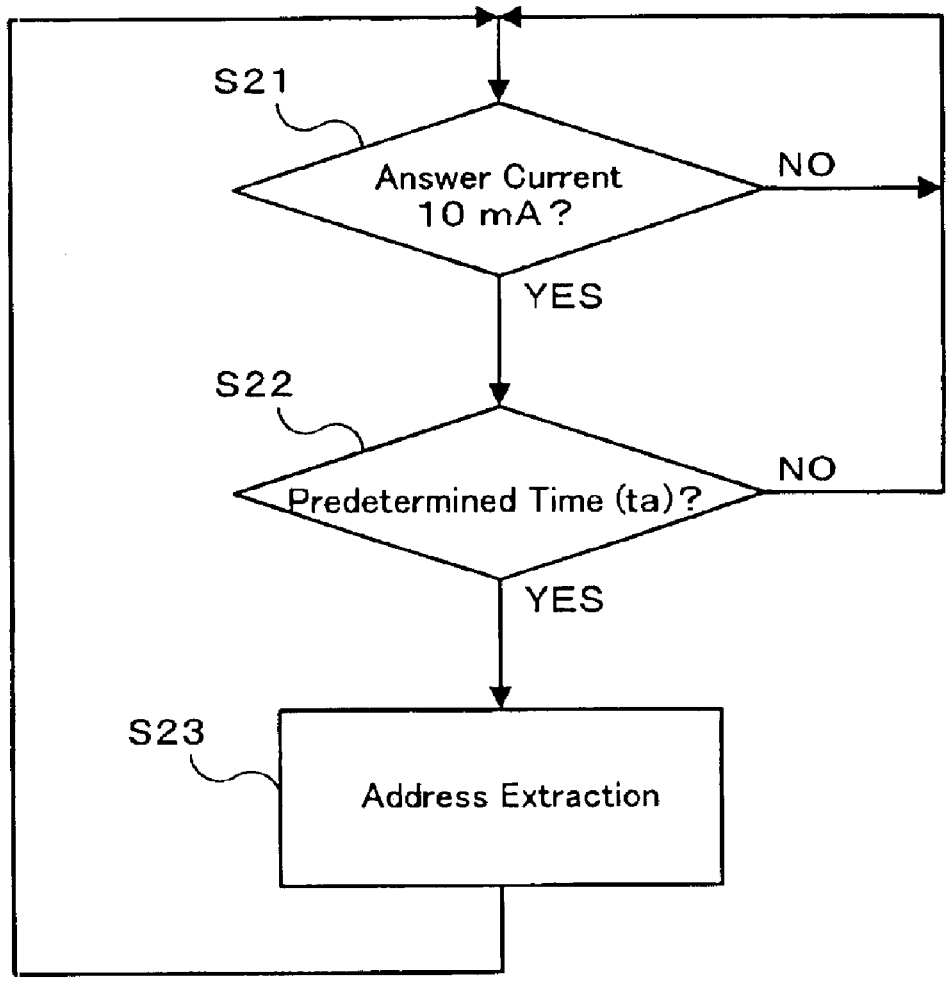
FIG. 19 is a flowchart showing how the receiver in the disaster prevention system of FIG. 12 is operated.

FIG. 19 shows how the receiver 120 is operated. It is judged whether or not the answer current is 2.4 mA or greater (exactly speaking, (10 mA+$\alpha$) or greater, in which $\alpha$ is a margin) (step S21). When it is 2.4 mA or greater and continues for a predetermined time ($t_a$) (step S22), the address information of the transmitter 150 from which abnormal-situation information was output is extracted from the modulation information of the answer current (step S23).

Thus, in response to the push-button operation of the transmitter 150, the answer current flowing in the A-C line 128 is modulated according to the address information of the transmitter 150, and the modulation of the answer current is detected by the receiver 120. Therefore, the place of urgent information (location of the transmitter 150) can be pinpointed.

Therefore, in the third embodiment of the present invention, the place of an abnormal situation such as a fire can be accurately grasped at a center side in which the receiver 120 is installed. Thus, guards can rush to the place of an abnormal situation through the shortest route. For instance, if this embodiment is applied to the guard of schools, etc., it is extremely useful as a crime prevention system.

Furthermore, since the third embodiment of the present invention makes no change in the external appearance and operability of the transmitter 150, users can use the transmitter 150 in like manner, and it can be easily applied to the existing fire alarm systems. In addition, in the case of an abnormal situation such as a fire, an assault by a ruffian, etc., the push-button switch of the transmitter 150 is first depressed to short-circuit the L-C line 129. Then, the short-circuited state (i.e., abnormal-situation information) is detected by the information detection section 134 provided in the L-C line 129. The transmitter 150 which issued the abnormal-situation information is specified by the current detection section 135 provided in the A-C line 128. Therefore, the information detection section 134 can use any of the existing information detection devices without making any change. Only the address extracting function of the current detection section 135 and the answer-current modulating function in the transmitter 150 are required. As a result, a change in the fire alarm system can be minimized.

In the third embodiment of FIG. 12, although the transmitter 150 has the function of generating its address, the present invention is not limited to this embodiment. For example, the transmitter 150 may be used as a repeater.

Figure 20:
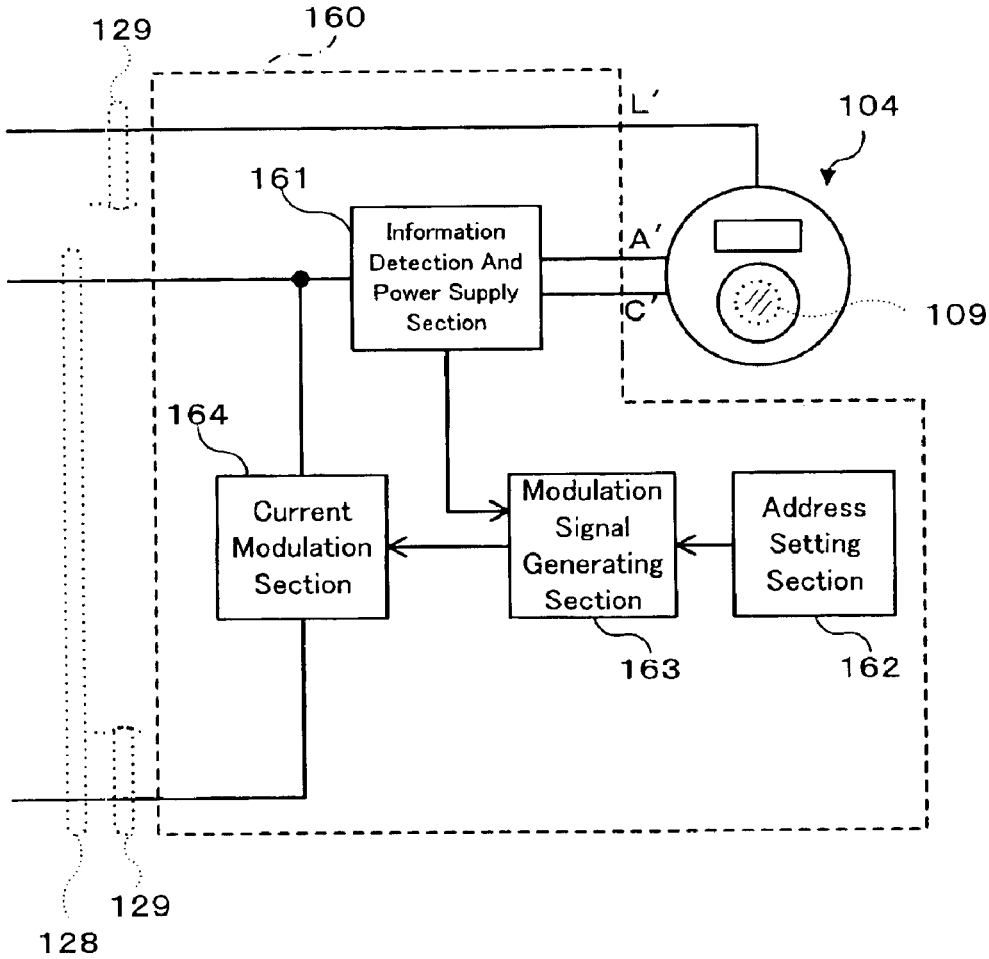
FIG. 20 is a block diagram showing a repeater constructed in accordance with a fourth embodiment of the present invention.

FIG. 20 shows a repeater 160 constructed in accordance with a fourth embodiment of the present invention. The repeater 160 is provided between a prior art transmitter (e.g., the transmitter 104 of FIG. 47) and the receiver 120. This repeater 160 includes L', A', and C' terminals which are connected with the transmitter 104, and L, A, and C terminals which are connected with the A-C line 128 and L-C line 129 extending from the receiver 120. The repeater 160 further includes an information detection and power supply section 161, an address setting section 162, a modulation signal generating section 163, and a current modulation section 164. These sections have the following functions, respectively. In the illustrated example, a single repeater 160 is connected with a signal transmitter 150. However, the present invention is not limited to this example. For instance, the repeater 160 may be connected with a plurality of transmitters 150.

The information detection and power supply section 161 is a circuit for detecting operation of the push-button switch 109 of the transmitter 104, then latching the detected state, and generating the internal power-supply voltage required of the modulation signal generating section 163.

The address setting section 162 is a circuit for setting the identification information inherent in each of the repeaters 160 (which is also the address information of the transmitter 104 connected with the repeater 160, or the group address information of a plurality of transmitters 104 connected with the repeater 160).

The modulation signal generating section 163 is a circuit for generating a predetermined modulation signal when an abnormal situation is sensed. As previously described, the modulation signal has abnormal-situation information, and address information set by the address setting section 156.

The current modulating section 164 is a circuit for modulating the answer current in accordance with the modulation signal generated by the modulation signal generating section 163. With operation of this circuit, the answer current which is 0 mA during a steady state is modulated at 35 mA and 10 mA at the time of an abnormal situation. The modulation waveform is transmitted to the receiver 120 through the A-C line 128.

In addition to the same advantages as the aforementioned embodiments, the existing facilities can be effectively utilized, because the repeater 160 provided separately from the transmitter 104 has the address generating function. For instance, in buildings with the transmitters 104, if only the receiver 120 and repeater 160 are installed, the fire alarm system with the crime preventing function according to the present invention can be easily constructed without exchanging the transmitter 104.

FIG. 21A shows the essential part (information detection and power supply section 161) of the repeater 160 of FIG. 20, improved with the object of reducing power consumption. In this example, the modulation signal generating section 163 is operated only at the time of an abnormal situation to save electric power. That is, the information detection and power supply section 161 has an information detection section 161*a*, a switch section 161*b*, and a constant voltage section 161*c*. When the button operation of the transmitter 104 is detected by the information detection section 161*a*, the switch section 161*b* is made on. Therefore, answer current is supplied to the constant voltage section 161*c* through the A terminal. In this manner, a voltage with which the modulation signal generating section 163 is operated is generated. When the button operation of the transmitter 104 is not detected by the information detection section 161*a*, the switch section 161*b* is made off. Therefore, since no electric power is consumed at the constant voltage section 161*c* during a steady state, electric power can be saved.

What kind of switching device is used in the switch section 161*b* belongs to the category of a design. For example, as shown in FIG. 21B, the switch section 161*b* may comprise a thyristor (which consists of four layers of PNPN in which a transistor has another PN junction). As is generally known, a thyristor is a three-terminal device that has an anode electrode (A), a cathode electrode (K), and a gate electrode (G). With a gate potential, a switch from an OFF-state to an ON-state can be made between the anode electrode and the cathode electrode. Once a switch to an ON-state is made, the gate potential will make no contribution to the switch. Therefore, it is necessary to make a current of some magnitude flow between the anode electrode and the cathode electrode to maintain the ON-state. The logic 0 (10 mA) in the above-described amplitude modulation period Kb is equivalent to the current for maintaining the ON-state. Therefore, in the case of employing a switching device which does not require such a maintaining current, there is no need to limit the level of the logic 0 in the amplitude modulation period Kb to 10 mA. For example, it may be the level (0 mA) of the answer current at the time of a steady state.

As set forth in the embodiments of FIGS. 12 to 21, the present invention has the following advantages:

If the push-button switch of the transmitter is operated, the receiver senses the short-circuited state of the L-C line, also detects that abnormal-situation information was output within a warning area allocated to the L-C line (129), and then causes answer current to flow in the A-C line. On the other hand, the transmitter which issued the abnormal-situation information modulates the answer current in accordance with its inherent address, and specifies the inherent address from the modulated state of the answer current. Therefore, using transmitters for fire information installed in public facilities such as schools, an abnormal situation such as a fire and an assault by a ruffian (location of a transmitter) can be specified at a center side where the receiver is installed. For example, in the case where a suspicious person is found in schools, etc., the place can be reported to the teacher's room, if only the nearest transmitter is operated. Therefore, guards or teachers can rush to the place of an abnormal situation. Thus, a fire prevention and crime prevention system that is very useful for school guard can be constituted.

According to the present invention, a transmitter can be realized which causes an L-C line to be in a short-circuited state when the push-button switch is operated; outputs abnormal-situation information; lights a confirming light by the answer current supplied from a receiver via the A-C line; and modulates the answer current in accordance with the inherent address information of the transmitter in which the confirming light is being lit. Therefore, by combining the transmitter with a receiver that has the function of specifying the inherent address of a transmitter which issued abnormal-situation information from the modulated state of the answer current, a fire prevention and crime prevention system that is very useful for school guard can be constituted.

According to the present invention, there is provided a receiver for sensing the short-circuited state of the L-C line when the push-button switch of a transmitter is operated, also detecting that an abnormal situation has occurred within a warning area allocated to the L-C line, then supplying answer current to an A-C line, and specifying the inherent address of the transmitter from which abnormal-situation information was output, from the modulated state of the answer current. Therefore, by combining the receiver with a transmitter that has the function of modulating its inherent address in accordance with the answer current, a fire prevention and crime prevention system that is very useful for school guard can be constituted.

According to the present invention, if the push-button switch of a transmitter is operated, the L-C line is short-circuited and abnormal-situation information is issued. In response to the abnormal-situation information, the answer current supplied from a receiver through the A-C line is modulated according to the inherent address information of the transmitter connected to a repeater. Therefore, by combining an existing transmitter with a receiver that has the function of specifying the inherent address of the transmitter from the modulated state of the answer current, a fire prevention and crime prevention system that is very useful for school guard can be constituted at a low cost.

According to the present invention, if the push-button switch of any of transmitters connected to a repeater is operated, the L-C line is short-circuited and abnormal-situation information is issued. In response to the abnormal-situation information, the answer current supplied from a receiver through the A-C line is modulated according to the group address information of the transmitters connected to the repeater. Therefore, a plurality of transmitters can be grouped and the costs for constituting a fire prevention and crime prevention system that is very useful for school guard can be reduced.

FIG. 22A shows a data set support system constructed in accordance with a fifth embodiment of the present invention. Reference numeral 210 denotes data set support system comprising a personal computer (PC). The PC 210 is connected with a fire receiver 230 through a cable 209 at all times or when "corresponding data" described later is written.

The PC 210 is constructed by known architecture (DOS/V architecture). In FIG. 22A, while a notebook-sized PC 210 with a display unit, a keyboard, and a pointing device is shown, the present invention is not limited to this. It may be a hand-held type, a mobile type, a desktop type, a tower type, etc. The PC 210 may be a workstation, an office computer, a minicomputer, an information processor, etc.

As shown in FIG. 22B, the PC 210 includes a main body portion 211. The main body portion 211 has a central processing unit (CPU) 212, a random access memory (RAM) 213, a disk controller 214, a disk unit 215, a display controller 216, a display unit 217, a keyboard controller 218, a keyboard 219, a pointing device 220, a communication section 221, a main bus 222, a bus interface 223, and an internal bus 224.

In the PC 210, an operating system and various application programs, installed in the disk unit 215, are loaded into the RAM 213 and executed by the CPU 212. Various processing functions are realized by an organic combination of hardware (CPU 12, etc.) and software resources.

One of the processing functions is a fire data management system that is executed alone in the PC 210. Before describing in detail the stand-alone function, a description will be given of a fire alarm system.

Figure 23:
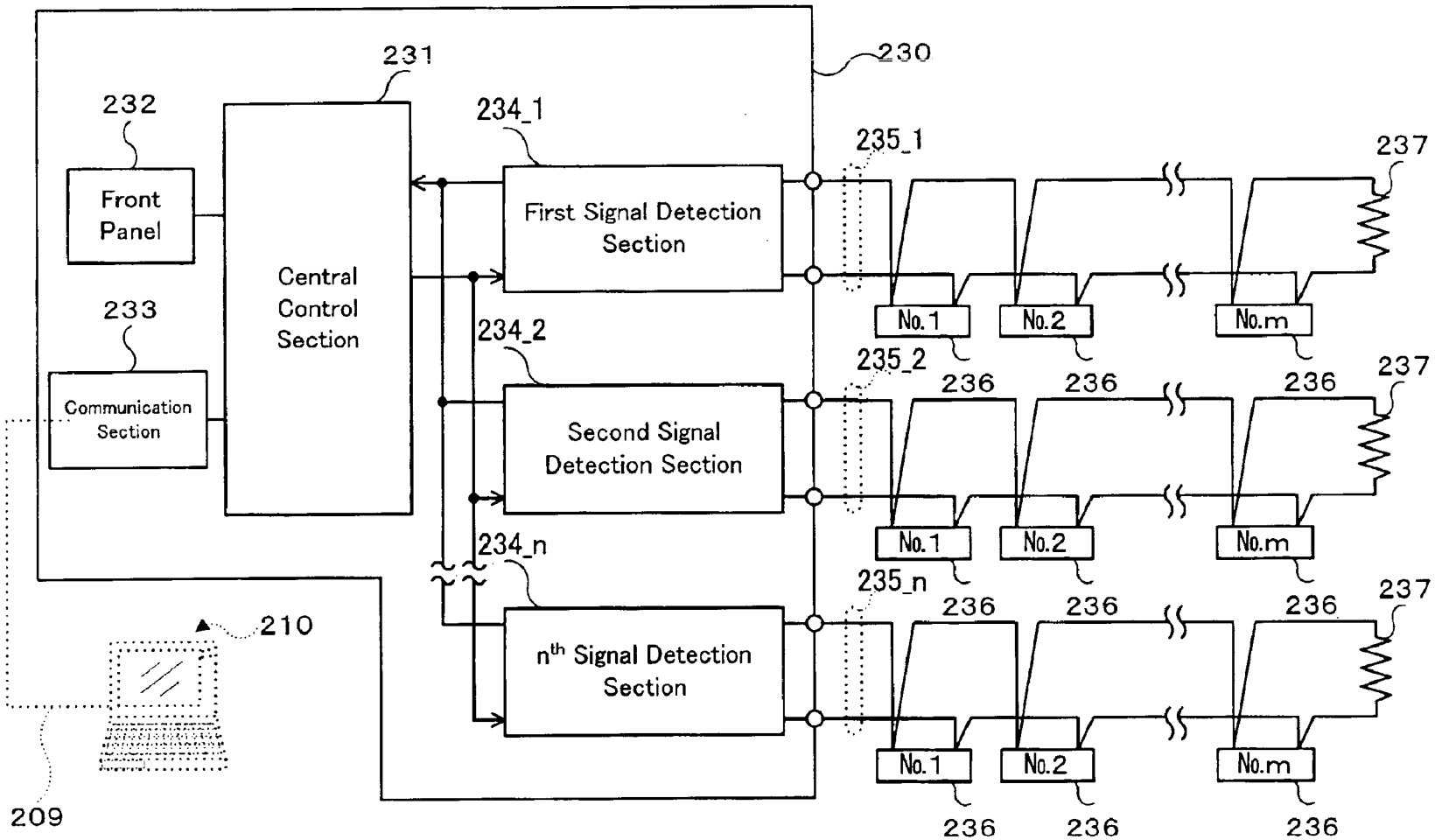
FIG. 23 is a block diagram showing a fire alarm system constructed in accordance with a sixth embodiment of the present invention.

FIG. 23 shows a fire alarm system constructed in accordance with a sixth embodiment of the present invention. Although this embodiment is applied to a P-type fire alarm system in which monitoring is performed for each line, the present invention is not limited to this system. For example, it is applicable to an R-type fire alarm system. The R-type fire alarm system includes a fire receiver, which receives as an inherent signal a fire signal issued from a sensor directly or through a repeater. Between the sensor (or the repeater) and the fire receiver, a signal is sent through the same electric line. Based on the recorded symbol of the signal input to the fire receiver, the place from which the fire signal is sent can be identified. Because of this, it is called a record type. The signal between the sensor (or the repeater) and the fire receiver is processed through transmission. That is, in the R-type fire alarm system, a question signal called a "calling pulse" is regularly transmitted from the fire receiver to the sensors or repeaters. When the sensor or repeater is called out by the calling pulse, it sends the required information back to the fire receiver.

The fire receiver 230 of this embodiment of FIG. 23 includes a central control section 231, a front panel 232, a communication section 233, and n current detection sections (first current detection section 234_1 to $n^{th}$ current detection section **234_*n***).

When constituting the fire alarm system, an arbitrary number of fire sensors 236 (for convenience, m sensors No. 1 to No. m) are connected to n sensor lines 235_1 to **235_*n* drawn from the current detection sections 234_1 to 234_*n*, and the terminal ends of each of the sensor lines 235_1 to 235_*n* are connected with a resistor 237 for termination. The fire sensor 236 is used for short-circuiting a connected sensor line when a fire is detected. The fire sensor 236 may comprise various types of fire sensors such as a photoelectric smoke sensor, a thermistor type heat sensor, a differential sensor, a constant-temperature sensor, etc. In addition to the fire sensors 236, the fire receiver 230 can also be connected with push-button alarms (transmitters) for issuing the occurrence of an urgent situation such as a fire, etc. Because of this, the fire receiver 230 includes fire-information lines in addition to the sensor lines 235_1 to 235_*n*. The fire-information lines are omitted for the convenience of explanation. In the following description, the term "fire sensor" refers to a transmitter as well as the fire sensor 236**.

The current detection sections 234_1 to **234_*n* monitor the line currents (sensing currents) of the sensor lines 235_1 to 235_*n*, respectively. Based on the result of monitoring, an information signal or identification information signal from the fire sensor 236 is detected. The detected information is output to the central control section 231**.

Figure 24:
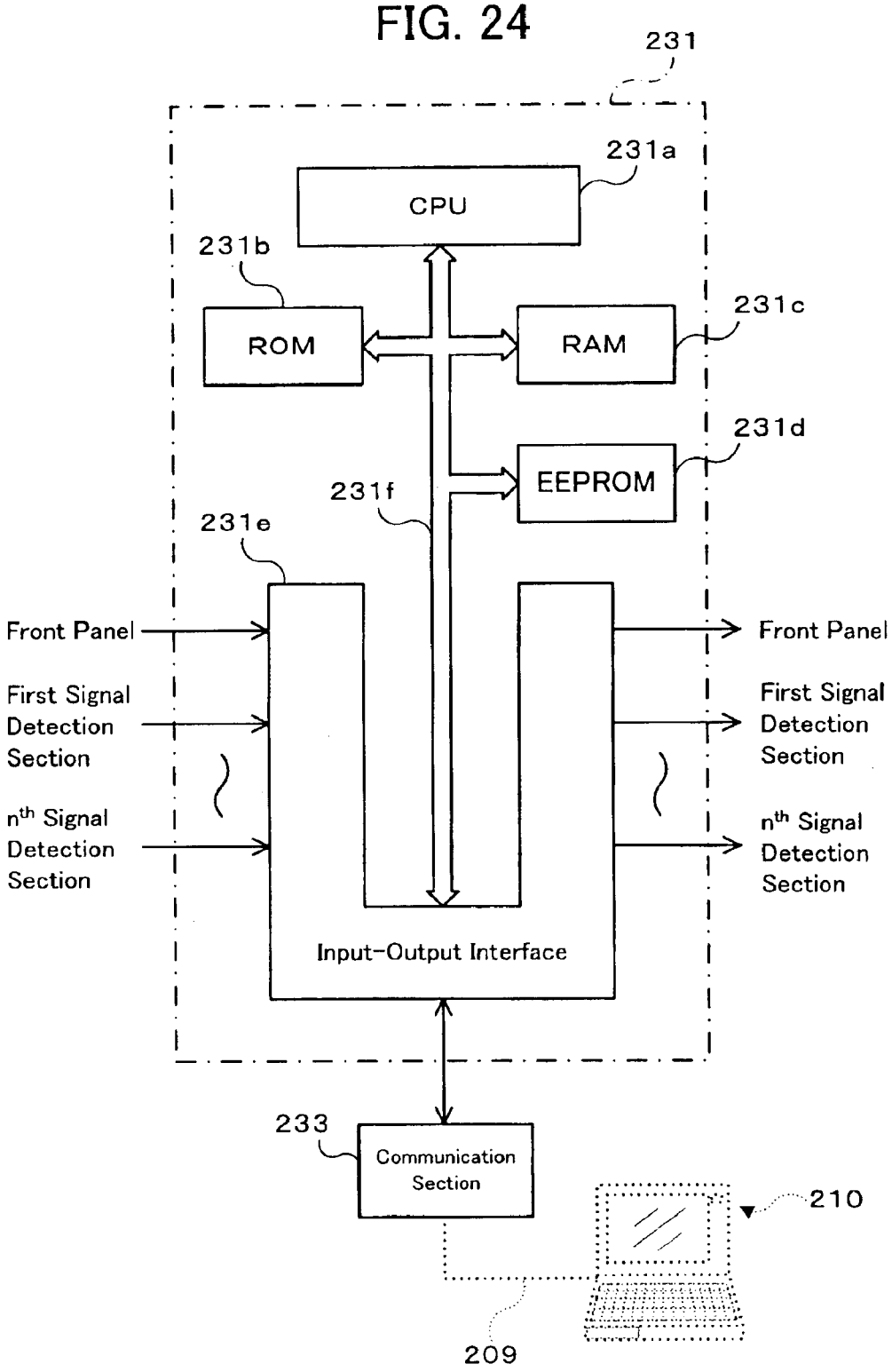
FIG. 24 is a block diagram of the central control section shown in FIG. 23.

FIG. 24 shows a block diagram of the central control section 231. In the figure, the central control section 231 includes a CPU 231*a*, a read-only memory (ROM) 231*b*, an electrically erasable programmable read-only memory (EEPROM) 231*d*, an input-output interface 231*e*, and a bus 231*f*. However, the present invention is not limited to this example. These components may be designed by hard-wired logic.

Figure 38:
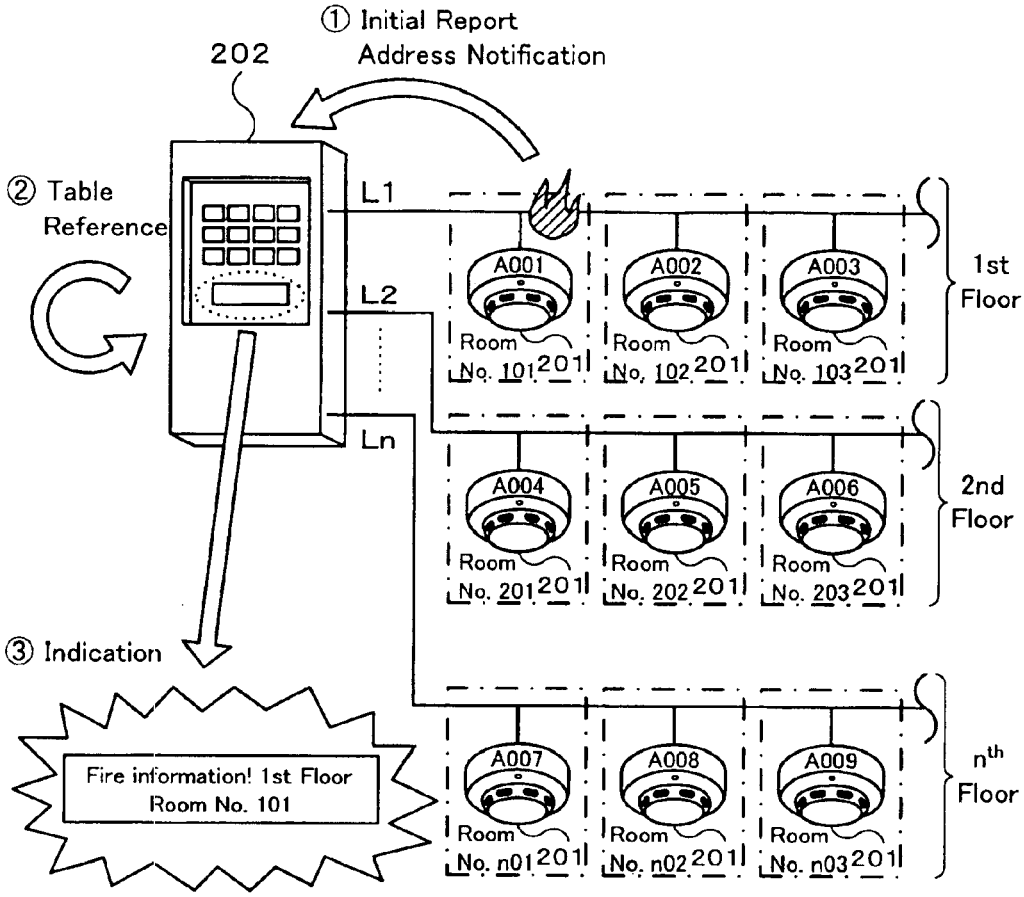
FIGS. 38A and 38B are diagrams showing a fire alarm system and showing data which corresponds to the addresses and installation places of all fire sensors provided in the fire alarm system.

In the CPU 231*a*, software resources, such as a control program, etc., stored in the ROM 231*b* are loaded into the RAM 231*c* and are executed to realize various functions required of the fire receiver 230. The RAM 231*c* provides a work area to the UPU 231*a*. The EEPROM 231*d* stores variable data inherent in each fire alarm system so that it is electrically rewritable (the representative data is the corresponding data 3 shown in FIG. 38B).

The input-output interface 231*e* controls the input and output signals between itself and the front panel 232, and the input and output signals between itself and the signal detection sections 234_1 to 234_*n*. The input-output interface 231*e* further controls signals that are input to or output from the PC 210 through the communication section 233.

The central control section 231, constructed as described above, detects fire information and extracts the address of the fire sensor 236 that issued the fire information, based on information from the signal detection sections 234_1 to 234_*n*. The central control section 231 looks up the installation place information of the fire sensor 236 that issued fire information from the corresponding data 203 stored in the EEPROM 234, using the extracted address information. These pieces of information can be displayed, for example, on the front panel 232. As occasion demands, the corresponding data 203 stored in the EEPROM 234 can be updated through PC 210.

FIG. 25A is a diagram showing the hierarchical structure of the hardware and software resources of the PC 210. The hierarchical structure 240 is similar to the open systems interconnection (OSI) reference model and consists of a hardware resource layer 241, an operating system layer 242 stacked on the hardware resource layer 241, and an application layer 243 stacked on the operating system layer 242.

The hardware resource layer 241 includes hardware resources 244 such as a CPU 212 (i.e., construction of FIG. 22B) and makes indirect utilization of the hardware resources 244 from the application layer 243 possible through an operating system 245 included in the operating system layer 242. The application layer 242 includes at least a database program 246 which forms the main part of the fire data management system, and a predetermined application program 247 which includes processing rules for the database program 246, a user interface program, etc. The fire data management system of the present invention is realized by an organic combination of these software resources (operating system 245, database program 246, application program 247) and the hardware resources 244.

FIG. 25B shows a conceptual diagram of the fire data management system constructed in accordance with a seventh embodiment of the present invention. In the figure, a user interface section 248 and a processing rule section 249 are realized by the application program 247 of FIG. 25A. A database section 250 is realized by the database program 246 of FIG. 25A.

The user interface section 248 outputs various graphical user interface (GUI) screens to the display resources (display controller 216 and display unit 217) of the hardware resources 244. The processing rule section 249 generates various GUI screens in an even-driven method, also reads information input to the GUI screen, generates information to be displayed on the GUI screen, and prints information as occasion demands. That is, the processing rule section 249 is the nucleus of the fire data management system of the present invention.

The database section 250 stores various kinds of electronic data required of the fire data management system. For instance, it may be formed as a database file designed by the use of a general-purpose database program (also called a database management system (DBMS)).

The database management systems are divided broadly into a relational type and other simple types (a card type, etc.). In principle these types may be used to realize the fire data management system of the present invention. However, the relational type is preferred because information within the database can be normalized to solve a contradiction in information.

The database management systems are also classified into a processing-rule mounting type and a processing-rule armoring type. In the processing-rule mounting type, the user interface section 248, the processing rule section 249, and the database section 250 are designed as a single file. In the processing-rule armoring type, only the database section 250 is designed. The user interface section 248 and the processing rule section 249 are designed by another software development support tool (e.g., a "Visual Basic" tool (Microsoft), a "C++" tool (Microsoft), etc.). Both types can be used.

In the illustrated embodiment, the fire data management system is realized as a stand-alone type. Therefore, the database section 250 and the other sections (user interface section 248 and processing rule section 249) may be formed integrally with each other. In this respect, a processing-rule mounting type of DBMS (e.g., Access 95/97/2000 (Microsoft)) can be used.

In the case where a small quantity of data is handled, the management of data equivalent to a database can be performed by utilizing, for example, text files and array on memory without using database program software such as DBMS, etc. The present invention is applicable to these various methods.

Figure 26:
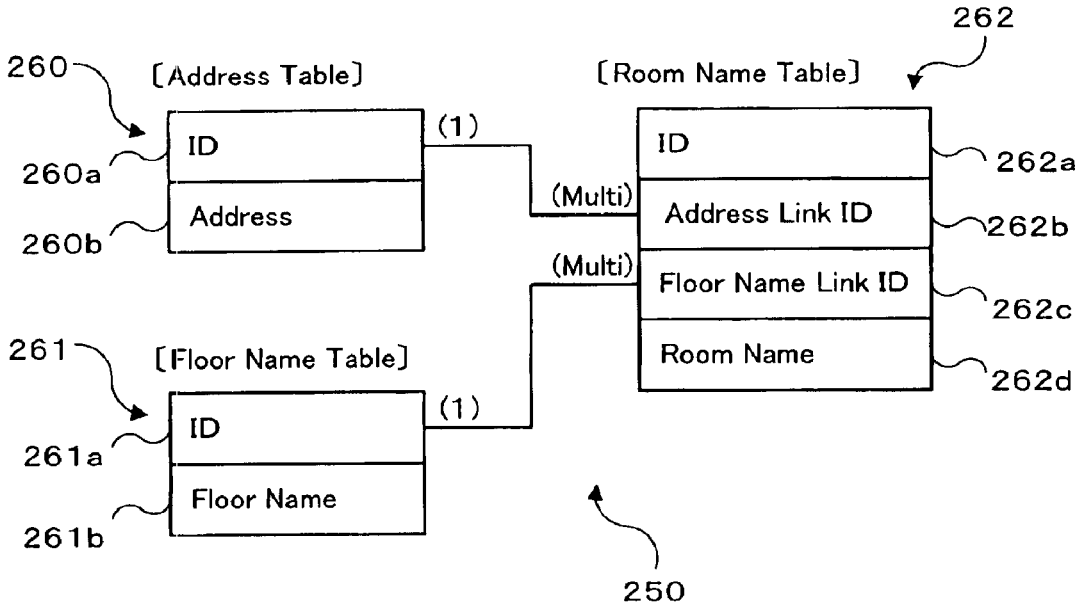
FIG. 26A is a conceptual diagram of the table structure of the database section in the fire data management system.
FIG. 26B is a conceptual diagram of a record set.

FIG. 26 shows the table structure of the database section 250. As described previously, the database section 250 stores various kinds of electronic data required of the fire data management system. In FIG. 26, the database section 250 consists of three tables 260 to 262 normalized. This table structure is merely an example.

The first table is an address table 260 for storing the address information of each fire sensor 236. Each record of the address table 260 (which is a set of data to which reference is made by the information of a key field) consists of an ID field 260*a* (which is a key field) and an address field 260*b* in which address information is stored.

The second table is a floor name table 261 for storing monitoring area names (in this embodiment, floor names). Each record of the floor name table 261 consists of an ID field 261*a* (which is a key field) and a floor name field 261*b* in which a floor name is stored.

The third table is a room name table 262 for storing the installation places of the fire sensors 236 (in this embodiment, room names). Each record of the room name table 262 consists of an ID field 262*a* (which is a key field), an address link ID field 262*b* for a relation with the address table 260, a floor name link ID field 262*c* for a relation with the floor name table 261, and a room name field 262*d* in which a room name is stored.

The tables 260 to 262, constructed as described above, can freely perform addition of a record, deletion of a record, editing of record contents, extraction of a specific record, generation of a record set, and rearrangement of records within a record set, using a structured query language (SQL) command by the processing rule section 249. The record operation can be performed individually on the three tables 260 to 262. It can also be performed on a plurality of tables having a relation property.

In the tables 260 to 262, a one-to-multi relation property is set between the address table 260 and the room name table 262, and between the floor name table 261 and the room name table 262. Therefore, if an arbitrary field between tables related to each other is selected, a desired record operation can be performed on a temporary table object (i.e., a set of records) generated by the selected field.

FIG. 26B shows a record set 263, which consists of an address field 263*a*, a floor name field 263*b*, and a room name field 263*c*. The field data in the record set 263 is the field data stored in the address table 260, floor name table 261, and room name table 262.

The "one-to-multi" in the relation property means that one record of one table is related with a plurality of records of another table. For example, in the case where one room is provided with a plurality of fire sensors 236, one record of the room name table 262 is related with a plurality of records of the address table 260. Such a relation refers to a one-to-multi relation.

Now, the GUI screen (also called a form object) in this embodiment will be described in detail.

Figure 27:
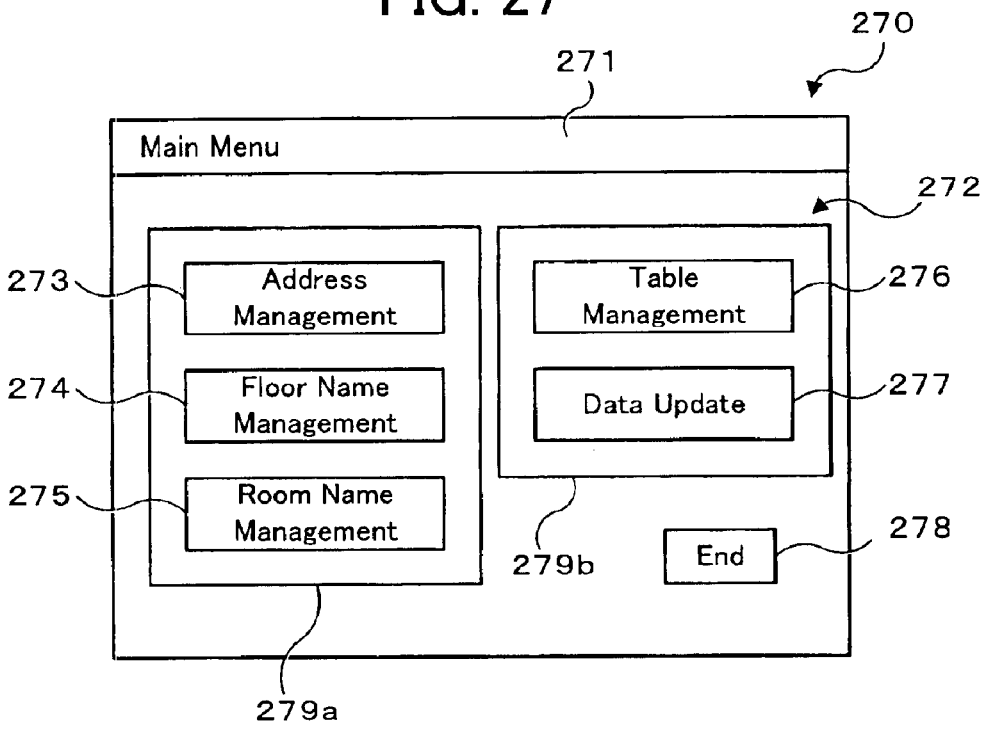
FIG. 27 is a diagram showing a main menu screen.

FIG. 27 shows a main menu screen 270. In the figure, the main menu screen 270 is displayed on the display unit 217 when the PC 210 is started or when a user clicks on a shortcut disposed in the desktop, etc., of the PC 210.

The main menu screen 270 has a title bar 271, which includes a suitable character string (e.g., "main menu"). The main menu screen 270 also has a client area 272, which includes 6 (six) command button controls 273 to 278. The title properties of the command button controls 273 to 278 have character strings such as Address management, Floor name management, Room name management, Table management, Data update, and End, respectively. In addition, the click event properties of the command button controls 273 to 278 are provided with processing procedures that are predicted from the above-described character strings, respectively.

That is, if the command button controls 273 to 278 are represented by the above-described character strings of the title properties, the click event of the address management command button control 273 is provided with a procedure of opening an address management screen 280 (see FIG. 28) when the user clicks on this button. The click event of the floor name management command button control 274 is provided with a procedure of opening a floor name management screen 300 (see FIG. 29) when the user clicks on this button.

The click event of the room name management command button control 275 is provided with a procedure of opening a room name management screen 320 (see FIG. 30) when the clicks on this button. The click event of the table management command button control 276 is provided with a procedure of opening a table management screen 340 (see FIG. 31) when the user clicks on this button.

The click event of a receiver's corresponding data update command button control 277 is provided with a procedure of overwriting and updating the corresponding data stored in the fire receiver 230 (i.e., corresponding data 203 stored in the EEPROM 231) when the user clicks on this button. The click event of the end command button control 278 is provided with a procedure of closing the main menu screen 270 and ending the application program 247 when the user clicks on this button.

The framed objects 279*a* and 279*b* of the main menu screen 270 are frames for classifying the tasks of the five command button controls 273 to 277 (Address management, Floor name management, Room name management, Table management, and Data update) other than the end command button control 278. The framed object 279*a* on the left side indicates that the command controls 273 to 275 within the frame are employed for data processing for a basic information management table (master table) such as the address table 260, floor name table 261, and room name table 262. The framed object 279*b* on the right side indicates that the command controls 276 and 277 within the frame are employed for setting a relation between the records of the above-described basic information management tables, also generating the record set 263 shown in FIG. 26B, and furthermore, using the record set 263 and overwriting and updating the corresponding data stored in the fire receiver 230 (i.e., corresponding data stored in the EEPROM 231).

FIG. 28A shows an address management screen 280. In the figure, the address management screen 280 includes a title bar 281, which has a suitable character string (e.g., Address Management). The address management screen 280 further includes a client area 282, which has a list box control 283, an edit command button control 284, an add command button control 285, a delete command button control 286, and a close command button control 287.

The list box control 283 lists the record information registered in the address table 260. If any of the rows in the list box control 283 is selected, then the edit command button control 284 and the delete command button control 286 can be used ("True" is set to an enabled property). The close command button control 287 is used to close itself (address management screen 280). Note that the "ID" and "Address" columns in the list box control 283 list the information stored in the ID field 260*a* and address field 260*b* of the address table 260.

If a user selects a certain row in the list box control 283 and clicks on the delete command button control 286, a specific record in the address table 260 corresponding to the selected row can be deleted. If the user selects a certain row in the list box control 283 and clicks on the edit command button control 284, a specific record in the address table 260 corresponding to the selected row can be extracted. The detailed address management screen 290 shown in the FIG. 28B can be opened and the extracted information can be displayed on the control within the screen. The detailed address management screen 290 can also be opened when the user clicks on the add command button control 285. In this case, the selected row in the list box control 283 is ignored.

In FIG. 28B, the detailed address management screen 290 includes a title bar 291, which has a suitable character string (e.g., detailed address management () where  represents an open mode). In the figure, since ** is "add," it represents a record adding mode when the user clicks on the add command button control 285. The detailed address management screen 290 further includes a client area 292, which has an ID text button control 293, an address text box control 294, an OK command button control 295, and a cancel command button control 296. Note that the ID text button control 293 is a display only control (edit enabled property= false).

When the detailed address management screen 290 is opened in an add mode, a candidate ID (e.g., 006 in the figure) for a new record is set to an ID text box control 293. If the user inputs an arbitrary address (e.g., A006 in the figure) to an address text box control 294 and clicks on the OK command button control 295, a new record of ID "006" is added to the address table 260. The address "A006" is stored in the address field 260*b* of the added record and the detailed address management screen 290 is closed. Note that addition of a new record is decided when the user clicks on the OK command button control 295. When the user clicks on the cancel command button control 296, addition of a new record is stopped and the detailed address management screen 290 is closed.

When the detailed address management screen 290 is opened in an edit mode, the contents of a record in the address table 260 can be updated if the user changes the information (address) of an editing object, and the detailed address management screen 290 can be closed if the user clicks on the OK command button control 295. When the user clicks on the cancel command button control 296, updating of a record is stopped and the detailed address management screen 290 is closed.

Therefore, according to the address management screen 280 and the detailed address management screen 290, the addition of a new record or editing of the existing record can be freely performed in the address table 260 of the database section 250 of the database program 246. Therefore, since a user-friendly interface can be provided, the addresses of all the fire sensors 236 can be efficiently and correctly registered in the address table 260. In addition, even in the case where some of the fire sensors 236 are exchanged, the addresses can be reliably reregistered.

FIG. 29A shows a floor name management screen 300. In the figure, the floor name management screen 300 includes a title bar 301, which has a suitable character string (e.g., Floor Name Management). The floor name management screen 300 further includes a client area 302, which has a list box control 303, an edit command button control 304, an add command button control 305, a delete command button control 306, and a close command button control 307.

The list box control 303 lists the record information registered in the floor name table 261. If any of the rows in the list box control 303 is selected, then the edit command button control 304 and the delete command button control 306 can be used ("True" is set to an enabled property). The close command button control 307 is used to close itself (floor name management screen 300). Note that the "ID" and "Address" columns in the list box control 303 list the information stored in the ID field 261*a* and floor name field 261*b* of the floor name table 261.

If the user selects a certain row in the list box control 303 and clicks on the delete command button control 306, a specific record in the floor name table 261 corresponding to the selected row can be deleted. If the user selects a certain row in the list box control 303 and clicks on the edit command button control 304, a specific record in the floor name table 261 corresponding to the selected row can be extracted. The detailed floor name management screen 310 shown in the FIG. 29*b* can be opened and the extracted information can be displayed on the control within the screen. The detailed floor name management screen 310 can also be opened when the user clicks on the add command button control 305. In this case, the selected row in the list box control 303 is ignored.

In FIG. 29B, the detailed floor name management screen 310 includes a title bar 311, which has a suitable character string (e.g., detailed floor name management () where  represents an open mode). In the figure, since  is "add," it represents a record adding mode when the user clicks on the add command button control 305. The detailed floor name management screen 310 further includes a client area 312, which has an ID text button control 313, a floor name text box control 314, an OK command button control 315, and a cancel command button control 316. Note that the ID text button control 313** is a display only control (edit enabled property=false).

When the detailed floor name management screen 310 is opened in an add mode, a candidate ID (e.g., 004 in the figure) for a new record is set to an ID text box control 313. If the user inputs an arbitrary address (e.g., fourth floor in the figure) to a floor name text box control 314 and clicks on the OK command button control 315, a new record of ID "004" is added to the floor name table 261. The floor name "fourth floor" is stored in the floor name field 261*b* of the added record and the detailed floor name management screen 310 is closed. Note that addition of a new record is decided when the user clicks on the OK command button control 315. When the user clicks on the cancel command button control 316, addition of a new record is stopped and the detailed floor name management screen 310 is closed.

When the detailed floor name management screen 310 is opened in an edit mode, the contents of a record in the floor name table 261 can be updated if the user changes the information (floor name) of an editing object, and the detailed floor name management screen 310 can be closed if the user clicks on the OK command button control 315. When the user clicks on the cancel command button control 316, updating of a record is stopped and the detailed floor name management screen 310 is closed.

Therefore, according to the floor name management screen 300 and the detailed floor name management screen 310, the addition of a new record or editing of the existing record can be freely performed in the floor name table 261 of the database section 250 of the database program 246. Therefore, since a user-friendly interface can be provided, the warning area information (e.g., floor names) of a building with fire sensors can be efficiently and correctly registered in the floor name table 261. In addition, for example, even in the case where the warning area information is changed from floor names to company names, the changes can be reliably reregistered.

FIG. 30A shows a room name management screen 320. In the figure, the room name management screen 320 includes a title bar 321, which has a suitable character string (e.g., Room Name Management). The room name management screen 320 further includes a client area 322, which has a list box control 323, an edit command button control 324, an add command button control 325, a delete command button control 326, and a close command button control 327.

The list box control 323 lists the record information registered in the room name table 262. If any of the rows in the list box control 323 is selected, then the edit command button control 324 and the delete command button control 326 can be used ("True" is set to an enabled property). The close command button control 327 is used to close itself (room name management screen 320).

Note that the "ID" and "Address" columns in the list box control 323 list the information stored in the ID field 262*a* and address field 262*b* of the room name table 262. The "Floor name" column in the list box control 323 lists the information stored in the floor name field 261*b* of the floor name table 261 related with the floor name link ID field 262*c* of the room name table 262.

If the user selects a certain row in the list box control 323 and clicks on the delete command button control 326, a specific record in the room name table 262 corresponding to the selected row can be deleted. If the user selects a certain row in the list box control 323 and clicks on the edit command button control 324, a specific record in the room name table 262 corresponding to the selected row can be extracted. The detailed room name management screen 330 shown in the FIG. 30*b* can be opened and the extracted information can be displayed on the control within the screen. The detailed room name management screen 330 can also be opened when the user clicks on the add command button control 325. In this case, the selected row in the list box control 323 is ignored.

In FIG. 30B, the detailed room name management screen 330 includes a title bar 331, which has a suitable character string (e.g., detailed room name management () where  represents an open mode). In the figure, since  is "add," it represents a record adding mode when the user clicks on the add command button control 325. The detailed room name management screen 330 further includes a client area 332, which has an ID text button control 333, a room name text box control 334, a floor name list box control 335, an OK command button control 336, and a cancel command button control 337. Note that the ID text button control 333 is a display only control (edit enabled property=false). In addition, the data source of the floor name list box control 335 is the record information registered in the floor name table 261**.

When the detailed room name management screen 330 is opened in an add mode, a candidate ID (e.g., 006 in the figure) for a new record is set to an ID text box control 333. If the user inputs an arbitrary address (e.g., Room No. 203 in the figure) to a room name text box control 334, also selects a desired floor name (e.g., 2nd floor in the figure), and clicks on the OK command button control 336, a new record of ID "006" is added to the address table 260. The room name "Room No. 203" is stored in the room name field 262*d* of the added record. In addition, the ID of the record (in which "2nd floor" is stored) of the floor name table 261 is stored in the floor name link ID field 262*c* of the added record, and the detailed room name management screen 330 is closed.

Note that addition of a new record is decided when the user clicks on the OK command button control 336. When the user clicks on the cancel command button control 337, addition of a new record is stopped and the detailed room name management screen 330 is closed.

When the detailed room name management screen 330 is opened in an edit mode, the contents of a record in the room name table 262 can be updated if the user changes the information (room and floor names) of an editing object, and the detailed room name management screen 330 can be closed if the user clicks on the OK command button control 336. When the user clicks on the cancel command button control 337, updating of a record is stopped and the detailed room name management screen 330 is closed.

Therefore, according to the room name management screen 320 and the detailed room name management screen 330, the addition of a new record or editing of the existing record can be freely performed in the room name table 262 of the database section 250 of the database program 246. Therefore, since a user-friendly interface can be provided, the installation place information (e.g., room names in this example) of the fire sensors 236 can be efficiently and correctly registered in the room name table 262. In addition, even in the case the installation place information is changed, for example, from a room number to a company department, the changed information can be reliably reregistered.

FIG. 31A shows a table management screen 340. In the figure, the table management screen 340 includes a title bar 341, which has a suitable character string (e.g., Table Management). The table management screen 340 further includes a client area 342, which has a list box control 343, an option group control 344, an edit command button control 345, an add command button control 346, a delete command button control 347, a print command button control 348, and a close command button control 349.

The list box control 343 lists the record information registered in the aforementioned record set 263 (see FIG. 26B). If any of the rows in the list box control 343 is selected, then the edit command button control 345 and the delete command button control 347 can be used ("True" is set to an enabled property).

The order of display in the list box control 343 is determined by the option box 344*a*, 344*b*, or 344*c* of the option group control 344. For example, if the address option box 344*a* is selected, "Address" is specified in the sort item. If the floor name option box 344*b* is selected, "Floor name" is specified in the sort item. If the room name option box 344*c* is selected, "Room name" is specified in the sort item. The sort items are displayed in the order sorted in ascending order or descending order.

The print command button control 348 shapes the data displayed in the list box control 343 in a predetermined form and prints the data. The printed examples are shown in FIGS. 32A to 32C. FIG. 32A shows a printed example in the case of address sorting. FIG. 32B shows a printed example in the case of floor-name sorting. FIG. 32C shows a printed example in the case of room-name sorting. If the user selects any of the three option boxes 344*a*, 344*b*, and 344*c* and clicks on the print command button control 348, a list of addresses, floor names, and room names rearranged in a desired sorting order can be printed and output. Therefore, the grasp of the addresses of the fire sensors 236 (in the case of address sorting), the grasp of addresses for each floor (in the case of floor-name sorting), and the grasp of an address for each room (in the case of room-name sorting) can be reliably performed.

The close command button control 349 is used to close itself (table management screen 340). Note that the "Address," "Floor name," and "Room name" columns in the list box control 343 list the information stored in the address field 263*a*, floor name field 263*b*, and room name field 263*c* of the record set 263.

If the user selects a certain row in the list box control 343 and clicks on the delete command button control 347, a specific record in the record set 263 corresponding to the selected row can be deleted. If the user selects a certain row in the list box control 343 and clicks on the edit command button control 345, a specific record in the record set 263 corresponding to the selected row can be extracted. The detailed table management screen 350 shown in the FIG. 28B can be opened and the extracted information can be displayed on the control within the screen. The detailed table management screen 350 can also be opened when the user clicks on the add command button control 346. In this case, the selected row in the list box control 343 is ignored.

In FIG. 31B, the detailed table management screen 350 includes a title bar 351, which has a suitable character string (e.g., detailed table management () where  represents an open mode). In the figure, since  is "add," it represents a record adding mode when the user clicks on the add command button control 346. The detailed table management screen 350 further includes a client area 352, which has an address list box control 353, a floor name list box control 354, a room name list box control 355, an OK command button control 356, and a cancel command button control 357**.

Note that the data source of the address list box control 353 is record information registered in the address table 260. The data source of the floor name list box control 354 is record information registered in the floor name table 261. The data source of the room name list box control 355 is record information registered in the room name table 262.

When the detailed table management screen 350 is opened in an add mode, no information is selected in the address list box control 353, floor name list box control 354, and room name list box control 355. The user selects a desired address, floor name, and room name from the respective lists and clicks on the OK command button control 356. For example, in the case where the fire sensors 236 are arranged as shown in FIG. 38A, the user selects address "A001," room name "room No. 101," and floor name "1st floor" and clicks on the OK command button control 356. This operation is repeatedly performed for the addresses of all fire sensors 236.

With this operation, the relation between each record of the room name table 262 and the address and floor name tables 260 and 261 is set and generation of the aforementioned record set 263 (see FIG. 26B) becomes possible.

When the detailed table management screen 350 is opened in an edit mode, related information between an address, a room name, and a floor name can be updated if the user changes the information (related information between an address, a room name, and a floor name) of an editing object. In addition, the detailed table management screen 350 can be closed if the user clicks on the OK command button control 356. When the user clicks on the cancel command button control 357, the updating is stopped and the detailed table management screen 350 is closed.

Therefore, according to the table management screen 340 and the detailed table management screen 350, the address table 260, floor name table 261, room name table 262 of the database section 250 of the database program 246 can be freely correlated with one another, and changes in the correlation can also be freely made. Therefore, since a user-friendly interface can be provided, changes in address and installation place of the fire sensors 236 can be efficiently performed.

Figure 33:
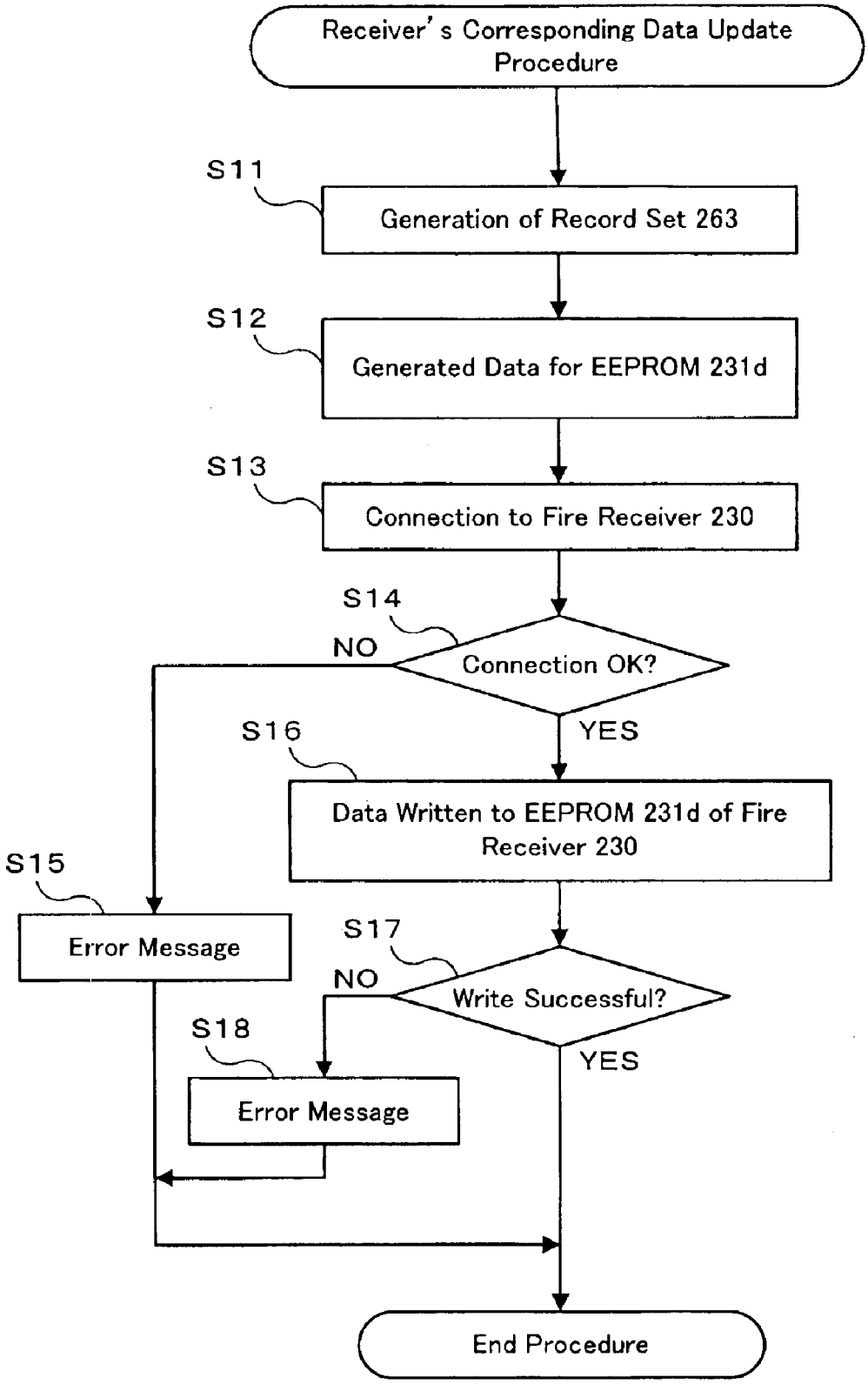
FIG. 33 is a flowchart showing a receiver's corresponding data update procedure.

FIG. 33 shows a flowchart of a receiver's corresponding data update procedure. This procedure is carried out when the user clicks on the receiver's corresponding data update command button control 277 of the main menu screen 270.

In this procedure, the record set 263 shown in FIG. 26B is first generated from the address table 260, floor name table 261, and room name table 262 (step S11). Using each record data stored in the record set 263, data (see the corresponding data 3 of FIG. 38B) to be written to the EEPROM 231*d* is generated (step S12). Then, a connection with the fire receiver 230 is confirmed (step S13). If there is no connection between the connection section 233 of the fire receiver 230 and the communication section 221 of the PC 210 (judgement of "NO" in step S14), a predetermined error message (e.g., "there is no connection with the fire sensor.") is displayed and the procedure ends (step S15).

On the other hand, if there is a connection with the fire receiver 230 (judgement of "YES" in step S14), the data generated in step S12 is written to the EEPROM 231*d* of the fire receiver 230 (step S16). Then, it is judged whether the write is successful (step S17). If it is successful, the procedure ends. If it is unsuccessful, a predetermined error message (e.g., "Data was written incorrectly. Please write it again.") is displayed and the procedure ends (step S18).

In accordance with the above-described procedure, the data stored in the EEPROM 231*d* of the fire receiver 230 (see the corresponding data 3 of FIG. 38B) can be overwritten and updated, if the user clicks on the receiver's corresponding data update command button control 277 of the main menu screen 270 with the communication section 233 of the fire receiver 230 connected with the communication section 221 of the PC 210 through the cable 209.

Therefore, if the identification information (address) of each fire sensor 263, warning-area information (e.g., floor names), and the installation place information (e.g., room names) of the fire sensors 263 are registered beforehand by employing the GUIs (address management screen 280, floor name management screen 300, room name management screen 320, table management screen 340, and detailed screens 290, 310, 330, and 350), the corresponding data stored in the EEPROM 231*d* of the fire receiver 230 can be quickly and easily overwritten and updated by the registered data. As a result, even when the installation place or room name of the fire sensor is changed, the corresponding data in the EEPROM 231*d* can be quickly updated.

While the above-described embodiment is applied to a local method in which the fire receiver 230 is connected with the PC 210 through the cable 209, the present invention is not limited to this embodiment. For example, the data stored in the fire receiver 230 in a remote place may be updated by remote control through a communication line.

Figure 34:
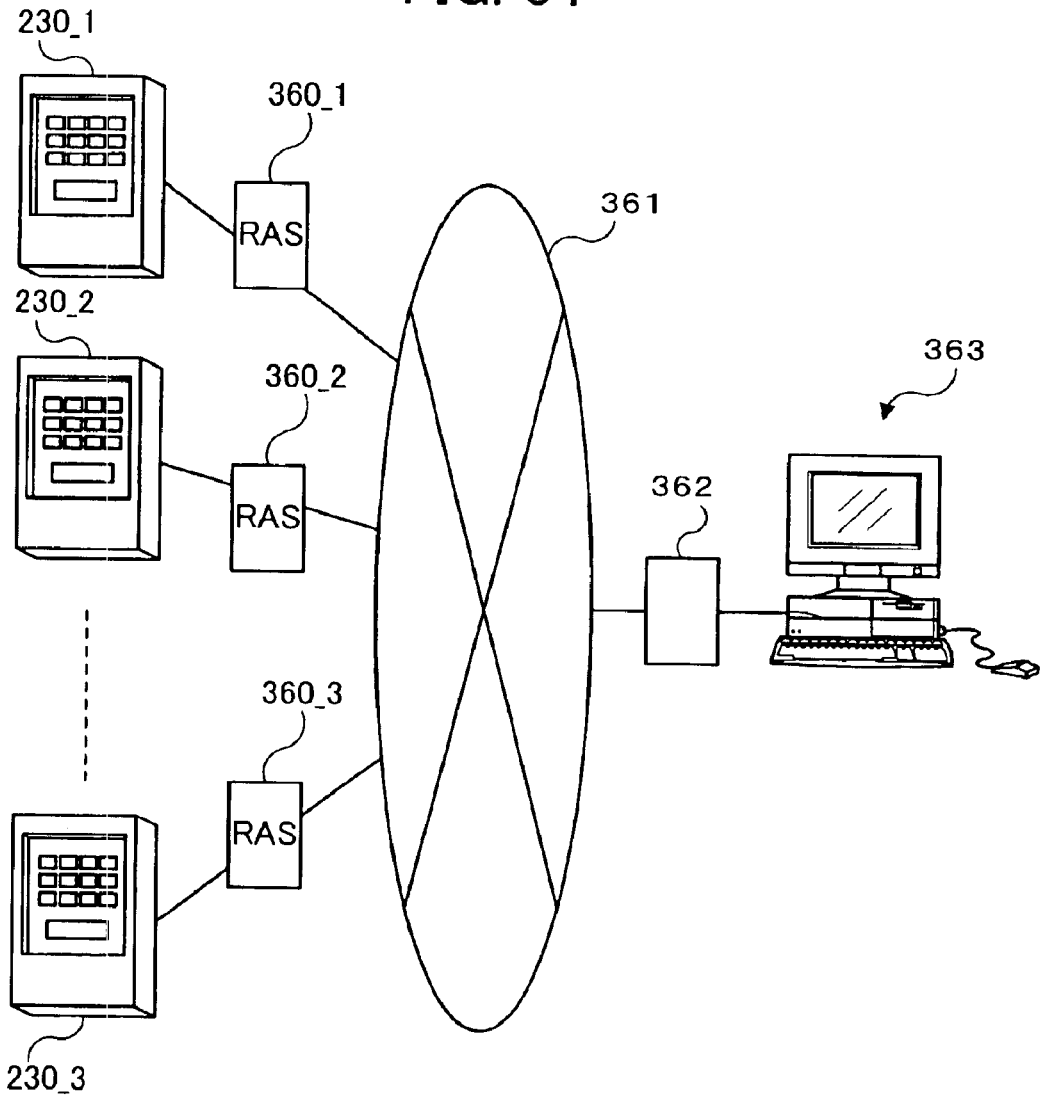
FIG. 34 is a diagram showing a fire data set support system constructed in accordance with an eighth embodiment of the present invention.

FIG. 34 shows afire data set support system constructed in accordance with an eighth embodiment of the present invention. In the figure, reference numerals 230_1 to 230_3 denote fire receivers. The fire receivers 230_1 to 230_3 are nearly identical in construction with the fire receiver 230 of the aforementioned embodiment, but differ in that the respective communication sections 233 are connected with a telephone line 361 through remote access servers 360_1 to 360_3. The remote access server receives access from an external terminal unit through the telephone line 361 (which includes an analog line, a digital line, a portable telephone, a personal handy-phone system (PHS), etc.) and performs services, such as resource release, etc., on the terminal unit.

The remote access servers 360_1 to 360_3 have inherent telephone numbers (also called RAS numbers). An external terminal unit is capable of having access to a fire receiver connected to a remote access server through the remote access server, by calling out the inherent telephone number.

On the other hand, the telephone line 361 is connected with a PC 363 through a modem (or a terminal adapter) 362. This PC 363 is provided with a fire data management system, improved based on the above-described database program 246 and application program 247 so that it can be connected with a plurality of fire receivers. The PC 363 further has the function of logging in the above-described remote access servers 360_1 to 360_3 (e.g., dial-up service in a general-purpose operating system such as Windows (R)).

Figure 35:
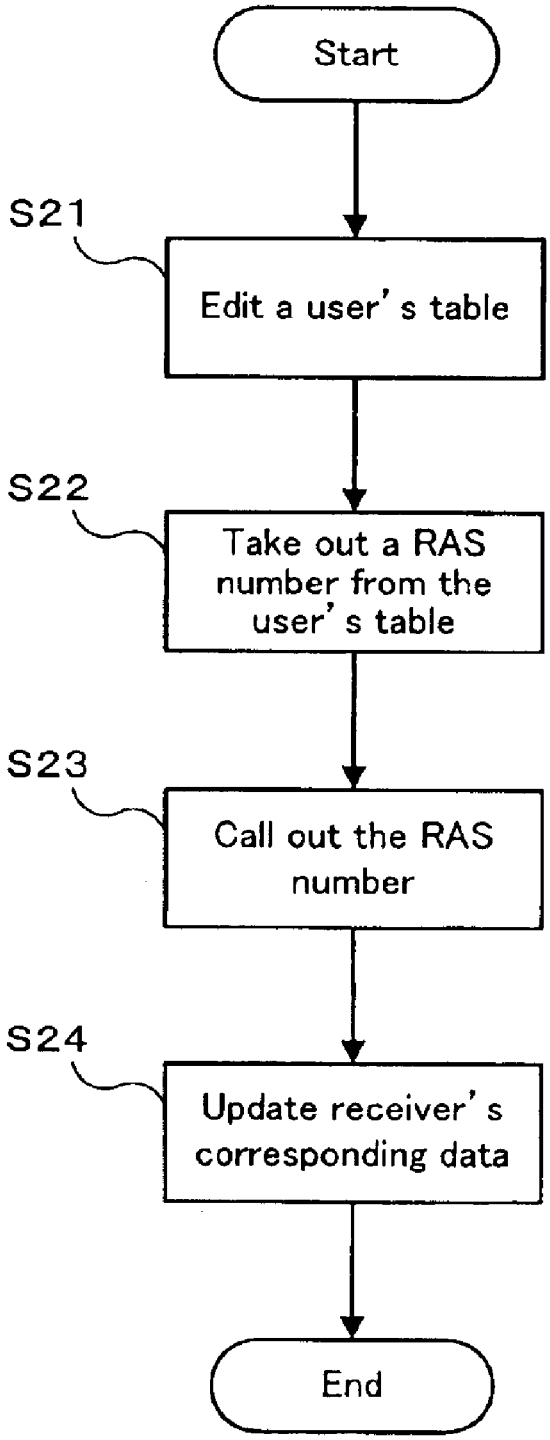
FIG. 35 is a flowchart showing a fire data management system provided in the fire data set support system of the eighth embodiment.

FIG. 35 shows a flowchart of the fire data management system provided in the fire data set support system of the eighth embodiment. When an arbitrary fire receiver (e.g., fire receiver 230-1) is controlled from a remote place, the user's tables (address table 260, floor name table 261, and room name table 262) are first edited by employing the aforementioned GUIs (address management screen 280, floor name management screen 300, room name management screen 320, table management screen 340, and detailed screens 290, 310, 330, and 350) (step S21).

If the editing is completed, the telephone number of the remote access server 360-1 connected to the fire receiver 230-1 is taken out from the user's tables or a telephone number list (step S22). The telephone number is called out through the modem 362 and telephone line 361 (step S23). If there is established a connection between the remote access server 360-1 and the modem 362, the data stored in the EEPROM 231*d* of the fire receiver 230 is updated with the data stored in the user's tables (address table 260, floor name table 261, and room name table 262) in the same procedure as the receiver's corresponding data update procedure of FIG. 33 (step S24).

Therefore, in accordance with the above-described improvement, the data stored in the EEPROM 231*d* of each of the fire receivers 230_1 to 230_3 can be updated from a remote place. Therefore, for instance, a convenient remote control system can be provided to users such as a building management company having a great number of fire receivers. Furthermore, the data stored in the EEPROM 231*d* can be updated by fire alarm facility manufacturers in place of users unaccustomed to PCs.

The main functions in the embodiment described above are realized functionally by an organic combination of hardware resources such as CPU 212, etc., and software resources such as operating system 245, database program 246, application program 247, etc. Since the hardware resources and the operating system are commercially available, the items indispensable to this embodiment are a program for displaying the aforementioned GUIs (address management screen 280, floor name management screen 300, room name management screen 320, table management screen 340, and detailed screens 290, 310, 330, and 350), and a program for realizing the aforementioned tables (address table 260, floor name table 261, and room name table 262).

Therefore, this embodiment includes these programs or portable recording media (e.g., a flexible disk, a CD-R, an MO, a hard disk, a semiconductor memory) storing these programs. More specifically, it includes program download services, provided on networks, for providing only record contents.

In the above-described embodiment, the data (corresponding data 3) stored in the EEPROM 231*b* of the fire receiver 230 (fire receivers 230_1 to 230_3) is updated locally or remotely by the PC 210 or PC 363. However, the present invention is not limited to this embodiment. For example, the present invention is applicable to a ninth embodiment that makes the setting of a World Wide Web (WWW) browser possible.

Figure 36:
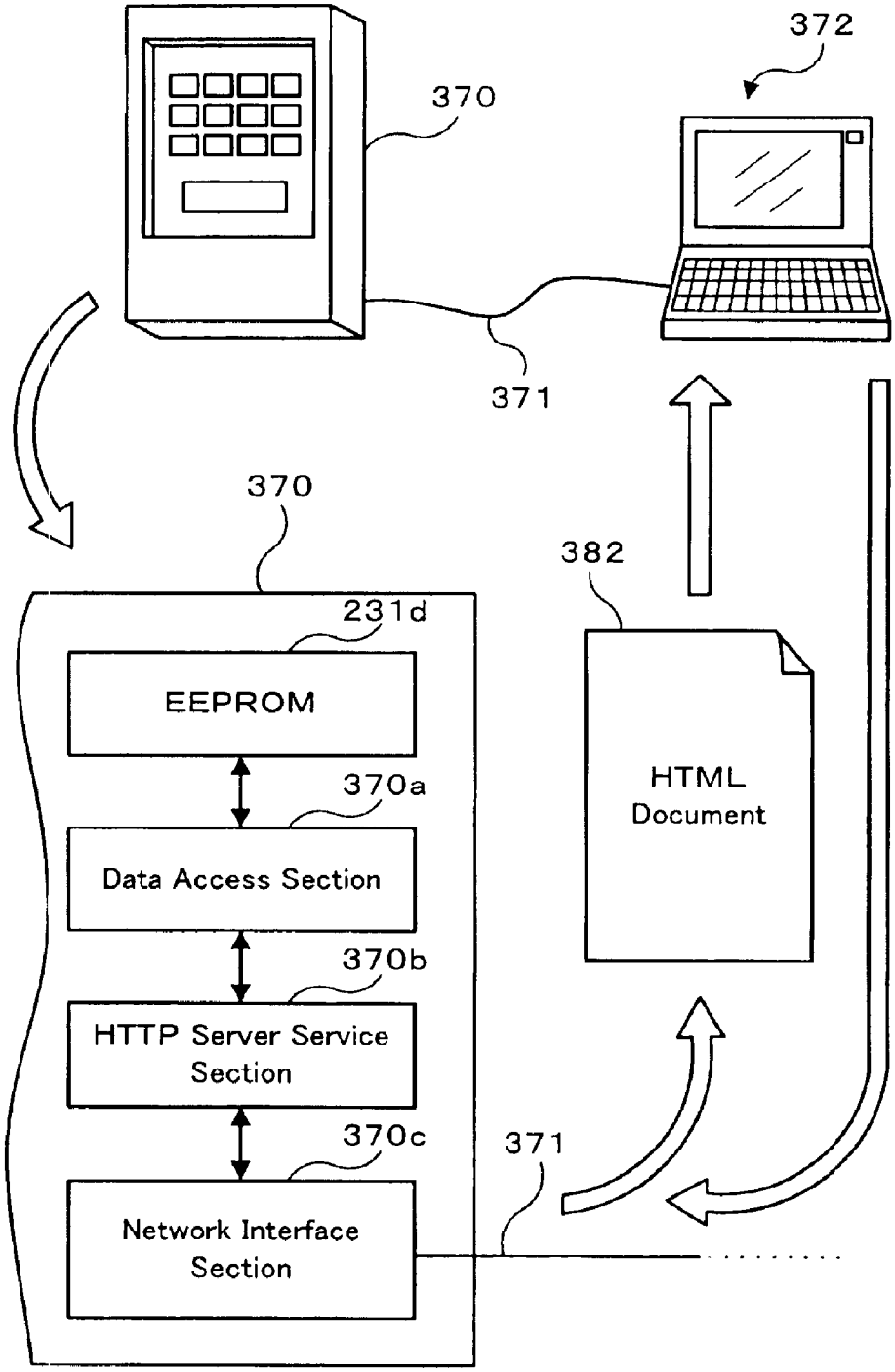
FIG. 36 is a diagram showing a ninth embodiment of the present invention that makes the setting of a WWW browser possible.

FIG. 36 shows the ninth embodiment of the present invention. In addition to the same function as the above-described fire receiver 230, a fire receiver 370 further has a data access section 370*a* and a hyper text transfer protocol (HTTP) server service section 370*b*. The data access section 370*a* is used to read out or update the data (see the corresponding data of FIG. 38B) stored in the EEPROM 231*b*. The HTTP server service section 370*b* is used to embed the data read out by the data access section 370*a* at a predetermined position in a HTML document 382, and open the HTML document 382 on a PC 372 provided on a network 371 (such as a LAN supporting at least an IP protocol) having an inherent IP address (e.g., a class-C private address of 192.168.1.1). The HTTP server service section 370*b* is also used to receive the data input to the HTML document 382, from the PC 372. The HTTP server service section 370*b* is further used to transfer the received data to the data access section 370*a* to update the data stored in the EEPROM 231*d*.

The PC 372 has at least an application program (so-called browser program) for reading the HTML document 382 and a network interface 370*c* (e.g., an Ethernet card, etc) for connecting to the network 371. Note that the PC in this embodiment may comprise a commercially available PC or portable information terminal unit. The reason is that most PCs or portable information terminal units are equipped with a browser program and a network card.

Figure 37:
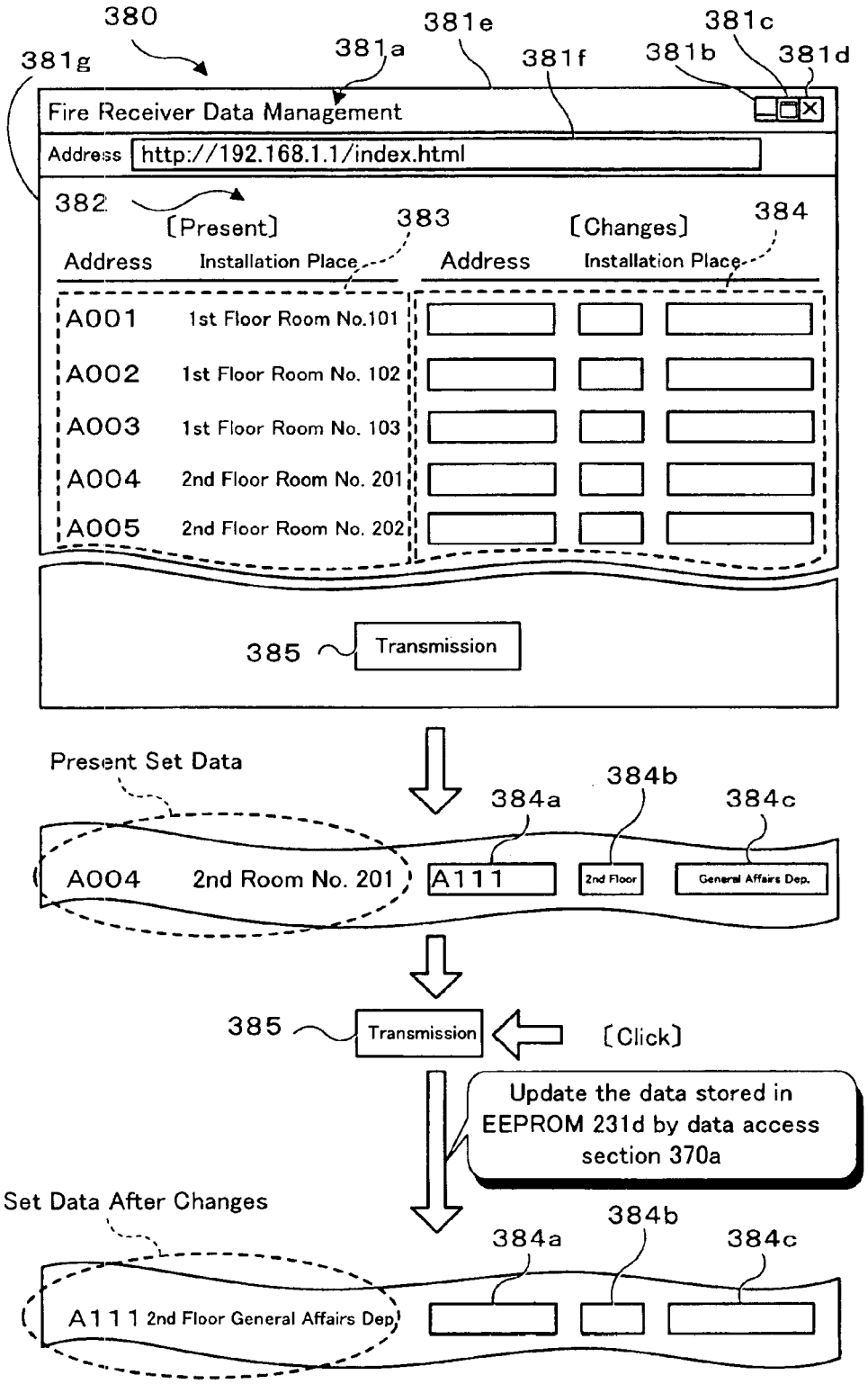
FIG. 37 is a diagram showing a browser program displayed on the screen of a PC.

FIG. 37 shows a browser program displayed on the screen of the PC 372. A form object 380 has a title bar 381*e*, an address box 381*f*, and a client area 318*g*. The title bar 381*e* has a title character string (e.g., Fire Receiver Data Management) 381*a*, a minimization button 381*b*, a maximization button 381*c*, and a close button 381*d*. The address box 381*f* is used for specifying a HTML document name (e.g., index html), an IP address (e.g., 192.168.1.1), and a server service section (e.g., http://). The client area 318*g* is used to display an HTML document.

In the figure, the address box 381*f* now has "192.168.1.1" for the IP address of the network interface section 370*c* of the fire receiver 370, "http://" for the server service section, and "index.html" for the HTML document name.

If the document name of the HTML document 382 which is opened by the HTTP server service section 170*b* of the fire receiver 370 is assumed to be "index.html," the character string (http://192.168.1.1/index.html) set to the address box 381*f* indicates the HTML document 382.

Therefore, the source code of the HTML document 382 is downloaded from the fire receiver 372 to the browser program of the PC 372. Then, the source code is decoded by the browser program and is displayed on the client area 381*g* of the form object 380.

In the displayed HTML document 382, a present set data display area 383 is disposed on the left side, a change data input area 384 is disposed on the right side, and a transmission command button control 385 is disposed on the lower side.

In the set data display area 383, the present data (see the corresponding data 3 of FIG. 38B) stored in the EEPROM 231*d* of the fire receiver 370 is listed. In the change data input area 384, an input text box control (which is rectangular in shape) for an address and an installation place (floor and room names) is disposed for each row of the set data display area 383.

The <Input Type> tag of the transmission command button control 385 has "submit." The <Form Action> tag of the HTML document 382 has a uniform resource location (URL) which includes an IP address (192.168.1.1) allocated to the network interface section 370*c* of the fire receiver 370. Furthermore, the "METHOD" option has "POST."

Therefore, if the user inputs changed data to the text box control and clicks on the transmission command button control 385, the input data is transmitted to the HTTP server service section 370*b* of the fire receiver 370 and transferred from the HTTP server service section 370*b* to the data access section 370*a*. Therefore, the present data (see the corresponding data 3 of FIG. 38B) stored in the EEPROM 231*b* can be updated with the transferred data.

For example, in the case where the data of the row of the address "A004" of the set data display area 383 shown in FIG. 37 is changed, new data (e.g., "A111," "2nd floor," and "General affairs department") is first input to the text box controls 384*a*, 384*b*, and 384*c* of the row. Then, if the user clicks on transmission command button control 385, the data (e.g., "A111," "2nd floor," and "General affairs department") input to the text box controls 384*a*, 384*b*, and 384*c* is transmitted to the URL set to the <Form Action> tag by the POST METHOD.

Since the destination is the URL that includes the IP address ("192.168.1.1") allocated to the network interface section 370*c* of the fire receiver 370, the HTTP server service section 370*b* of the fire receiver 370 receives the above-described input data ("A111," "2nd floor," and "General affairs department") and transfers the data to the data access section 370*a*. As a result, the present data (see the corresponding data 3 of FIG. 38B) stored in the EEPROM 231*d* is updated by the data access section 370*a*.

If display of the form object 380 is reloaded after the data changing operation, the changed data can be displayed on the set data display area 383, as shown in FIG. 37. In this manner, changes in data can be confirmed.

According to the embodiments shown in FIGS. 22 to 38, the corresponding data set to the fire receiver 370 can be easily read out or changed by the general-purpose PC 372 with a browser program and a network card. Therefore, there is no need to prepare a special data set support system, and the data in the fire receiver 370 can be managed by effectively utilizing resources such as commercially available PCs, portable information terminal units, etc. Furthermore, since the data management can be performed via the network 371, there is no need to go near the fire receiver 370 and therefore data management can be efficiently performed. In the case where a global IP address is statically allocated to the network interface section 370*c* of the fire receiver 370, data management can be performed on a worldwide scale through the network 371.

As set forth in the embodiments of FIGS. 22 to 38, the present invention has the following advantages:

The data addition and data update in the holding means are performed through the user's interface. In addition, data corresponding to the above-described identification information and installation place information is generated from data held in the holding means. The corresponding data is transferred to the fire receiver. Therefore, even when the installation place of the fire receiver is changed, the corresponding data in the fire receiver can be quickly updated.

If the transfer of the corresponding data to the fire receiver is performed through telephone lines, the corresponding data held in the fire receiver in a remote place can be updated without difficulty. For example, a business model such as a remote rewriting service can be realized.

In the present invention, when the HTML document is opened to network terminals, and the data input to the change data input control of the HTML document is received by reception means, the identification information and installation place information can be updated based on the received data. Since the network terminals can use general-purpose PCs having a browser program for the HTML document and a network connecting function, a reduction in system cost can be achieved.

Next, in the fire alarm system of the present invention, a system for supporting an operation of maintaining and inspecting facilities will be described in detail.

Figure 39:
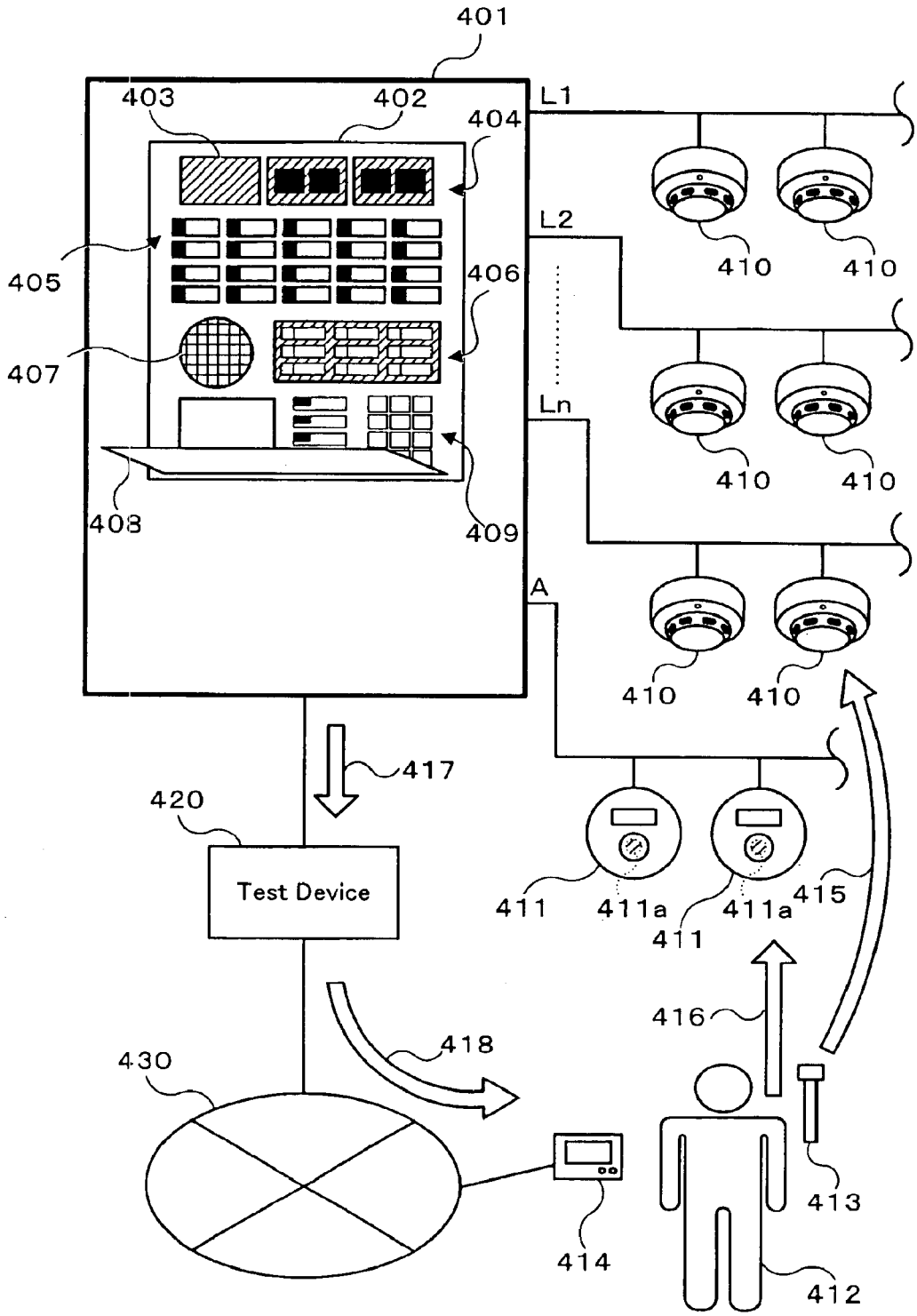
FIG. 39 is a diagram showing a P-type fire alarm system constructed in accordance with an eleventh embodiment of the present invention.

FIG. 39 shows a P-type fire alarm system (hereinafter referred to simply as a fire alarm system) constructed in accordance with an eleventh embodiment of the present invention. In the figure, a fire receiver 401 has a front panel 402, which is provided with various display buttons and control buttons. For instance, the front panel 402 is provided with a fire display light 403, an information light 404, an area display light 405 for displaying n areas, a control section 406, and a sound output section 407. Inside a small lid 408, there is provided a control display section 21 for maintenance and inspection.

The fire receiver 401 has n sensor lines L1 to Ln (in this embodiment, n=3) and a single transmitter line A. Each of the sensor lines L1 to Ln has a 2-line construction (pair construction of an L line and a C line). The transmitter line A also has a 2-line construction (pair construction of an A line and a C line). Each of the sensor lines L1 to Ln is connected in parallel with an arbitrary number of fire sensors 410. Similarly, the transmitter line A is connected in parallel with an arbitrary number of fire sensors 411.

The fire sensor 410 causes the connected sensor line (L and C lines) to be in a short-circuited state and issues fire information, when it detects a fire by smoke sensing or heat sensing. The fire receiver 401 always monitors the short-circuited state of each of the sensor lines L1 to Ln. If it detects the short-circuited state, the fire receiver 401 performs the required warning. That is, the fire receiver 401 specifies the area of the fire from the sensor line number, lights the area display light 405 corresponding to the area, lights the fire representative light 403, and sends out a warning sound.

The transmitter 411 has an information switch 411*a* which is operated at the time of an urgent situation such as a fire. When the information switch 411*a* is operated, the transmitter 411 causes the transmitter line A (A and C lines) to be in a short-circuited state and sends out urgent-situation information. The fire receiver 401 always monitors the short-circuited state of the transmitter A. If it detects the short-circuited state, the fire receiver 401 performs the required warning. That is, the fire receiver 401 lights the transmitter light 404 and the fire representative light 403 and rings the bell.

Therefore, the fire receiver 401 can collectively control the operating states of the fire sensors 410 for each group consisting of n sensor lines L1 to Ln (one group corresponds to one area). The fire receiver 401 can also collectively control the operating states of the transmitters 411 via the single transmitter line A.

In conventional P-type fire alarm systems, inherent identification information (hereinafter referred to as address information) are given to a fire sensor and a transmitter. At the time of a fire or urgent-situation information, the address information is sent to a fire receiver. The position of the fire or urgent condition can be specified in the unit of a sensor or transmitter by the fire receiver (for example, Japanese Laid-Open Patent Application No. 2001-184571).

In R-type fire alarm systems, a fire signal issued from a sensor or transmitter is received as an inherent signal directly or through a repeater. Similarly, the position of the fire or urgent condition can be specified in the unit of a sensor or transmitter by the fire receiver.

The above-described technique has been applied to the fire alarm system of the present invention. That is, the fire sensors 410 and the transmitters 411 have inherent addresses, respectively. When any of the fire sensors 410 issues fire information, the address of the fire sensor 410 is transmitted to the fire receiver 401. When the information switch 411*a* of an arbitrary transmitter 411 is operated, the address of the transmitter 411 is transmitted to the fire receiver 401.

Therefore, the fire receiver 401 is capable of sensing fire information and urgent-situation formation and lighting the area display light 405 and the transmitter light 404, and further specifying the address of the fire sensor 410 which issued fire information, or the address of the transmitter 411 which issued urgent-situation information.

The maintenance and inspection in the fire alarm system shown in FIG. 39 will hereinafter be described. A tester 412 with a test jig 413 and a portable terminal 414 operates the fire sensors 410 and transmitters 411 in sequence. For example, as shown by an arrow 415 in FIG. 39, the tester 412 generates a test smoke from the test jig 413 and blows the smoke against the fire sensor 410 when it is a smoke sensing type, or heats the fire sensor 410 with test jig 413 and tests the fire sensor 410 when it is a heat sensing type. As shown by an arrow 416, the tester 412 also tests the information switch 411*a* of the transmitter 411.

During the above-described maintenance and inspection, the fire receiver 401 monitors operation of the fire sensors 410 and transmitters 410. If the fire receiver 411 detects information from the fire sensor 410 or transmitter 411, the fire receiver 411 outputs the detected line number (L1 to Ln or A) and the address information of the fire sensor 410 or transmitter 411 to a test device 420 along with the detected information.

The test device 420 is connected to the fire receiver 401 when a maintenance and inspection operation is performed. The test device 420 generates a predetermined character message, based on the above-described information output from the fire receiver 401 (see an arrow 417) during maintenance and inspection (i.e., based on the fire or urgent-situation information from the fire sensor 410 or transmitter 411, line number (L1 to Ln or A), and the address information of the fire sensor 410 or transmitter 411 which issued the fire or urgent-situation information). The character message is transmitted from the fire receiver 401 to the portable terminal 414 through a communication infrastructure 430 (see an arrow 418).

The communication infrastructure 430 refers to a continuous connection type Internet protocol (IP) line such as a business line, a portable telephone (including a PHS) line, a public switched analog line, a digital public line, a digital subscriber line, a CATV, etc., and a combination of these lines and a LAN (or a WAN). That is, the communication infrastructure 430 means the existing communication infrastructures that can be used to transmit information between the test device 420 and the portable terminal 414.

The message to be transmitted to the portable terminal 414 is a character message differing from the conventional message (voice message) described above. This character message is information that can be confirmed through visual sensation. Therefore, since it does not use hearing sense, there is no possibility that the user will fail to hear a message or will hear it wrong. Therefore, the portable terminal 414 has to receive such a character message and display it.

The message that is transmitted to the portable terminal 414 is preferably a character string having meaning. This significant character string may be a room name or department name which indicates the installation place of the fire sensor 410 or transmitter 411 that issued fire information or urgent-condition information. A character message including such a significant character string is far superior in readability to a message comprising only figures or symbols. Therefore, the reliability of the confirmation of information can be considerably enhanced in combination with the utilization of visual sensation.

Figure 40:
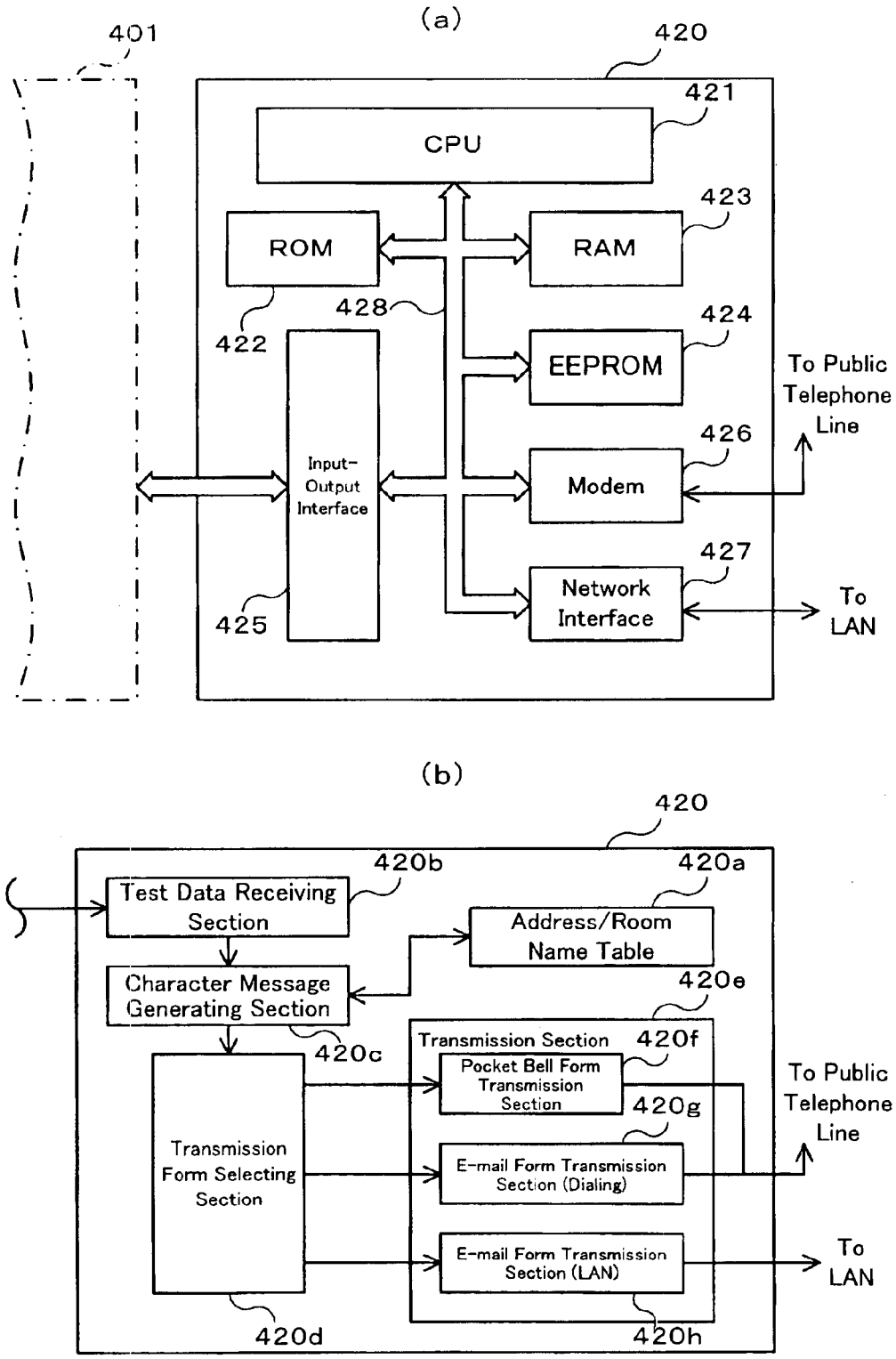
FIGS. 40A and 40B are block diagrams of the test device employed in the fire alarm system of FIG. 39.

FIG. 40A shows the construction of the test device 420. In the figure, the test device 420 comprises a CPU 421, a ROM 422, a RAM 423, an EEPROM 424, an input-output interface 425, a modem 426, a network interface 427, and a bus 428. The test device 420 is basically designed by a microprogramming technique. However, the present invention is not limited to this embodiment. For example, it may be designed by hard-wired logic.

The CPU 421 realizes various functions required of the test device 420, by loading the control program stored in the ROM 422 into the RAM 423. The RAM 423 provides a work area to the CPU 421. The EEPROM 424 rewrites stored variable data (e.g., an address/room name table described later, etc.) inherent in each system.

The input-output interface 425 transmits and receives information between the test device 420 and the fire receiver 401 in accordance with a predetermined protocol (e.g., a serial transfer protocol). The modem 426 performs digital communication through a public telephone line (which is a form of the communication infrastructure 430). The network interface 427 performs digital communication via a LAN or WAN ((which is another form of the communication infrastructure 430) in accordance with a general-purpose work protocol such as Ethernet.

FIG. 40B shows the functional blocks of the test device 420. The functional blocks 420*a* to 420*h* are realized virtually by an organic combination of hardware resources such as CPU 421 and software resources such as control programs stored in the ROM 422. These functional blocks are for purposes of understanding the present invention and not for purposes of limiting the invention.

The address/room name table 420*a* of the test device 420 is a table in which the address information of the fire sensors 410 and transmitters 411 of the fire alarm system is correlated with a name (corresponding to a significant character string and hereinafter referred to as a room name) which represents the installation place of the fire sensors 410 and transmitters 411.

Figure 41:
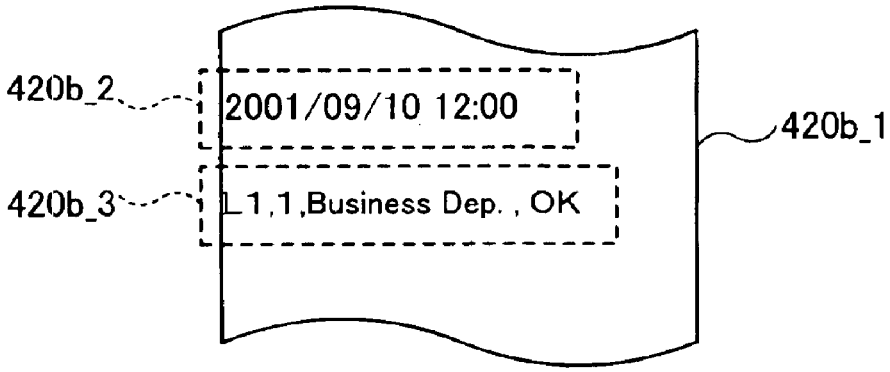
FIG. 41A is a diagram showing an example of the address/room name table shown in FIG. 40B.
FIG. 41B is a diagram showing a character message generated by the character message generation section of the test device.

FIG. 41A shows an example of the address/room name table 420*a*. This address/room name table 420 has an address field 420*a*_1 and a room name field 420*a*_2. One record stores a piece of address information, and room name information corresponding to the address information. For example, in the illustrated example, the room name corresponding to address number 1 is "Business department." The room name corresponding to address number 2 is "Design department." The room name corresponding to address number 3 is "Patent department." The room name corresponding to address number 4 is "General affairs department."

The test data receiving section 420*b* (detection means) of the test device 420 has the function of receiving the above-described information from the fire receiver 401 during maintenance and inspection (i.e., fire or urgent-situation information from the fire sensor 410 or transmitter 411, line number (L1 to Ln or A), the address information of the fire sensor 410 or transmitter 411 that issued the fire or urgent-situation information).

The character message generation section 420*c* (generation means) of the test device 420 makes reference to the address/room name table 420*a*, based on the address information received by the test data receiving section 420*b*. And the character message generation section 420*c* extracts room name information corresponding to the address information from the address/room name table 420*a*, and generates a character message which includes the address information, the room name information, and the detected line number.

FIG. 41B shows a character message generated by the character message generation section 420*c* of the test device 420. The character message 420*b*_1 consists of a time display section 420*b*_2 and an address display section 420*b*_3. In the illustrated example, the time display section 420*b*_2 has a character string of "2001/09/10 12:00," and the address display section 420*b*_3 has a character string of "L1, 1, business department, OK." The character string of "2001/09/10 12:00" represents "Sep. 10, 2001 and 12 hours." The character string of "L1, 1, business department, OK" represents "Line number: L1, Address: 1, Room name: business department, Test status: OK (pass)."

Therefore, it is found from these character string that the test of the fire sensor 410 (or transmitter 411) of address 1 connected to the line number L1 was executed at noon on Sep. 10, 2001 and was passed. It is also found that the installation place is the business department.

The transmission form selecting section 420*d* of the test device 420 is used to select one of all character-string transmission forms which can transmit the character message 420*b*_1 to the portable terminal 414 and can be executed through the modem 426 or network interface 427. For instance, character-string transmission forms that are executable through the modem 426 are a pocket bell transmission form through a public telephone line, a short mail transmission form provided by specific portable telephone (including PHS) service companies, an E-mail transmission form via an internet service provider (ISP) through a public telephone line, etc. Character-string transmission forms that are executable through the network interface 427 are an E-mail transmission form to be performed through a continuous connection line (ADSL, CATV, etc.) via a LAN (or WAN) or directly, etc.

The transmission section 420*c* (transmission means) of the test device 420 has transmission functions suitable to the above-described character-string transmission forms. For example, the transmission section 420*c* has a pocket bell form transmission section 420*f*, a dial-up form transmission section 420*f*, and a LAN form transmission section 420*h*.

Therefore, in accordance with the functional blocks of the test device 420 shown in FIG. 40B, the character message 420*b*-1 is generated during maintenance and inspection. That is, the address information of the fire sensor 410 (or transmitter 411) that issued test information, a significant character string representing the installation place (room name), the name of a line, and the test result, are generated. Then, a suitable character-string transmission form is selected. Next, the generated character message 420*b*_1 is transmitted to the portable terminal 414 of the tester 412.

As a result, the tester 412 can confirm the address information of the fire sensor 410 (or transmitter 411) that issued test information, the room name, the line name, and the test result, by visually confirming the character message 420*b*_1 displayed on the portable terminal 414. In addition, the confirmation of such information can be performed through visual sensation even at a noisy place. Furthermore, the character message 420*b*_1 includes not only a meaningless character string (line number and address information) but also a significant character string (room name, etc.). Therefore, misreading is prevented and the reliability of the confirmation of information can be considerably enhanced.

As previously described, the communication infrastructure 430 may be any of the existing communication infrastructures that can be used to transmit information between the test device 420 and the portable terminal 414. Therefore, it may be any of the following examples.

Figure 42:
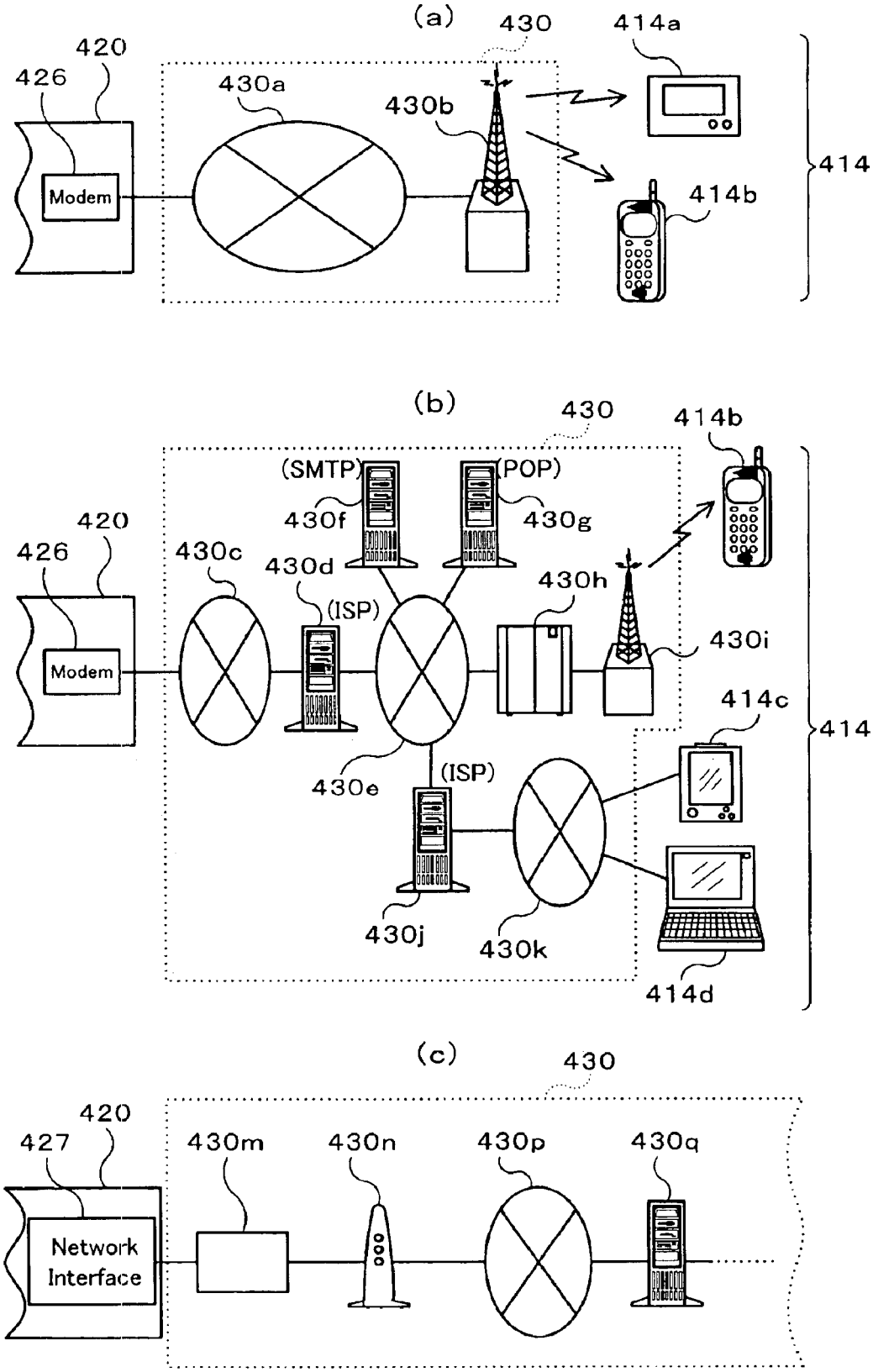
FIGS. 42A, 42B, and 42C are diagrams showing a typical communication infrastructure of the character-string transmission forms executable through a modem or network interface.

FIG. 42 shows a typical communication infrastructure 430 of the character-string transmission forms executable through the modem 426 or network interface 427.

The communication infrastructure 430 shown in FIG. 42A corresponds to a pocket bell transmission form, and a short mail transmission form provided by specific portable telephone (including PHS) service companies. The communication infrastructure 430 corresponding to these transmission forms calls a predetermined telephone number and calls out the portable terminal 414 corresponding to the above-described transmission forms via a base station 430*b* through a public telephone line 430*a*. For example, the communication infrastructure 430 can call out a pocket bell 414*a* or portable telephone (or PHS) 414*b* and transmit the character message 420*b*_1 to the pocket bell 414*a* or portable telephone (or PHS) 414*b*.

The communication infrastructure 430 shown in FIG. 42B corresponds to an E-mail transmission form that is performed by dialing. The communication infrastructure 430 corresponding to this transmission form logs in the access server 430*d* of an ISP through a public telephone line 430*c* from the modem 426 of the test device 420, and connects to an internet 430*e* via the access server 430*d*. Therefore, the character message 420*b*_1 (i.e., E-mail) transmitted from the modem 426 of the test device 420 can be transmitted to a portable terminal 414 (e.g., portable telephone (or PHS) 414*b*, personal digital assistants (PDA) 414*c*, or PC 414*d*) via a simple mail transfer protocol (SMTP) server 430*f* and a post office protocol (POP) server 430*g*. In FIG. 42B, reference numeral 430*j* denotes an access server through which the portable terminal 414 has access to the internet 430*e*. Reference numeral 430*k* denotes a public telephone line.

The communication infrastructure 430 shown in FIG. 42C is a modification of the communication infrastructure 430 shown in FIG. 42B, and corresponds to an E-mail transmission form that is performed under a continuous connection internet environment such as ADSL, CATV, etc. The communication infrastructure 430 corresponding to this transmission form logs in an access server 430*q* via a continuous connection line (ADSL or CATV line, etc.) through a router 430*m* and an ADSL modem (or a CATV modem) 430*n* from the network interface 427 of the test device 420. Thereafter, in the same manner as the communication infrastructure 430 shown in FIG. 42B, the character message 420*b*_1 (i.e., E-mail) can be transmitted to the portable terminal 441 (for example, portable telephone (or PHS) 414*b*, personal digital assistants (PDA) 414*c*, PC 414*d*, etc.).

Figure 43:
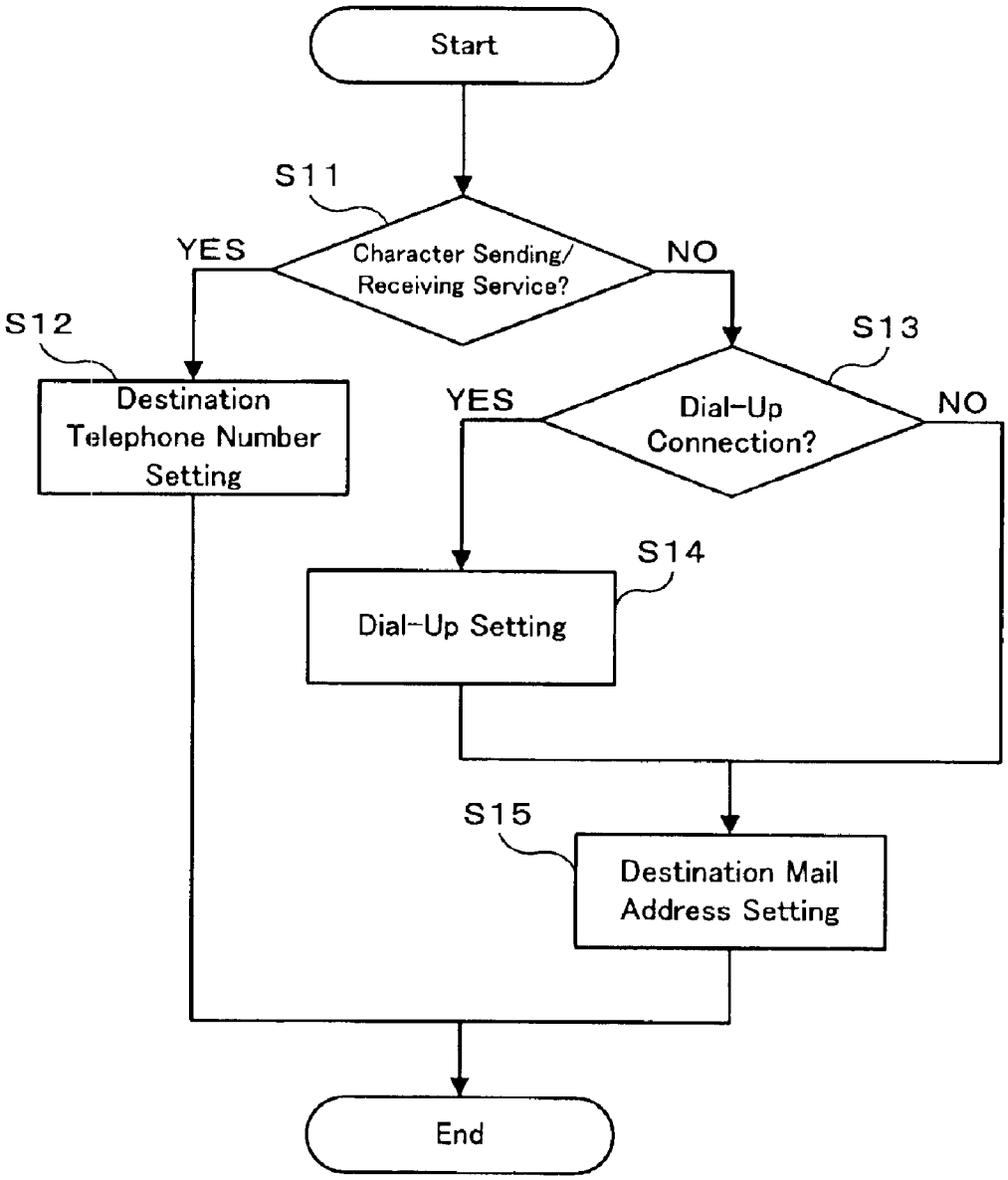
FIG. 43 is a flowchart of a control program (process of setting destination information) that is executed by the CPU of the test device.

FIG. 43 shows a flowchart of a control program that is executed by the CPU 421 of the test device 420. In the control program, destination information is set.

As shown in the figure, the test device 420 first judges whether or not the user has selected a character string sending/receiving service such as a pocket bell service and a short message service (see FIG. 42A (step S11). If it has been selected, the test device 420 sets an identification number (telephone number) for the portable terminal 414 (step S12).

On the other hand, if the above-described character string sending/receiving service has not been selected, then the test device 420 judges whether or not the connection is a dial-up connection (see FIG. 42B) (step S13). If it is a dial-up connection, the test device 420 sets the telephone number of the access server 430*d* of the contracted ISP (step S14) and then sets a destination address (step S15). If the connection is not a dial-up connection, the test device 420 judges that the service is a continuous connection environment (see FIG. 42C) and sets a destination address (step S15).

Thus, according to the above-described control program shown in FIG. 43, even in the case where any of various communication infrastructures 430 (FIGS. 42A to C) is selected, destination information (telephone number or mail address) suitable to the communication infrastructure can be set.

Figure 44:
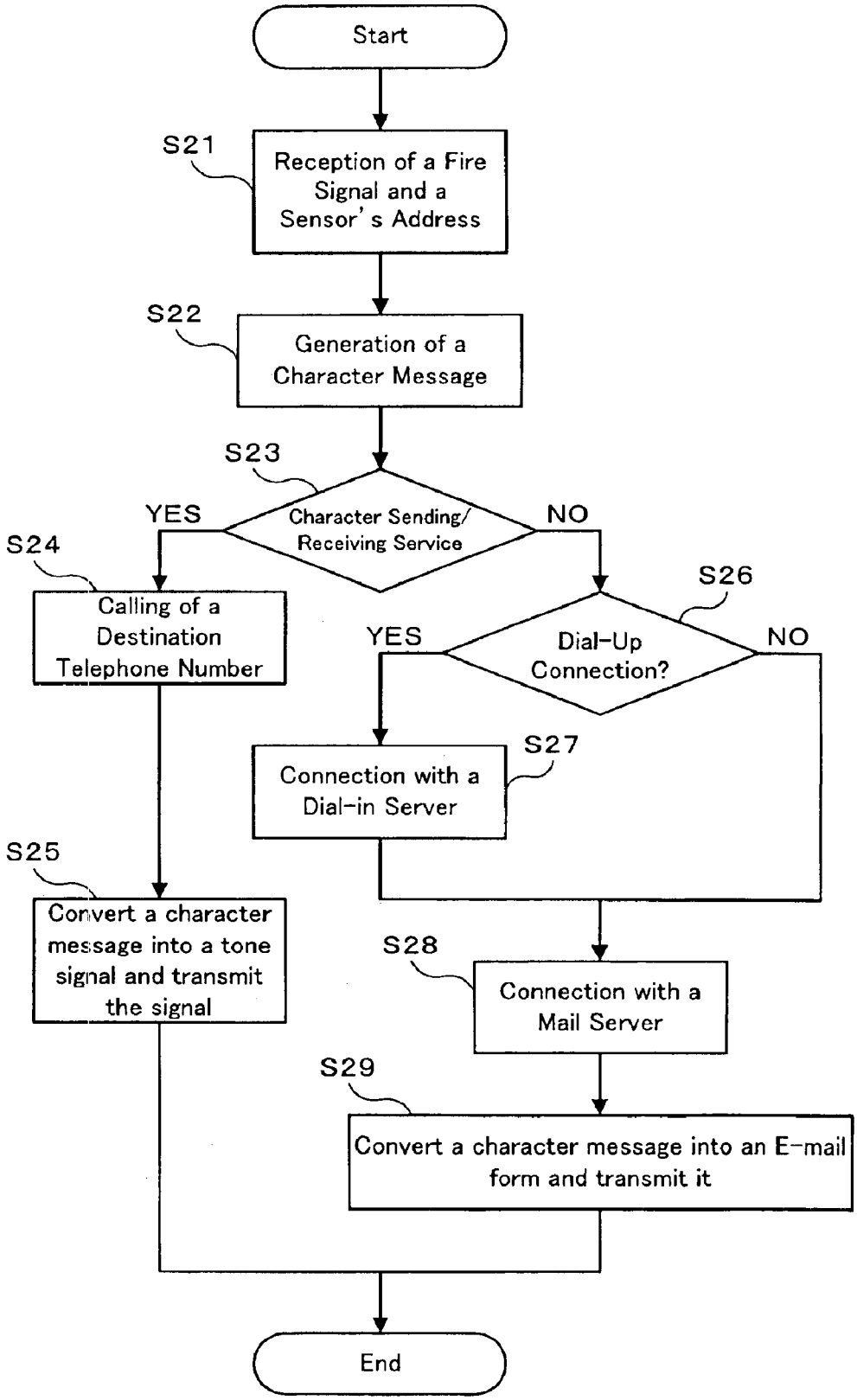
FIG. 44 is a flowchart of another control program (process from the generation of the character message to the transmission) that is executed by the CPU of the test device.

FIG. 44 shows a flowchart of another control program that is executed by the CPU of the test device. In the control program, the process from the generation of the character message 420*b*_1 to the transmission is performed.

As shown in the figure, the test device 420 first receives the operation information and address information of the fire sensor 410 or transmitter 411 during an operation test (step S21). Then, the test device 420 generates a character message 420*b*_1 which includes the received operation information and address information and further includes a significant character string (room name, etc.) corresponding to the received address information (step S22).

Next, the test device 420 judges whether or not the user has selected a character string sending/receiving service such as a pocket bell service and a short message service (see FIG. 42A (step S23). If it has been selected, the test device 420 calls out the telephone number of the portable terminal 414 (step S24), converts the character message 420*b*_1 to a tone signal, and sends it to the portable terminal 414 (step S25).

On the other hand, if the above-described character string sending/receiving service has not been selected, then the test device 420 judges whether or not the connection is a dial-up connection (see FIG. 42B) (step S26). If it is a dial-up connection, the test device 420 calls out the access server 430*d* of the contracted ISP (step S27) and then connects to the SMTP server 430 (step S28). If the connection is not a dial-up connection, the test device 420 judges that the service is a continuous connection environment (see FIG. 42C), and connects to the SMTP server 430*f* (step S28) without performing the above-described calling-out operation. In either case, the character message 420*b*_1 is converted into an E-mail form and transmitted with a destination address set to the destination ($T_o$) header.

Thus, according to the above-described control program shown in FIG. 44, even in the case where any of various communication infrastructures 430 (FIGS. 42A to C) is selected, the character message 420*b*_1 during maintenance and inspection can be transmitted to the portable terminal 414 suitable to the communication infrastructure 430 (e.g., pocket bell 414*a*, portable telephone (or PHS) 414*b*, PDA 414*c*, and PC 414*d*).

Figure 45:
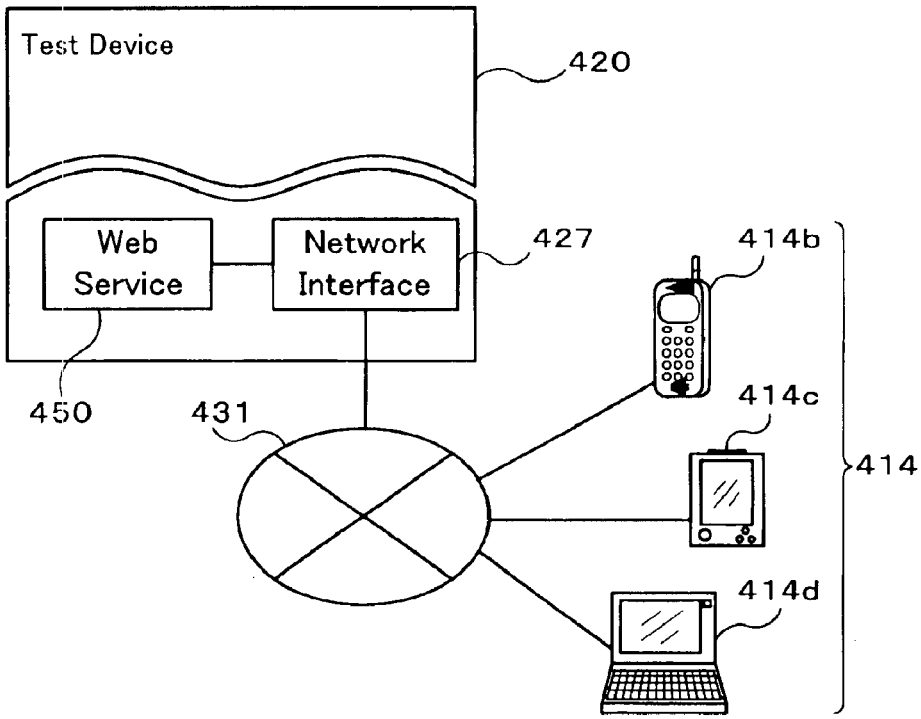
FIG. 45A is a diagram showing an improvement of the test device.
FIG. 45B is a diagram showing the history information displayed on a portable information terminal.
Figure 46:
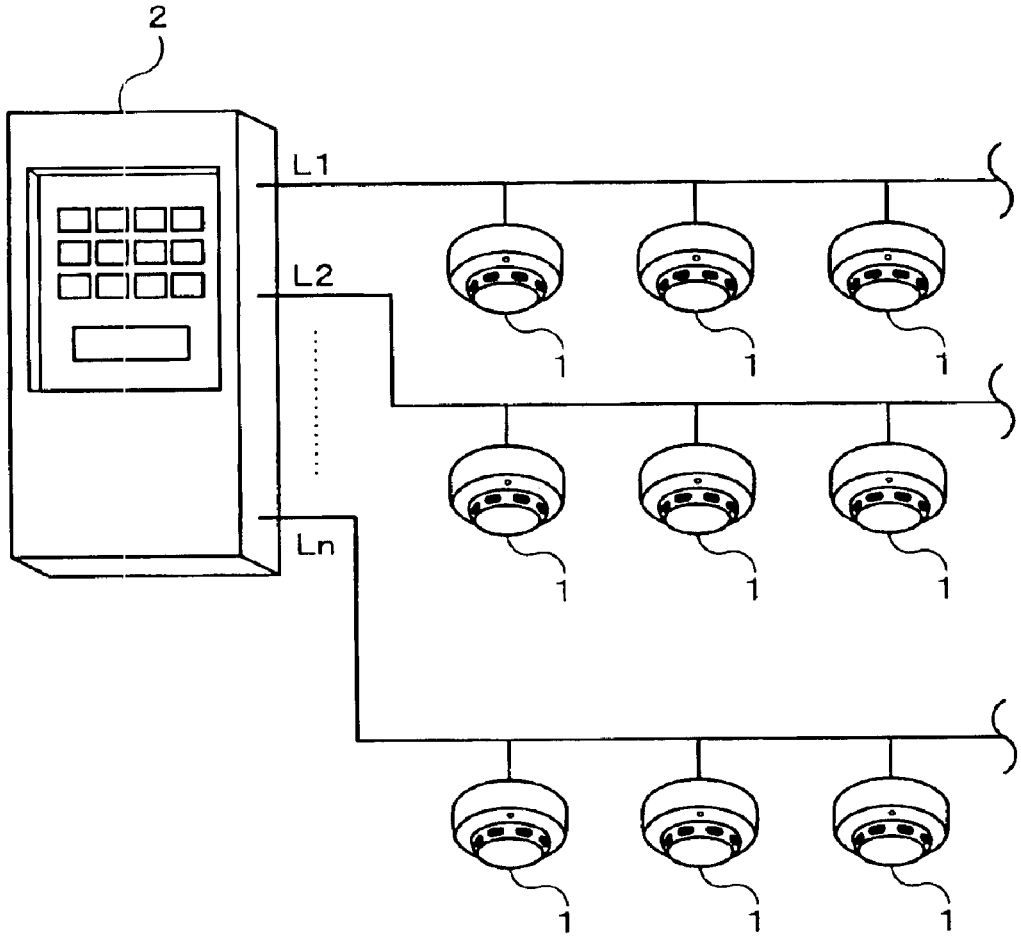
FIG. 46 is a diagram showing a P-type fire alarm system.

FIG. 45A shows an improvement of the test device 420. In the improvement, the test device 420 is equipped with the function of a web service (open means) 450 (HTTP server service). If the history information during maintenance and inspection is opened on an IP network 431 by the web service 450, the history information can be freely read by a portable terminal 414 of a browser corresponding type (e.g., a portable telephone 414*b* with an i mode (trademark), a PDA 414*c* or PC 414*d* with a browser program).

FIG. 45B shows the history information displayed on the portable terminal 414. The document 451 displayed on the portable terminal 414 is a document of a hyper text markup language (HTML) form opened by the web service 450. The document 451 lists the history information of a maintenance and inspection operation such as test date, a line number, address information, a significant character string (room name, etc.), a test result (status), etc. Therefore, since the history information can be confirmed at any time during or after the maintenance and inspection of the fire alarm system, the oversight of inspection can be judged from the history information. In addition, if the history information is stored as electronic data, the quantity of paper to record maintenance and inspection can be considerably saved.

As set forth above, the test device 420 of the present invention has the following advantages:

Since test results are transmitted in the form of a character message to the portable terminal 414, the test results can be confirmed by visual sensation. Therefore, there is no possibility that the user will fail to hear test results or will hear them wrong, and the reliability of the transmission of information can be enhanced.

As the character message includes a significant character string (room name, etc.), it is superior in readability to simple numerical value or symbol information such as address information, a line number, etc. This can also enhance the reliability of the transmission of information.

The web service 450 enables users to have free access to the history of maintenance operations. Because of this, the history of operations can be confirmed at any time during or after maintenance and inspection. Therefore, the oversight of inspection can be judged from the history, and the operation history can be stored as electronic data. If the history of operations are stored in the form of electronic data, the electronic data can be attached as a report document and therefore the reliability of the report of inspection results can be enhanced.

As set forth in the embodiments of FIGS. 39 to 45, the present invention has the following advantages:

During the maintenance and inspection of the fire alarm system, a character message including test results is transmitted to the portable terminal of the tester. The test results are confirmed by visually recognizing the character message. Therefore, since test results can be confirmed not by hearing but by visual sensation, there is no possibility that the user will fail to hear the test results or will hear them wrong. As a result, the reliability of the transmission of information can be enhanced.

In addition, during the maintenance and inspection of the fire alarm system, the test results are displayed on the portable terminal of the tester, and at the same time, a character message including a significant character string is transmitted. The test results are confirmed by visually recognizing the character message. Therefore, since the character message includes a significant character string, misreading can be prevented. This can also enhance the reliability of the transmission of information.

According to a preferred form of the present invention, the character message that is transmitted to the portable terminal of a tester includes a character string specifying the installation place of a fire sensor or transmitter being tested. Therefore, a corresponding relation with the actual installation place can be correctly grasped and errors in the maintenance operation can be avoided.

According to another form of the present invention, free access to the messages transmitted is made possible by an arbitrary terminal connected to a network. As a result, the results of maintenance and inspection can be confirmed afterward. In addition, since the transmitted messages can be stored as electronic data, the quantity of paper to record maintenance and inspection can be considerably saved.

While the present invention has been described with reference to the preferred embodiments thereof, the invention is not to be limited to the details given herein. As this invention may be embodied in several forms without departing from the spirit of the essential characteristics thereof, the present embodiments are therefore illustrative and not restrictive. Since the scope of the invention is defined by the appended claims rather than by the description preceding them, all changes that fall within the metes and bounds of the claims, or equivalence of such metes and bounds thereof are therefore intended to be embraced by the claims.

What is claimed is:

1. A fire alarm system for connecting a plurality of fire sensors to sensor lines drawn from a fire receiver, and giving an alarm in response to a fire information signal output from the fire sensor in a line unit, said fire alarm system comprising:

current modulation means, provided in said fire sensors, for maintaining a sensing current supplied from said fire receiver at a predetermined value for a predetermined time at the time of a fire, and modulating said sensing current in accordance with inherent address information of said fire sensor after said predetermined time; and address specification means, provided in said fire receiver, for sensing fire information by judging whether or not said sensing current has been maintained at said predetermined value for said predetermined time, and also for specifying the inherent address of the fire sensor that issued said fire information, from a modulated state of said current after said predetermined time.

2. Fire sensors which are employed in a fire alarm system for connecting a plurality of fire sensors to sensor lines drawn from a fire receiver, and giving an alarm in response to a fire information signal output from the fire sensor in a line unit, of said fire sensors comprising:

current modulation means provided in said fire sensors, for maintaining a sensing current supplied from said fire receiver at a predetermined value for a predetermined time at the time of a fire, and modulating said sensing current in accordance with inherent address information of said fire sensor after said predetermined time.

3. A fire receiver which is employed in a fire alarm system for connecting a plurality of fire sensors to sensor lines drawn from a fire receiver, and giving an alarm in response to a fire information signal output from the fire sensor in a line unit, said fire receiver comprising:

address specification means, provided in said fire receiver, for sensing fire information by judging whether or not a sensing current has been maintained at a predetermined value for a predetermined time, and also for specifying the inherent address of the fire sensor that issued said fire information, from a modulated state of said sensing current after said predetermined time.

4. A repeater which is employed in a fire alarm system for connecting a plurality of fire sensors to sensor lines drawn from a fire receiver, and giving an alarm in response to a fire information signal output from the fire sensor in a line unit, said repeater comprising:

current modulation means, provided in said fire sensors, for maintaining a sensing current supplied from said fire receiver at a predetermined value for a predetermined time at the time of a fire, and modulating said sensing current in accordance with inherent address information of said fire sensor after said predetermined time.

* * * * *